US010697619B2

(12) United States Patent
Toyohisa et al.

(10) Patent No.: US 10,697,619 B2
(45) Date of Patent: Jun. 30, 2020

(54) SURFACE LIGHT EMISSION SYSTEM, LIGHTING SYSTEM, AND LIGHTING SPACE REPRODUCTION METHOD

(71) Applicants: KILT PLANNING OFFICE INC., Kawasaki-shi, Kanagawa (JP); KANEKA CORPORATION, Osaka-shi, Osaka (JP)

(72) Inventors: Shozo Toyohisa, Kawasaki (JP); Harunobu Izumo, Kawasaki (JP); Tomoki Kubo, Tokyo (JP); Youichi Yamaguchi, Tokyo (JP)

(73) Assignees: KILT PLANNING OFFICE INC., Kawasaki-Shi, Kanagawa (JP); KANEKA CORPORATION, Osaka-Shi, Osaka (JP)

( * ) Notice: Subject to any disclaimer, the term of this patent is extended or adjusted under 35 U.S.C. 154(b) by 0 days.

(21) Appl. No.: 16/330,466

(22) PCT Filed: Jun. 14, 2017

(86) PCT No.: PCT/JP2017/021922

§ 371 (c)(1),
(2) Date: Mar. 5, 2019

(87) PCT Pub. No.: WO2018/047430

PCT Pub. Date: Mar. 15, 2018

(65) Prior Publication Data

US 2019/0203914 A1 Jul. 4, 2019

(30) Foreign Application Priority Data

Sep. 8, 2016 (JP) ..... 2016-175854

(51) Int. Cl.
*F21V 21/30* (2006.01)
*F21V 14/02* (2006.01)
(Continued)

(52) U.S. Cl.
CPC ..... *F21V 21/30* (2013.01); *F21S 6/00* (2013.01); *F21S 8/00* (2013.01); *F21S 8/033* (2013.01);
(Continued)

(58) Field of Classification Search
CPC ..... F21V 21/30; F21V 19/02; F21V 21/29; F21V 14/02; F21S 8/00; F21S 8/033;
(Continued)

(56) References Cited

U.S. PATENT DOCUMENTS 9,033,547 B2 * 5/2015 Manahan ..... F21V 21/14 362/249.03
9,599,297 B2 * 3/2017 Stephens ..... F21S 8/08
(Continued)

FOREIGN PATENT DOCUMENTS

CN 201170467 Y 12/2008
EP 2295848 A2 3/2011
(Continued)

OTHER PUBLICATIONS

International Bureau of WIPO, International Preliminary Report on Patentability Issued in Application No. PCT/JP2017/021922, dated Mar. 12, 2019, WIPO, 10 pages.
(Continued)

*Primary Examiner* — Peggy A Neils
(74) *Attorney, Agent, or Firm* — Alleman Hall Creasman & Tuttle LLP

(57) ABSTRACT

An object of the present invention to provide a surface light-emission system that can change its posture and can be safely used. There is provided a surface light-emission system including: a surface light-emitting module including a surface light-emitting panel with an emission surface; and a supporting part rotatably supporting the surface light-emitting module in a circumferential direction directly or indirectly. Furthermore, In the surface light-emission system, the supporting part is capable of supplying electric power to the surface light-emitting panel and includes a
(Continued)

movable range restriction unit restricting a movable range in a circumferential direction of the surface light-emitting module.

15 Claims, 41 Drawing Sheets

(51) Int. Cl.

| | |
|---|---|
| ***F21V 19/02*** | (2006.01) |
| ***F21S 8/04*** | (2006.01) |
| ***F21S 8/00*** | (2006.01) |
| ***F21S 6/00*** | (2006.01) |
| ***F21V 23/04*** | (2006.01) |
| ***F21V 21/28*** | (2006.01) |
| ***F21Y 115/15*** | (2016.01) |
| ***F21Y 105/00*** | (2016.01) |

(52) U.S. Cl.
CPC ..... *F21S 8/04* (2013.01); *F21V 14/02* (2013.01); *F21V 19/02* (2013.01); *F21V 21/28* (2013.01); *F21V 23/0492* (2013.01); *F21Y 2105/00* (2013.01); *F21Y 2115/15* (2016.08)

(58) Field of Classification Search
CPC ..... F21S 8/04; F21Y 2105/00; F21Y 2115/15; H01L 2251/5361
See application file for complete search history.

(56) References Cited

U.S. PATENT DOCUMENTS

| | | | | |
|---|---|---|---|---|
| 9,615,409 | B2 * | 4/2017 | Matsuda | H01L 27/3293 |
| 9,854,919 | B1 * | 1/2018 | Risdon | A47C 21/003 |
| 2007/0064425 | A1 | 3/2007 | Frecska et al. | |
| 2009/0323365 | A1 | 12/2009 | Ochiai | |
| 2010/0103659 | A1 | 4/2010 | Chen | |
| 2015/0354794 | A1 | 12/2015 | Guercio et al. | |
| 2016/0353530 | A1 | 12/2016 | Matsuda | |
| 2017/0074488 | A1 | 3/2017 | Fujisawa et al. | |
| 2017/0146203 | A1 * | 5/2017 | Belaidi | H01L 25/048 |
| 2017/0164433 | A1 | 6/2017 | Matsuda | |
| 2019/0186714 | A1 * | 6/2019 | Bergman | F21S 6/005 |

FOREIGN PATENT DOCUMENTS

| | | | |
|---|---|---|---|
| EP | 2924332 | A1 | 9/2015 |
| JP | 2002208492 | A | 7/2002 |
| JP | 2010009970 | A | 1/2010 |
| JP | 3159960 | U | 6/2010 |
| JP | 2010198908 | A | 9/2010 |
| JP | 2011070985 | A | 4/2011 |
| JP | 2013247176 | A | 12/2013 |
| JP | 2015090778 | A | 5/2015 |
| JP | 2015191820 | A | 11/2015 |
| JP | 2015225799 | A | 12/2015 |
| JP | 2016103448 | A | 6/2016 |
| WO | 2010146534 | A1 | 12/2010 |
| WO | 2013036876 | A2 | 3/2013 |

OTHER PUBLICATIONS

ISA Japan Patent Office, International Search Report Issued in Application No. PCTJP2017021922, dated Aug. 8, 2017. WIPO, 4 pages.

European Patent Office, Supplementary European Search Report Issued in Application No. 17848375, dated May 24, 2019, 2 pages.

* cited by examiner

A-A CROSS-SECTIONAL VIEW

DIRECT LIGHTING POSTURE

INDIRECT LIGHTING POSTURE

DIRECT LIGHTING POSTURE

SURFACE LIGHT EMISSION SYSTEM, LIGHTING SYSTEM, AND LIGHTING SPACE REPRODUCTION METHOD

TECHNICAL FIELD

The present invention relates to a surface light emission system, a lighting system, and a lighting space reproduction method.

BACKGROUND ART

The organic EL panel is a surface light source and has a feature of being thin and light. Hence, there are few restrictions on installation places and it is used for various purposes in recent years. When this organic EL panel is used as a lighting device, it is possible to set an unprecedented lighting space.

For example, in the organic EL module of Patent Document 1, by directly contacting and electrically connecting the shaft portion and the bearing part, the light-emitting panel can be rotated and power can be supplied in any posture, thereby enabling use as direct lighting and as indirect lighting according to the posture to the wall surface. Therefore, it is possible to set the lighting space according to the intended use by the user.

PRIOR ART DOCUMENT

Patent Document

Patent Document 1: JP 2013-247176 A

DISCLOSURE OF INVENTION

Technical Problem

However, the organic EL module of Patent Document 1 has a problem that since the organic EL panel rotates endlessly beyond 360 degrees when rotated in the circumferential direction, the organic EL panel does not stop at a desired position when rotated. Hence, there is a possibility that the organic EL panel rotates so excessively that the organic EL panel is damaged by colliding with surrounding objects or catches the user's finger.

Further, the organic EL module of Patent Document 1 has a structure in which the terminal of the shaft portion and the terminal of the bearing part are in direct contact with each other to support and thus power is supplied, and it hence has a problem that when changing the posture, the shaft portion and the bearing part rotate while sliding, causing each terminal to wear easily.

Furthermore, in the organic EL module of Patent Document 1, the organic EL panel rotates endlessly. Therefore, when a lighting space is set in advance, it is difficult to match the organic EL panel with the set posture and it is difficult to reproduce the lighting space. Therefore, there is a problem that fine adjustment by a technician is required when reproducing the lighting space.

It is therefore an object of the present invention to provide a surface light-emission system that can change its posture and can be safely used. It is another object of the present invention to provide a lighting system and a lighting space reproduction method that can set or reproduce a desired lighting space using a surface light-emission system.

Solution to Problem

One aspect of the present invention for solving the above-mentioned problems is to provide a surface light-emission system including: a surface light-emitting module that includes a surface light-emitting panel having an emission surface; and a supporting part that supports the surface light-emitting module rotatably in a circumferential direction directly or indirectly, wherein the supporting part is capable of supplying electric power to the surface light-emitting panel, and wherein the supporting part includes a movable range restriction unit that restricts a movable range of the surface light-emitting module in a circumferential direction.

According to this aspect, since the movable range restriction unit of the supporting part restricts the movable range in the circumferential direction of the surface light-emitting module, it is possible to prevent the surface light-emitting module from rotating endlessly when caused to rotate in the circumferential direction, and it is possible to prevent the surface light-emitting module from being damaged by colliding with surrounding objects and from injuring the user by colliding with him.

A preferable aspect is that the movable range restriction unit restricts a movable range of rotation in a circumferential direction of the surface light-emitting module to less than 360 degrees.

According to this aspect, the movable range in one direction is restricted to one turn, and it is possible to prevent the surface light-emitting module from rotating excessively in the circumferential direction.

A preferable aspect is that the movable range restriction unit physically regulates a movable range of rotation in a circumferential direction of the surface light-emitting module.

The "physically regulate" used here refers to regulation not by an electrical mechanism such as control but by a structural mechanism based on the relationship between an object and an object.

According to this aspect, it is less susceptible to problems such as electricity or program malfunction, and it is possible to more reliably restrict the movable range in the circumferential direction of the surface light-emitting module.

A preferable aspect is that the supporting part includes a motor and a clutch, and a rotational force of the motor is transmitted via the clutch, so that the surface light-emitting module rotates in a circumferential direction.

According to this aspect, since the clutch is interposed between the motor and the surface light-emitting module, when an overload is applied to the motor, the connection between the motor and the surface light-emitting module is cut off, and torque transmission from the motor to the surface light-emitting module can be blocked. Therefore, the motor is less likely to be overloaded and less likely to be damaged.

A preferable aspect is that the supporting part includes a main body and a fixing part, the fixing part being rotatable in a circumferential direction with respect to the main body relatively, and the surface light-emitting module is fixed to the fixing part with a temporary fastening element.

The "temporary fastening element" used here refers to a type of fastening element that essentially is a fastening element removable without destroying, for example, a combination of a screw and a bolt nut.

According to this aspect, the surface light-emitting module rotates in the circumferential direction according to the relationship between the main body and the fixing part in the supporting part, and the surface light-emitting module can be attached to and detached from the fixing part by attaching or detaching the temporary fastening element. Therefore, it is unnecessary to disassemble the surface light-emitting module at the time of replacement or the like, and it is easy to replace the surface light-emitting module at the time of maintenance or the like.

A preferable aspect is that the supporting part includes a main body, a fixing part, a shaft part, and a wiring part, the fixing part is coupled with the main body via the shaft part, the fixing part being rotatable in a circumferential direction with respect to the main body relatively, the shaft part is a hollow body having a wiring space therein, and the wiring part is electrically connectable with an external power source, the wiring part being connected electrically from the main body to the surface light-emitting panel through the wiring space of the shaft part.

According to this aspect, the external power source and the surface light-emitting panel are electrically connected to each other via the wiring part, thereby supplying the power. Therefore, if the surface light-emitting module rotates excessively, the wiring part may become entangled or the wiring part may be twisted, and in some cases the wiring part may be damaged. Even in such a case, according to this aspect, since the supporting part restricts the movable range in the circumferential direction of the surface light-emitting module, it is possible to prevent the wiring part from becoming entangled or twisted excessively, and it is possible to prevent the wiring part from being damaged. Further, according to this aspect, since the wiring part passes through the inside of the shaft part, the wiring part is unlikely to be an obstacle to rotation of the surface light-emitting module.

A preferred aspect is that the surface light-emitting module includes: at least two of the surface light-emitting panels; and a frame member that protects the two surface light-emitting panels, and the two surface light-emitting panels are fixed in a state of being brought into contact with or close proximity to each other by the frame member.

The "state where the two surface light-emitting panels are into close proximity" described here refers to a state where the distance between the two surface light-emitting panels is ⅕ or less of one side of the surface light-emitting panel.

According to this aspect, since the plurality of surface light-emitting panels are attached to one frame member, a larger light-emission area can be secured as a surface light-emission system, and a wider range can be illuminated.

A preferred aspect is that the supporting part is capable of attaching the surface light-emitting module to a mounting surface, and when the surface light-emitting module is attached to the mounting surface, the supporting part is capable of retaining the surface light-emitting module with the emission surface facing the mounting surface.

The "mounting surface" used here refers to a mounting target surface, including a ceiling, a wall, a floor surface, and a wall surface of a structure.

According to this aspect, by retaining the surface light-emitting module with the emission surface facing the mounting surface, it can be used as indirect lighting utilizing reflection on the mounting surface.

A preferred aspect is that the supporting part supports a lower end portion of the surface light-emitting module, and a reinforcing member is provided at a connection portion connecting the supporting part to the surface light-emitting module.

According to this aspect, it is less likely for a load to be directly applied to the surface light-emitting panel during rotation.

A preferable aspect is that the supporting part includes a main body and a fixing part, the fixing part being rotatable in a circumferential direction with respect to the main body relatively, and the fixing part and the main body are connected via a universal joint.

According to this aspect, it can move other than in the circumferential direction and the movable range is wide.

One aspect of the present invention is a lighting system including: the surface light-emission system above described; and a signal transmission unit that transmits a predetermined operation signal to the surface light-emission system, wherein the surface light-emission system includes a signal reception unit, and wherein the signal reception unit receives the operation signal from the signal transmission unit, so that the surface light-emission system performs an operation based on the operation signal.

According to this aspect, since the operation of the surface light-emission system can be controlled by the signal transmission unit, operability is good.

A preferred aspect is that in the surface light-emission system, the signal reception unit receives an operation signal related to a posture from the signal transmission unit, so that the surface light-emission system changes the surface light-emitting module to a preset posture or keeps the surface light-emitting module in the preset posture.

According to this aspect, by sending an operation signal related to the posture from the signal transmission unit, the surface light-emitting module is brought into a preset desired posture. Hence, it is possible to easily operate the posture of the surface light-emitting module and it is possible to set a desired lighting space.

One aspect of the present invention is a lighting system including: at least two of the surface light-emission systems above described, the at least two of the surface light-emission systems including a first surface light-emission system and a second surface light-emission system; and a signal transmission unit that transmits a predetermined operation signal to the first and the second surface light-emission systems, wherein the first surface light-emission system includes a first signal reception unit, wherein the second surface light-emission system includes a second signal reception unit, and wherein a posture of a surface light-emitting module of the second surface light-emission system is synchronized with a posture of a surface light-emitting module of the first surface light-emission system when the second signal reception unit receives an operation signal related to synchronization from the signal transmission unit.

According to this aspect, since the posture of at least two surface light-emitting modules is synchronized by transmitting an operation signal related to synchronization from the signal transmission unit, it is possible to cause each of the surface light-emitting modules to take a desired posture without individually operating each of the surface light-emitting modules and it is possible to set a desired lighting space.

One aspect of the present invention is a method for reproducing a lighting space, using at least two surface light-emission systems, the two surface light-emission systems each including: a surface light-emitting module; and a supporting part that rotatably supports the surface light-emitting module, the two surface light-emission systems each having a signal reception unit, the method further using a signal transmission unit that transmits a predetermined operation signal to the two surface light-emission systems, the method including: transmitting an operation signal related to a posture to the signal reception units with the signal transmission unit; and changing the surface light-emitting modules of the two surface light-emission systems to a preset posture, or keeping the surface light-emitting modules in the preset posture.

According to this aspect, by sending an operation signal related to the posture from the signal transmission unit, each of the surface light-emitting modules is brought into a preset desired posture, and hence a preset lighting space can be easily reproduced.

Effect of Invention

According to the surface light-emission system of the present invention, the posture can be changed and it can be safely used.

According to the lighting system and the lighting space reproduction method of the present invention, a desired lighting space can be set or reproduced.

BRIEF DESCRIPTION OF DRAWINGS

FIGS. 17A and 7B are explanatory views of the interval retaining member of FIG. 4, with FIG. 17A being a perspective view and FIG. 17B being a cross-sectional view taken along the line A-A of FIG. 17A.

BEST MODE FOR CARRYING OUT THE INVENTION

Hereinafter, embodiments of the present invention will be described in detail. It is to be noted that regarding the positional relationship of a surface light-emission system 2, the posture of FIG. 1 is taken as a reference.

Figure 1:
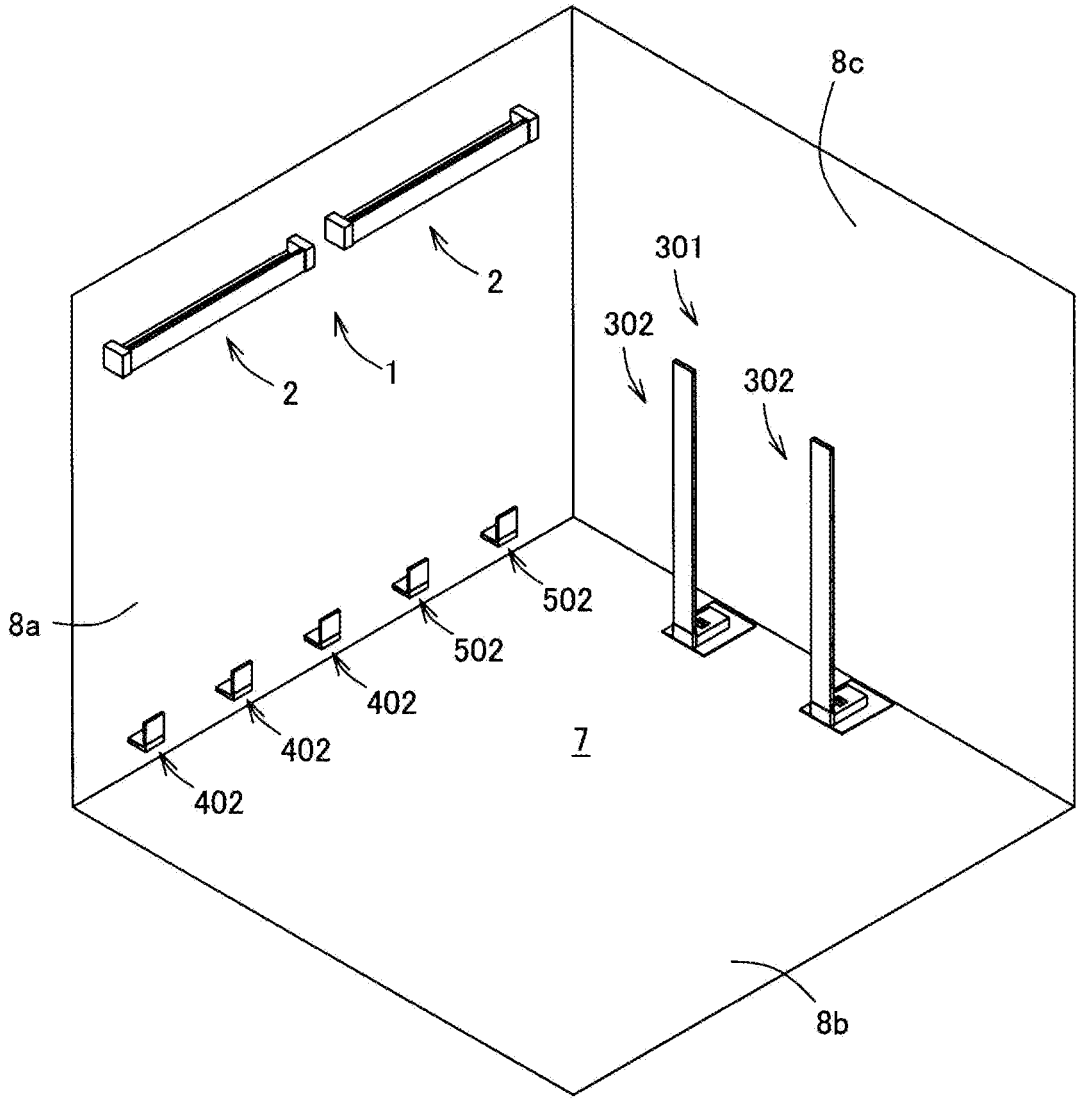
FIG. 1 is a perspective view schematically showing a lighting system according to each embodiment of the present invention.

As in FIG. 1, a lighting system 1 according to the first embodiment of the present invention is mainly disposed in a living space 7 and has a plurality of surface light-emission systems 2 and 2.

Figure 2:
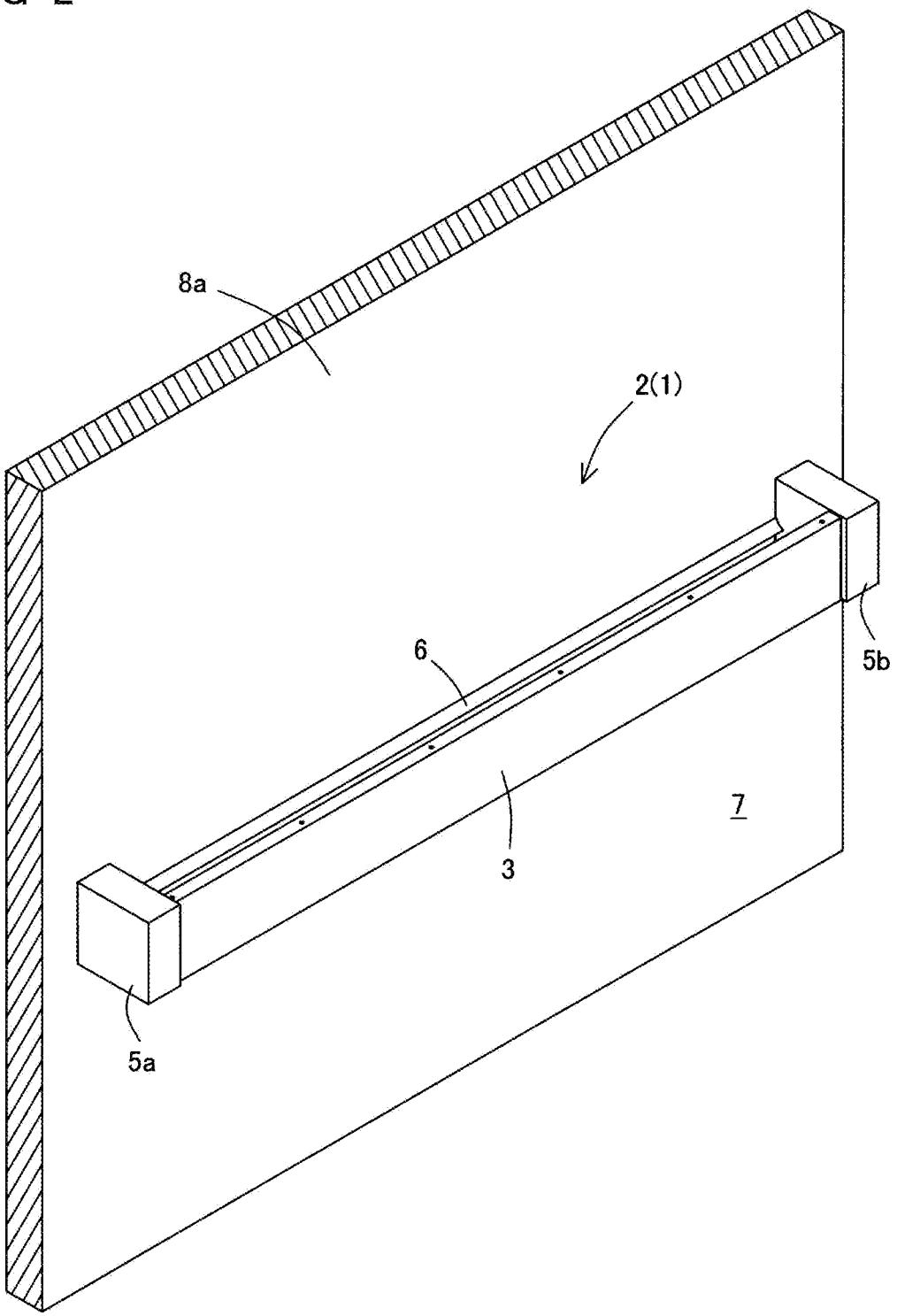
FIG. 2 is a perspective view of a surface light-emission system according to a first embodiment of the present invention.
Figure 3:
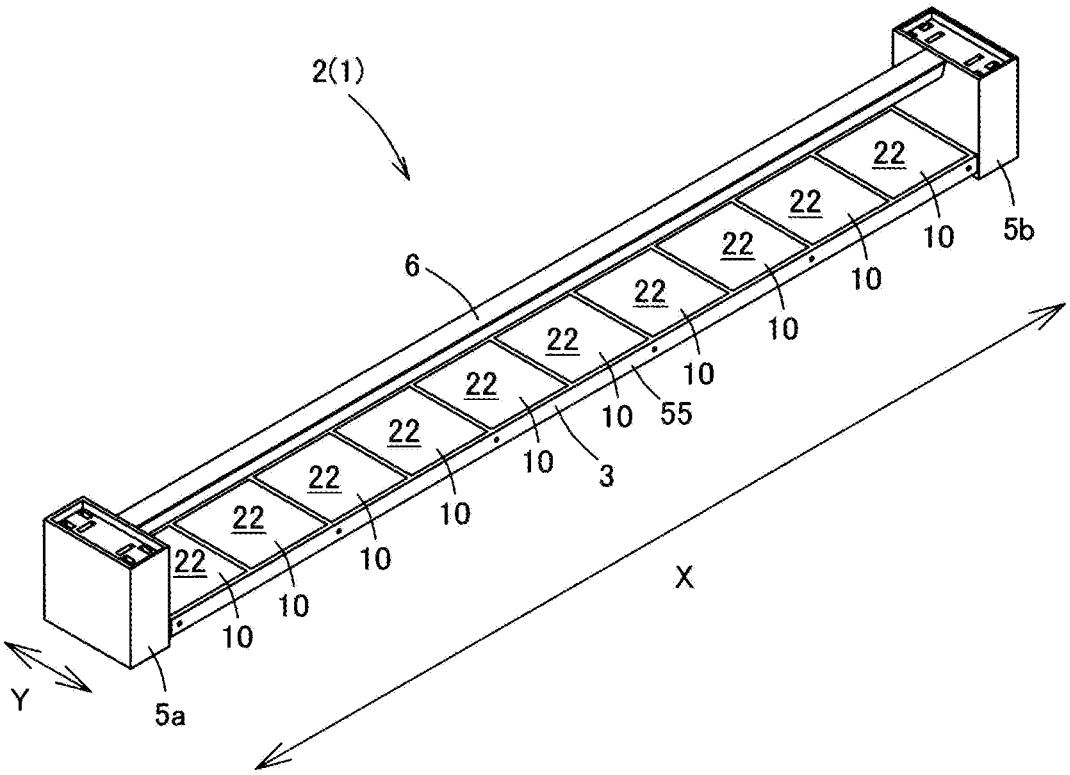
FIG. 3 is a perspective view of the surface light-emission system of FIG. 2 as viewed from another direction.

As in FIG. 2 and FIG. 3, the surface light-emission system 2 includes a surface light-emitting module 3, a pair of supporting members 5*a* and 5*b* (supporting parts), and an interval retaining member 6.

Figure 20A:
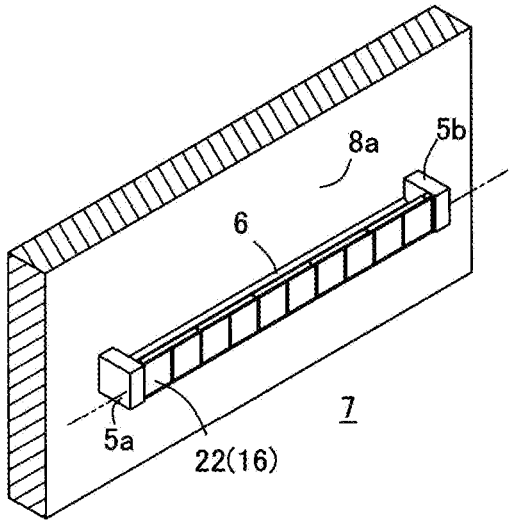
FIGS. 20A, 20B, and 20C are explanatory views of each posture of the surface light-emitting module in the surface light-emission system of FIG. 2, with FIG. 20A being a perspective view of a direct lighting posture, FIG. 20B being a perspective view in the middle of changing from a direct lighting posture to an indirect lighting posture, and FIG. 20C being a perspective view of an indirect lighting posture.
Figure 20B:
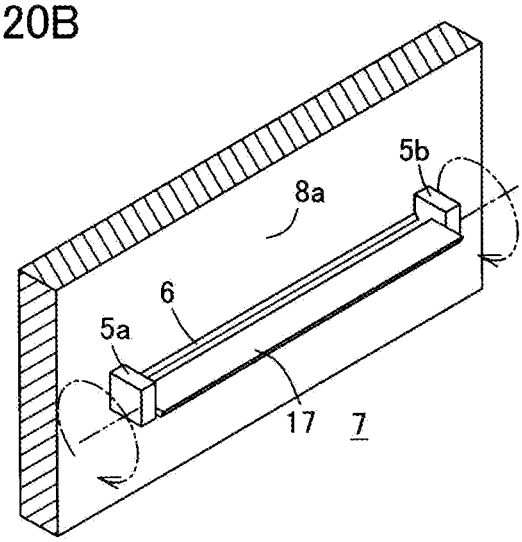
Figure 20C:
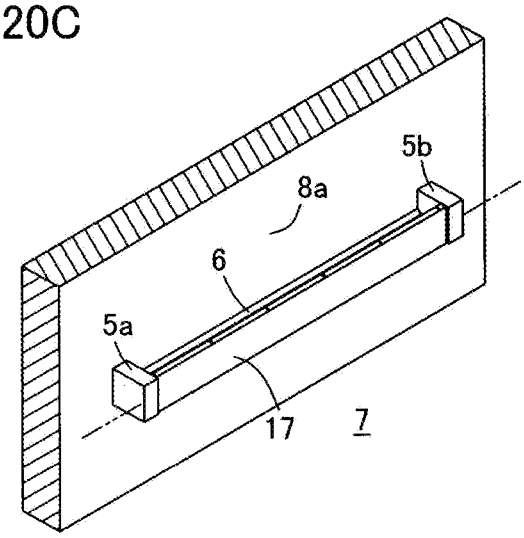

The surface light-emission system 2 is configured to manually or automatically rotate the surface light-emitting module 3, thereby enabling to switch between the direct lighting posture in which an emission surface 16 of the surface light-emitting module 3 shown in FIG. 20A faces the living space 7 side and the indirect lighting posture in which the emission surface 16 of the surface light-emitting module 3 shown in FIG. 20C faces a mounting surface 8*a* side. The surface light-emission system 2 of the present embodiment includes a rotation angle restriction function for restricting the rotation angle of the surface light-emitting module 3. One of the characteristics is that this function is capable of preventing a support side wiring member 103 (refer to FIG. 12) serving as a power supply wiring to the surface light-emitting module 3 from being entangled or damaged, which is caused by excessive rotation of the surface light-emitting module 3.

Based on this, each constituent member of the surface light-emission system 2 will be described below.

Figure 4:
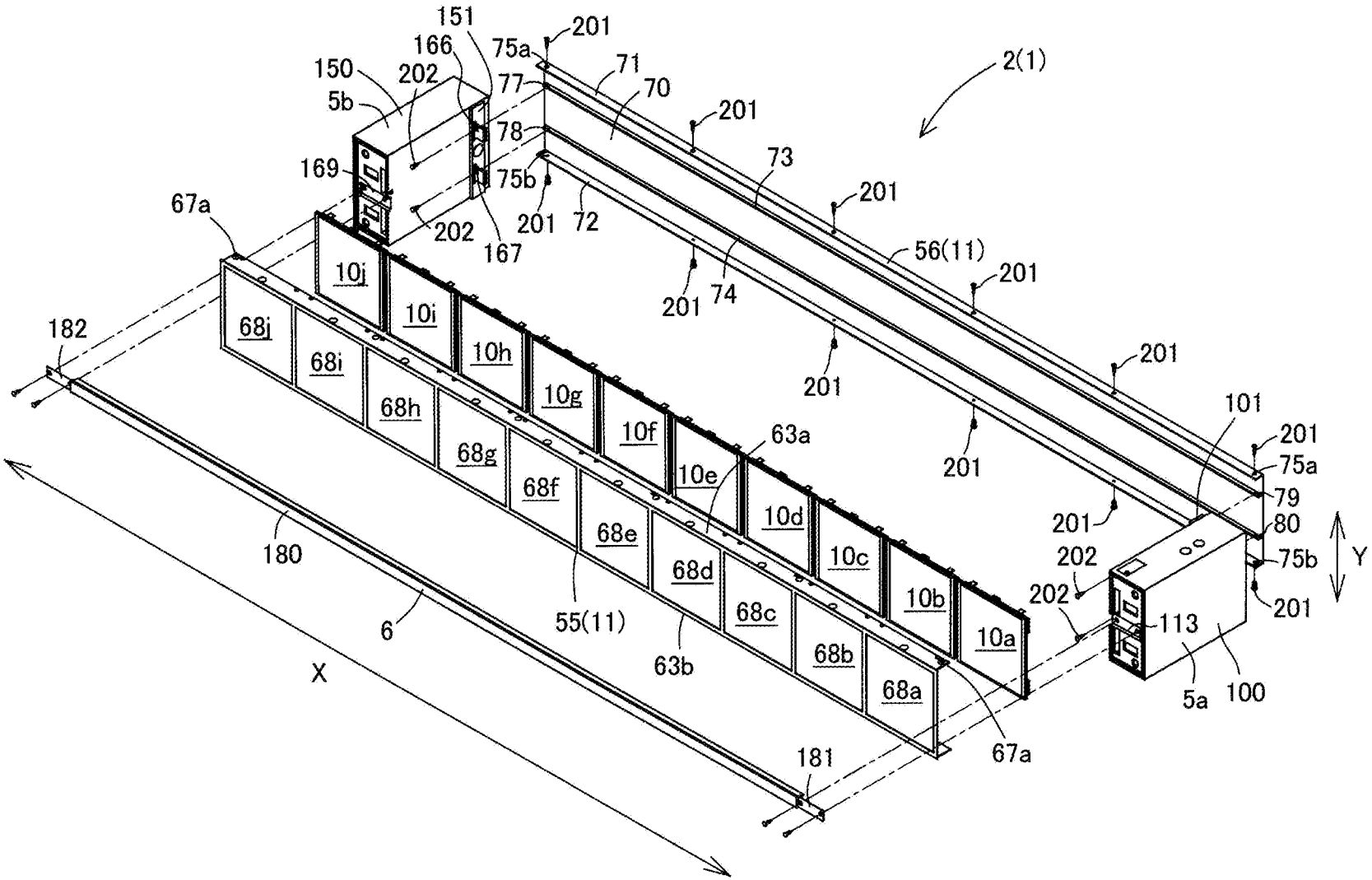
FIG. 4 is an exploded perspective view of the surface light-emission system of FIG. 3.
Figure 5:
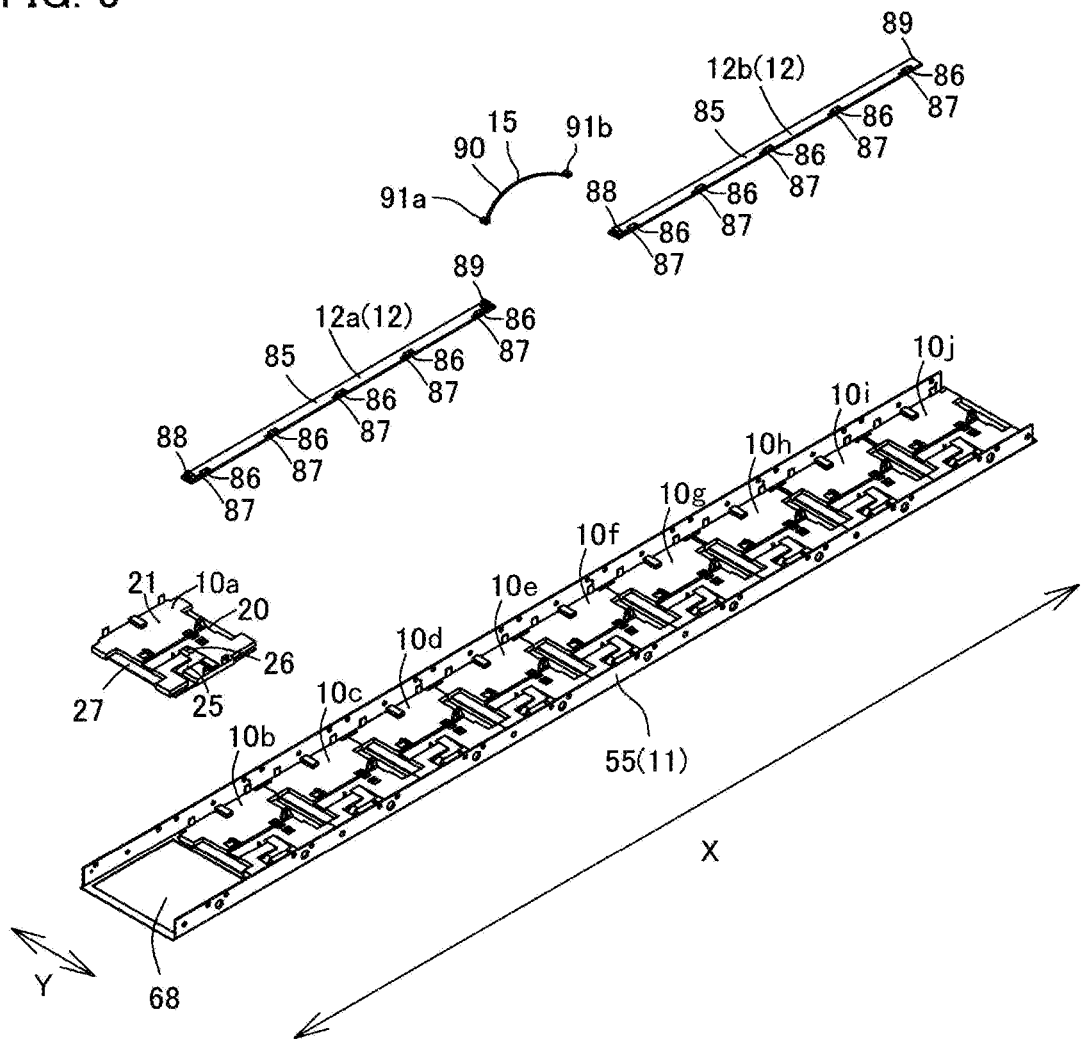
FIG. 5 is an exploded perspective view of the surface light-emitting module of FIG. 4.

The surface light-emitting module 3 includes a plurality of surface light-emitting panels 10, a frame member 11, a power supply member 12 (12*a* and 12*b*), and a panel side wiring member 15, as in FIG. 4 and FIG. 5.

The surface light-emitting panel 10 is a light-emitting panel which planarly widens and is capable of emitting planar light, specifically, it is an organic EL panel and is capable of irradiating diffusion light. As in FIG. 6, the surface light-emitting panel 10 is mainly composed of a light-emitting tile 20 and a bracket part 21.

The light-emitting tile 20 is a quadrangular-shaped plate-like tile, specifically, an organic EL tile having an organic EL element. As in FIG. 7, one main surface (the surface on the front surface side) of the light-emitting tile 20 is an emission surface 16 having a light-emitting region 22, and the other main surface (the surface on the rear face side) thereof is a non emission surface on which a power supply portion 25 is provided.

Figure 7A:
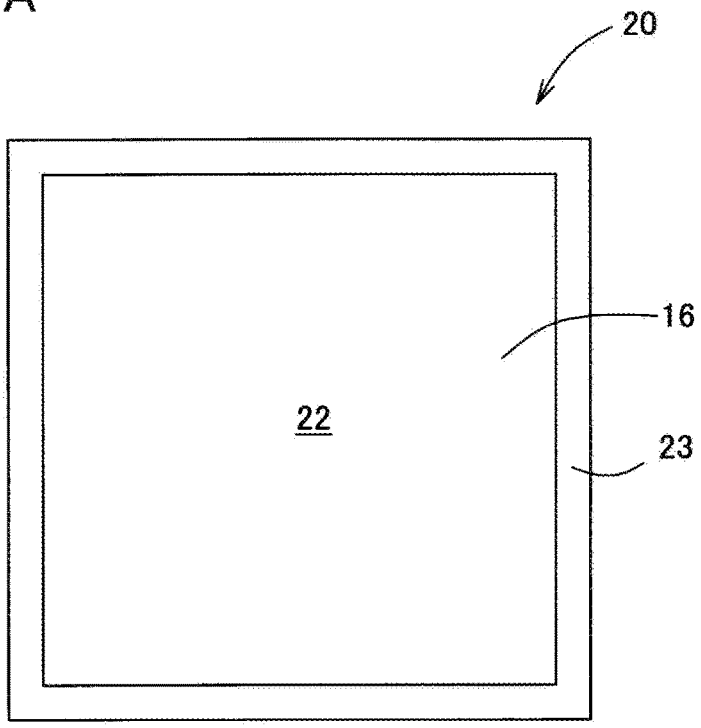
FIGS. 7A and 7B are explanatory views of the light-emitting tile of FIG. 6, with FIG. 7A being a plan view seen from the emission surface side, and FIG. 7B being a plan view seen from the non emission surface side.

As in FIG. 7A, the emission surface 16 of the light-emitting tile 20 is composed of the light-emitting region 22, which actually emits light, and a remaining non light-emitting region 23. In the present embodiment, the light-emitting region 22 is provided at the center of the emission surface 16 of the light-emitting tile 20, and the frame-like, non light-emitting region 23 is provided so as to surround the light-emitting region 22. In a planar view, the light-emitting region 22 is an overlapped portion of an anode layer, an organic function layer including an organic light-emitting layer, and a cathode layer, and is a portion corresponding to an organic EL element in which the anode layer, the organic function layer, and the cathode layer are laminated in this order. That is, in the light-emitting region 22, the organic light-emitting layer emits light by applying a voltage to the anode layer and the cathode layer.

Figure 7B:
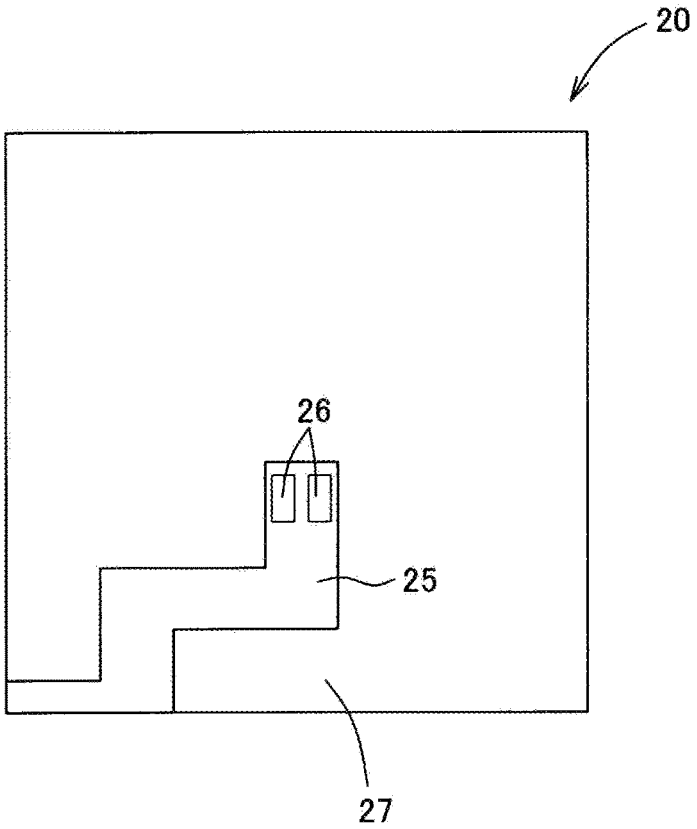

As in FIG. 7B, the power supply portion 25 is a portion which is provided on the rear face side of the light-emitting tile 20, supplies power to the organic light-emitting layer belonging to the light-emitting region 22, is electrically connected to the anode layer and the cathode layer belonging to the light-emitting region 22, and is capable of applying voltage between the anode layer and the cathode layer.

The power supply portion 25 is a tongue-shaped stretching portion that is cantilevered by a main body 27 and extends from a circumferential end side to a center side, and has a tile side connector portion 26 at the distal end thereof.

The tile side connector portion 26 is a connection terminal connectable with each power supply side connector portion 86 (refer to FIG. 5) of the power supply members 12*a* and 12*b*. Specifically, the tile side connector portion 26 is a male connector and can be electrically connected with the power supply side connector portion 86 by being fitted into the power supply side connector portion 86.

Figure 6:
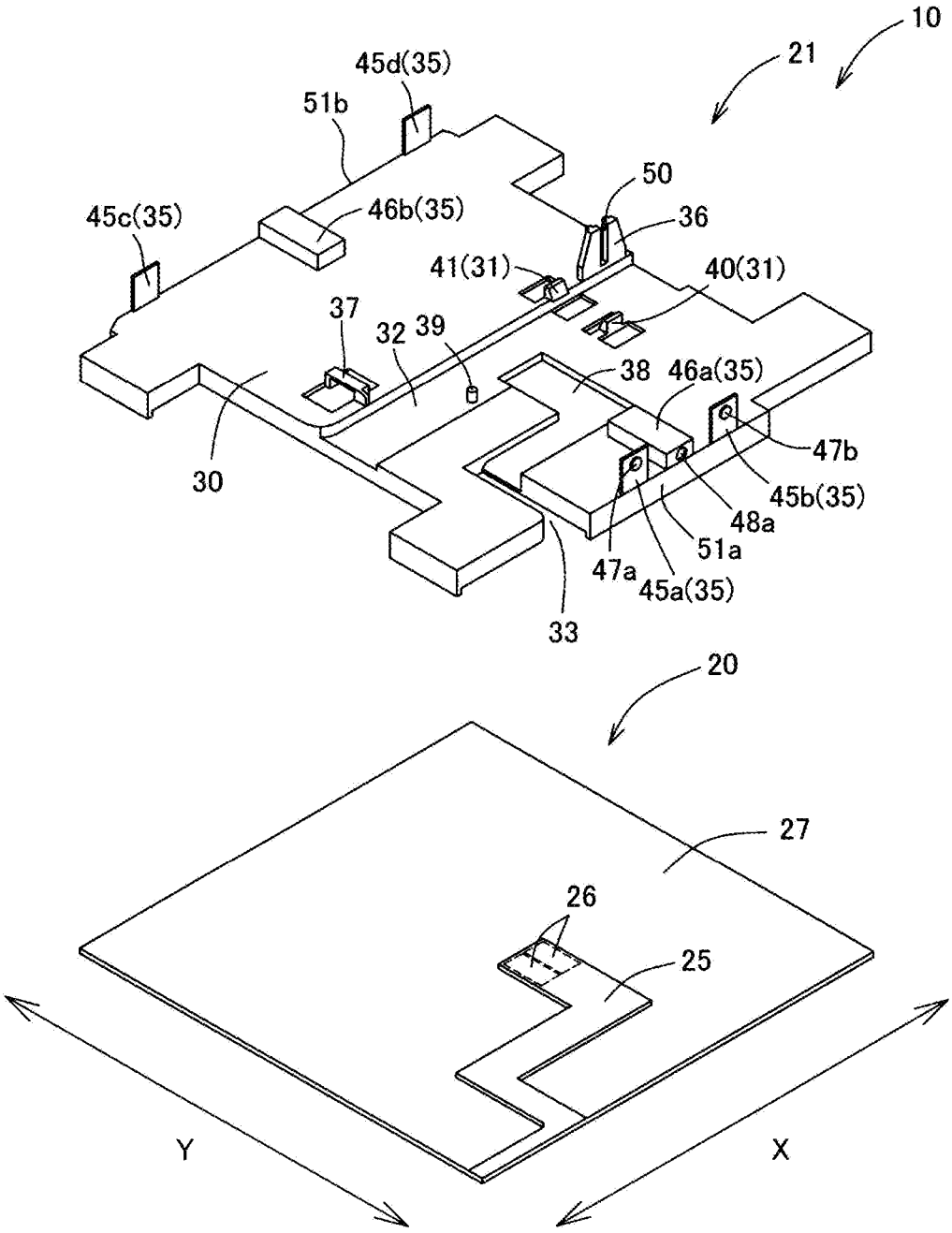
FIG. 6 is an exploded perspective view of the surface light-emitting panel of FIG. 5.
Figure 8:
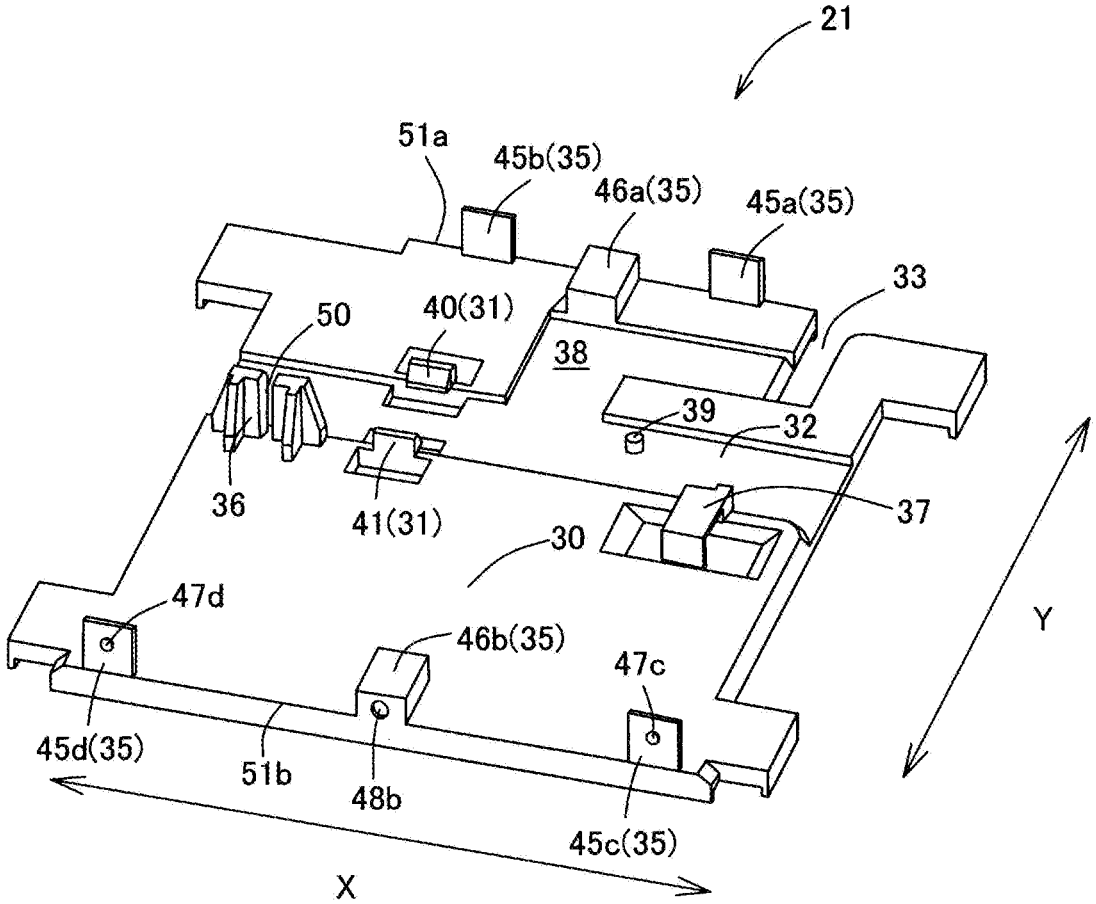
FIG. 8 is a perspective view of the bracket part of FIG. 6 as viewed from another direction.

The bracket part 21 is a mounting member for attaching the frame member 11 and the power supply member 12 to the light-emitting tile 20, and, as in FIG. 6 and FIG. 8, includes a bracket main body 30, a power supply fixing part 31, a power supply position adjusting groove 32, a tile notch 33, a frame mounting part 35, an interval maintaining part 36, a wiring regulating part 37, and a tile retaining groove 38.

The bracket main body 30 is a reinforcing part for reinforcing the rear face side of the light-emitting tile 20, and is a plate-like portion having a substantially "H" shape in rear view.

The power supply fixing part 31 is a portion for fixing the power supply member 12, and is composed of a pair of locking pieces 40 and 41.

The locking pieces 40 and 41 are portions for locking the power supply member 12 by holding a part of the power supply member 12, both of which are plate-shaped pieces rising from the bracket main body 30, and locking protrusions are provided at distal ends thereof. The locking pieces 40 and 41 are opposed to each other with a predetermined interval in a vertical direction Y, and the locking protrusions project in a direction where the locking protrusions come close to each other.

The power supply position adjusting groove 32 is a power supply retaining groove for retaining the power supply member 12 by fitting the power supply member 12, extends over an entire lateral direction X as in FIG. 6 and FIG. 8, and has a position adjusting projection 39 at the bottom thereof.

Figure 11:
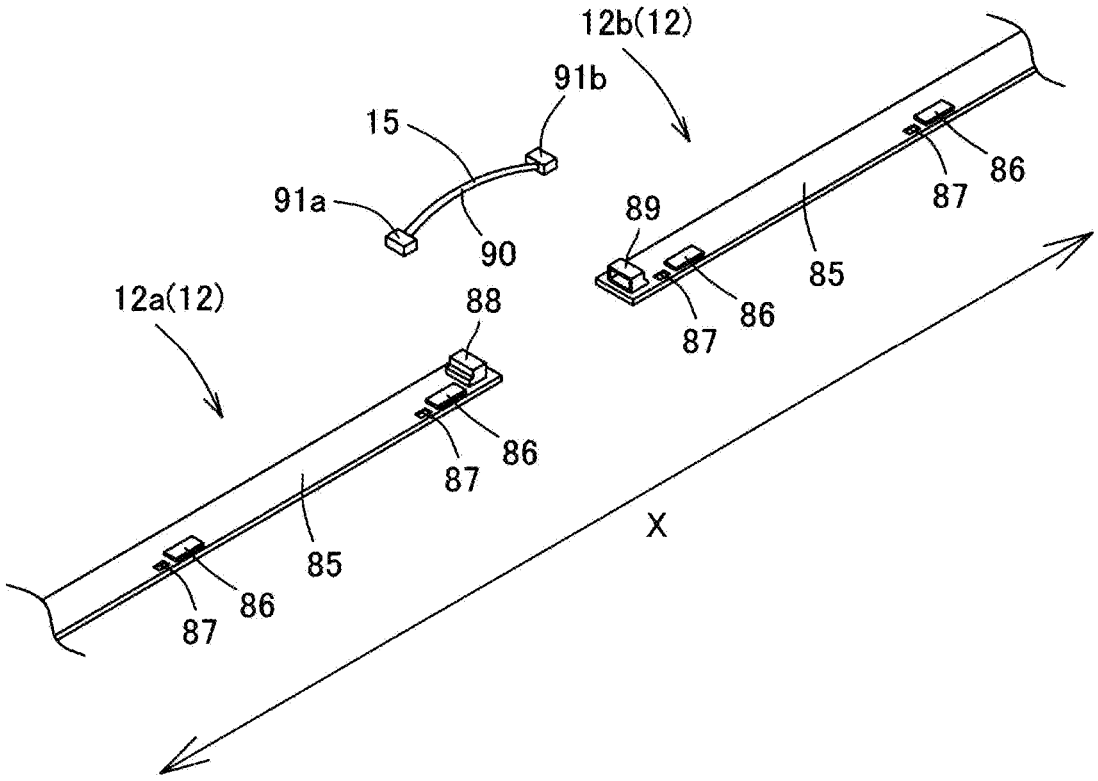
FIG. 11 is an exploded perspective view of a connection portion of the power supply member in FIG. 6.

The position adjusting projection 39 is a columnar projection standing upright from the bottom of the power supply position adjusting groove 32 and is insertable into a positioning hole 87 (refer to FIG. 11) of the power supply member 12.

The tile notch 33 is a notch for hooking and retaining the power supply portion 25 of the light-emitting tile 20, and as in FIG. 6, extends linearly from one lateral side 51*a* (a side extending in the lateral direction X) of the bracket main body 30 toward the center side of the vertical direction Y.

The frame mounting part 35 is a portion for attaching the light-emitting tile 20 to the frame member 11, and as in FIG. 6, it is composed of fixing pieces 45*a* to 45*d* and raised parts 46*a* and 46*b*.

The fixing pieces 45*a* and 45*b* are plate-like pieces that are bent from one end portion in the vertical direction Y of the bracket main body 30 towards the rear face side (the side opposite to the light-emitting tile 20) and rise towards the bracket main body 30. The fixing pieces 45*c* and 45*d* are plate-like pieces that are bent from the other end portion in the vertical direction Y of the bracket main body 30 towards the rear face side and rise towards the bracket main body 30.

As in FIG. 6 and FIG. 8, the fixing pieces 45*a* to 45*d* include engagement protrusions 47*a* to 47*d*, respectively, projecting outward in the thickness direction at the middle section of the rising direction, and the engagement protrusions 47*a* to 47*d* are engageable with frame-side engagement holes 65*a* to 65*d* of the frame member 11.

The raised parts 46*a* and 46*b* are rectangular parallelepiped portions provided at both ends or the vicinity of the vertical direction Y of the bracket main body 30 and are raised with respect to the bracket main body 30. The raised parts 46*a* and 46*b* include panel side fixing holes 48*a* and 48*b* in the middle section of the raised direction.

The panel side fixing holes 48*a* and 48*b* are bottomed holes or through holes having a depth toward the center side of the vertical direction Y that is a direction crossing the raised direction (orthogonal direction in the present embodiment). The panel side fixing holes 48*a* and 48*b* are fastening holes that can be fastened with fastening elements and, in the present embodiment, they are screw holes threaded inward on the inner surface and can be screwed with fastening elements such as screws.

The "fastening element" used here is a broader concept of screws, nails, rivets, etc., and is a concept including temporary fastening elements. The same shall apply hereinafter.

The interval maintaining part 36 is a projecting part that maintains the interval between the bracket main body 30 and the frame member 11 and projects from the bracket main body 30 toward the rear face side, and has a wiring notch 50 at the center thereof.

The wiring notch 50 is a notch extending from the distal end side to the base end side of the projecting direction and can be engaged by passing through the wiring part.

Figure 12:
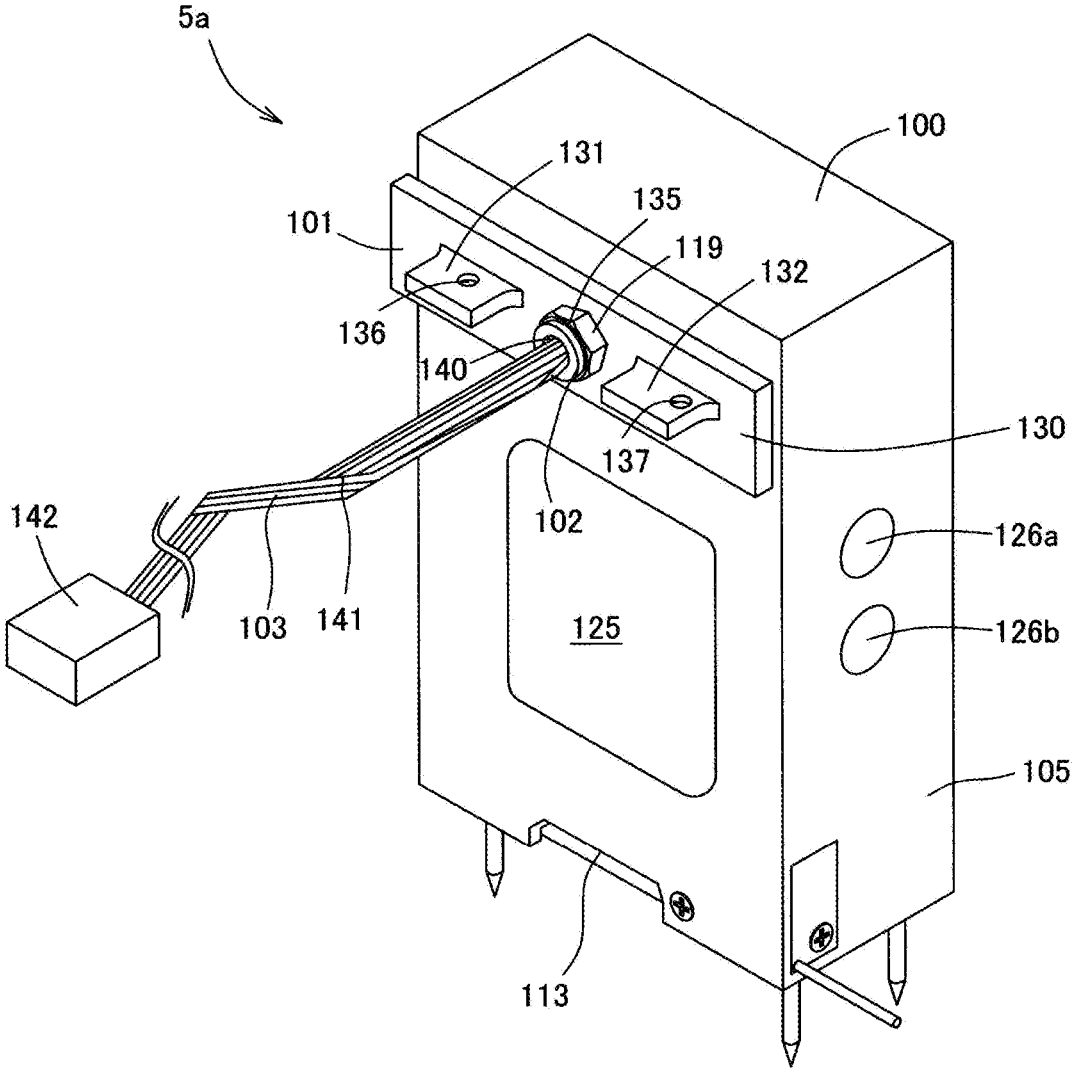
FIG. 12 is a perspective view of the supporting member in FIG. 4.

The wiring regulating part 37 is a portion for regulating the movement of the support side wiring member 103 (refer to FIG. 12). The wiring regulating part 37 is a locking piece having a substantially "U" shape in side view, and the support side wiring member 103 can be inserted inside thereof.

The tile retaining groove 38 is a retaining groove for retaining the power supply portion 25 of the light-emitting tile 20 and is a guiding groove for guiding the tile side connector portion 26 of the power supply portion 25 to the power supply side connector portion 86 of the power supply member 12. The tile retaining groove 38 is an "L" shaped groove in rear view that extends from the tile notch 33 toward the power supply position adjusting groove 32 and continues with the power supply position adjusting groove 32.

Here, the positional relationship of each portion of the bracket part 21 will be described.

As in FIG. 6 and FIG. 8, the fixing pieces 45*a* and 45*b* and the raised part 46*a* are provided along the one lateral side 51*a* (the side extending in the lateral direction X) of the bracket main body 30 when the bracket main body 30 is viewed in plain. Similarly, the fixing pieces 45*c* and 45*d* and the raised part 46*b* are provided along the other lateral side 51*b* (the opposite side of the lateral side Ma) of the bracket main body 30.

The engagement protrusions 47*a* to 47*d* of the fixing pieces 45*a* to 45*d* respectively protrude outward of the vertical direction Y in a planar view. That is, the engagement protrusions 47*a* and 47*b* and the engagement protrusions 47*c* and 47*d* protrude in directions away from each other, and each opening of the panel side fixing holes 48*a* and 48*b* of the raised parts 46*a* and 46*b* face outward of the vertical direction Y.

The raised part 46*a* is located between the fixing pieces 45*a* and 45*b* in the lateral direction X, and the raised part 46*b* is located between the fixing pieces 45*c* and 45*d*. The tile notch 33 is located outside the fixing piece 45*a* in the lateral direction X.

The locking pieces 40 and 41 are opposed to each other so as to sandwich the power supply position adjusting groove 32 between the locking pieces 40 and 41, and the locking protrusions project toward the power supply position adjusting groove 32 side.

The interval maintaining part 36 is disposed at a predetermined interval from the wiring regulating part 37 in the lateral direction X. In the present embodiment, the interval maintaining part 36 is provided on one end side of the lateral direction X of the bracket main body 30, and the wiring regulating part 37 is provided on the other end side of the lateral direction X of the bracket main body 30.

The frame member 11 is a protective frame that retains the plurality of surface light-emitting panels 10 as in FIG. 4 and FIG. 5 and protects the surface light-emitting panels 10 from the outside. As in FIG. 4, the frame member 11 is composed of a light-emitting side frame 55 and a rear face side frame 56.

The light-emitting side frame 55 is a front frame for protecting the emission surface 16 side of the surface light-emitting panel 10. As in FIG. 9, the light-emitting side frame 55 is in a ladder shape and is mainly composed of a pair of first crosspiece parts 60*a* and 60*b* and second crosspiece parts 61*a* to 61*k* connecting between the first crosspiece parts 60*a* and 60*b*.

The first crosspiece parts 60*a* and 60*b* are lengthy bodies that extend in a rod shape in a predetermined direction and, in the present embodiment, lateral crosspieces extending in the lateral direction X. Each of the first crosspiece parts 60*a* and 60*b* has an L-shaped cross section, and is composed of a light-emitting side cover 62 and a side face side cover 63 (63*a* and 63*b*).

The light-emitting side cover 62 is a plate-like portion having a rectangular-shaped cross section and is a portion covering a part of the emission surface 16 of the surface light-emitting panel 10.

The side face side cover 63 is a plate-like portion having a rectangular-shaped cross section and is a portion that stands upright from the end or the vicinity of the transverse direction (the direction orthogonal to the thickness direction and in the short-side direction) of the light-emitting side cover 62 and covers a part of the side face of the surface light-emitting panel 10.

When the surface light-emitting module 3 is assembled, the side face side covers 63*a* and 63*b* of the respective first crosspiece parts 60*a* and 60*b* are provided with the frame-side engagement holes 65*a* to 65*d*, respectively, at positions corresponding to the engagement protrusions 47*a* to 47*d* of each of the surface light-emitting panels 10. The frame-side engagement holes 65*a* to 65*d* are through holes or bottomed holes having a depth toward the outside in the thickness direction of the first crosspiece parts 60*a* and 60*b*, and are engageable with the engagement protrusions 47*a* to 47*d*.

When the surface light-emitting module 3 is assembled, the side face side covers 63*a* and 63*b* of the respective first crosspiece parts 60*a* and 60*b* are provided with first frame side fixing holes 66*a* and 66*b* at positions corresponding to the panel side fixing holes 48*a* and 48*b* of each of the surface light-emitting panels 10. The first frame side fixing holes

66*a* and 66*b* are through holes penetrating in the thickness direction of the first crosspiece parts 60*a* and 60*b*, and are insertion holes through which the fastening elements can be inserted.

When the surface light-emitting module 3 is assembled, the side face side covers 63*a* and 63*b* of the first crosspiece parts 60*a* and 60*b* are provided with second frame side fixing holes 67*a* and 67*b* on the boundary portion or the vicinity between the adjacent specific surface light-emitting panels 10 and 10.

The second frame side fixing holes 67*a* and 67*b* are through holes or bottomed holes having a depth in the thickness direction from the outsides of the first crosspiece parts 60*a* and 60*b*, and fastening holes that can be fastened with a fastening element 201 (refer to FIG. 4) such as a screw. In the present embodiment, the second frame side fixing holes 67*a* and 67*b* are screw holes threaded inward on the inner surface, and can be screwed with the fastening element 201.

The second crosspiece parts 61*a* to 61*k* are plate-like portions having quadrangular-shaped cross sections and portion that cover parts of the surface light-emitting panels 10 and a boundary portion between the surface light-emitting panels 10, and are disposed at regular intervals with predetermined intervals in the lateral direction X.

Figure 9:
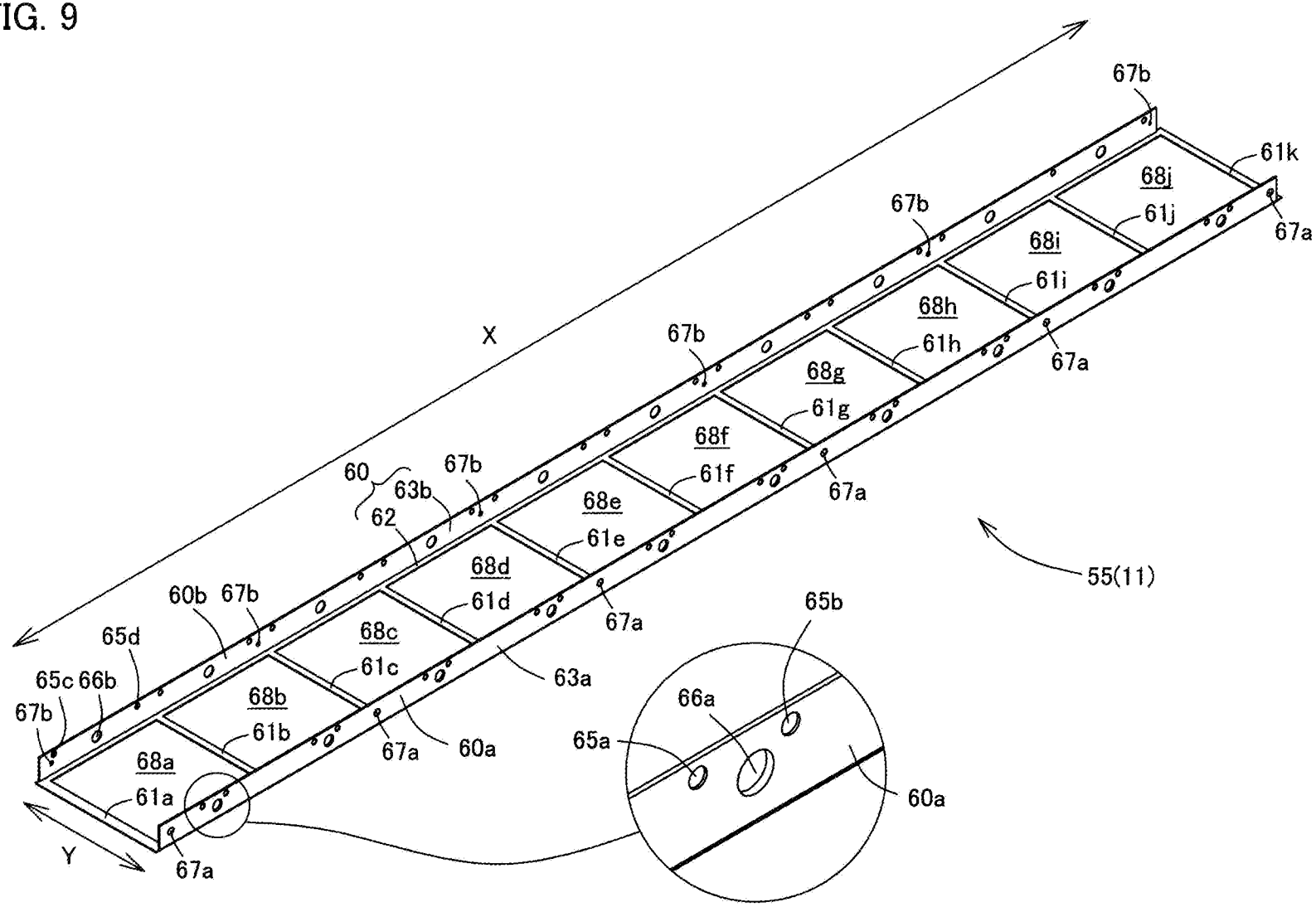
FIG. 9 is a perspective view of the light-emitting side frame of FIG. 4.

Viewed from another point, the light-emitting side frame 55 is configured, as seen in FIG. 9, such as the light-emitting side cover 62 of the first crosspiece parts 60*a* and 60*b* and the second crosspiece parts 61*a* to 61*k* intersect each other to form ten window parts 68*a* to 68*j*. Each of the window parts 68*a* to 68*j* is capable of transmitting light from the light-emitting region 22 of each of the surface light-emitting panels 10.

Figure 10:
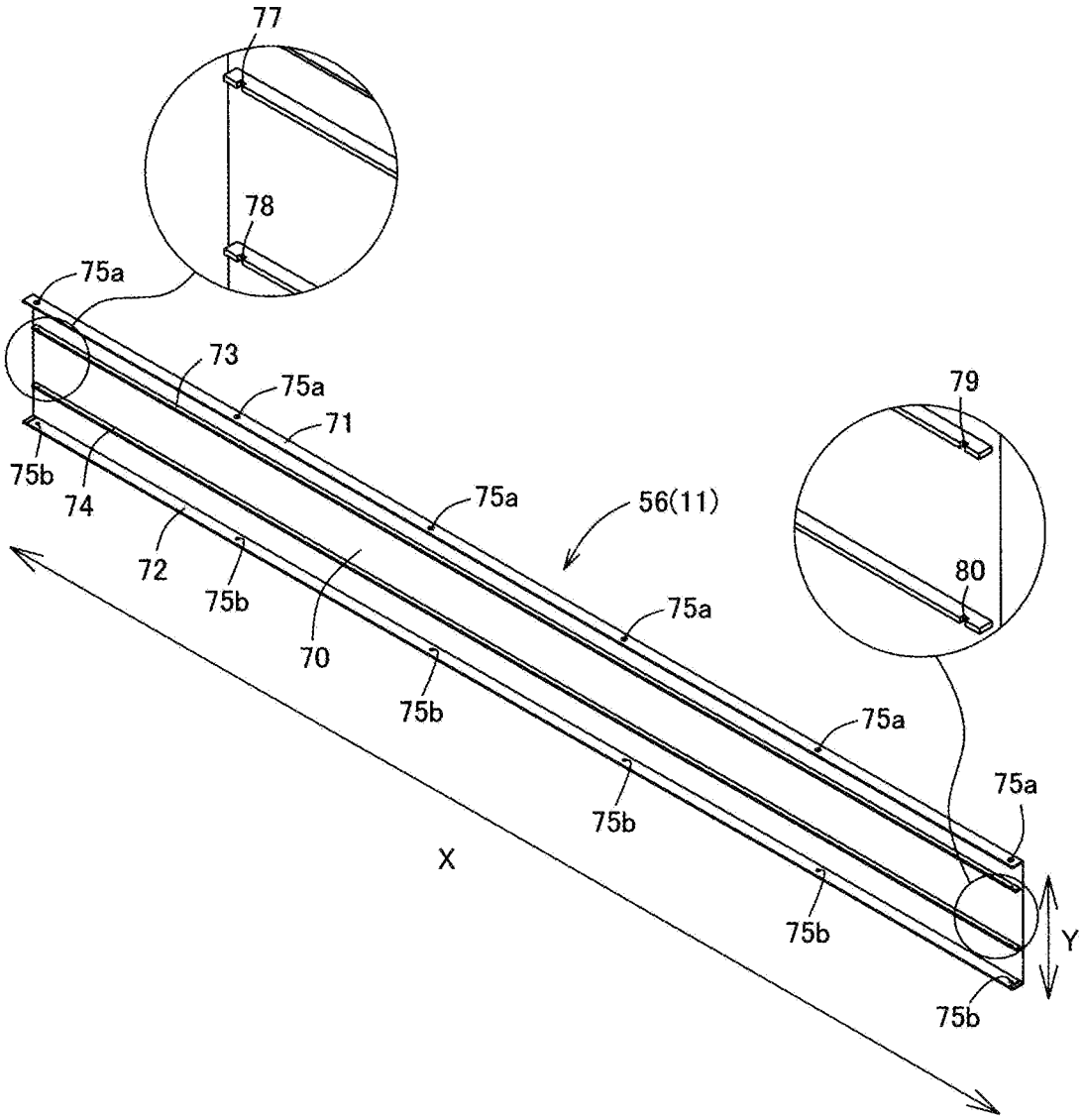
FIG. 10 is a perspective view of the rear face side frame of FIG. 4.

As shown in FIG. 4, the rear face side frame 56 is a rear frame for protecting the rear face side (the side opposite to the emission surface 16) of the surface light-emitting panel 10, and as in FIG. 10, includes a rear face side cover 70, side face side covers 71 and 72, and ridge parts 73 and 74.

The rear face side cover 70 is a portion covering the rear face side of the surface light-emitting panel 10, and is horizontally elongated long plate-like.

The side face side covers 71 and 72 are portions covering the outside of the side face side covers 63*a* and 63*b* of the light-emitting side frame 55, and are standing upright from both ends in the transverse direction (vertical direction Y) of the rear face side cover 70. When the surface light-emitting module 3 is assembled, frame side fixing holes 75*a* and 75*b* of the side face side covers 71 and 72 are made to locate at positions corresponding to the second frame side fixing holes 67*a* and 67*b* of the first crosspiece parts 60*a* and 60*b*.

The frame side fixing holes 75*a* and 75*b* are through holes penetrating in the thickness direction of the side face side covers 71 and 72 and are insertion holes through which the fastening element 201 can be inserted.

The ridge parts 73 and 74 are ribs protruding from a middle section in the transverse direction (vertical direction Y) of the rear face side cover 70, and extend in the longitudinal direction (lateral direction X). Both of the respective longitudinal ends of the ridge parts 73 and 74 are provided with fastening reception holes 77 to 80, which can be fastened with the temporary fastening element 202.

The fastening reception holes 77 to 80 are bottomed holes or through holes having a depth from the distal end face toward the base end face of the projecting direction of the ridge parts 73 and 74, and in the present embodiment, screw holes threaded inward on the inner surface.

The power supply member 12 (12*a* and 12*b*) is a power supply board that supplies power to each of the surface light-emitting panels 10, specifically, a printed circuit board on which a printed wiring is mounted. As in FIG. 5 and FIG. 11, the power supply members 12*a* and 12*b* include a board main body 85, a power supply side connector portion 86, a positioning hole 87, and wiring connector portions 88 and 89.

The board main body 85 is a rectangular-shaped plate-like body extending in the lateral direction X, and provided with a printed wiring (not shown).

The power supply side connector portion 86 is a connection terminal connectable with the tile side connector portion 26 (refer to FIGS. 7A and 7B) of each of the surface light-emitting panels 10, specifically, a female connector.

The positioning hole 87 is an insertion hole into which the position adjusting projection 39 of the bracket part 21 can be inserted, and is an adjustment hole for adjusting the positional relationship of the power supply member 12 by inserting the position adjusting projection 39. The positioning hole 87 is a bottomed hole or a through hole having a depth in the thickness direction from one main surface of the board main body 85.

The wiring connector portions 88 and 89 are respectively provided at both ends in the lateral direction X (longitudinal direction) of the board main body 85, and are connection terminals connectable with wiring side connector portions 91*a* and 91*b* of the panel side wiring member 15 and a wiring side connector portion 142 (refer to FIG. 12) of the supporting member 5*a*. Specifically, both of the wiring connector portions 88 and 89 are female connectors.

The panel side wiring member 15 is a member for electrically connecting between the power supply members 12*a* and 12*b*, and includes a wiring main body 90 and the wiring side connector portions 91*a* and 91*b*.

The wiring main body 90 is a linear body or a bundle-like body having flexibility and physically and electrically connecting between the wiring side connector portions 91*a* and 91*b*.

The wiring side connector portions 91*a* and 91*b* are connection terminals connectable with the wiring connector portions 88 and 89 of the power supply members 12*a* and 12*b* and, specifically, both are male connectors that can be electrically connected to each other by fitting the wiring connector portions 88 and 89.

The supporting member 5*a* is a member that rotatably supports the surface light-emitting module 3 together with the supporting member 5*b*, and is capable of supplying power to each of the surface light-emitting panels 10 of the surface light-emitting module 3. As in FIG. 12, the supporting member 5*a* includes a mounting part 100 (main body), a fixing part 101, a shaft part 102 connecting the mounting part 100 and the fixing part 101, and a support side wiring member 103.

Figure 14:
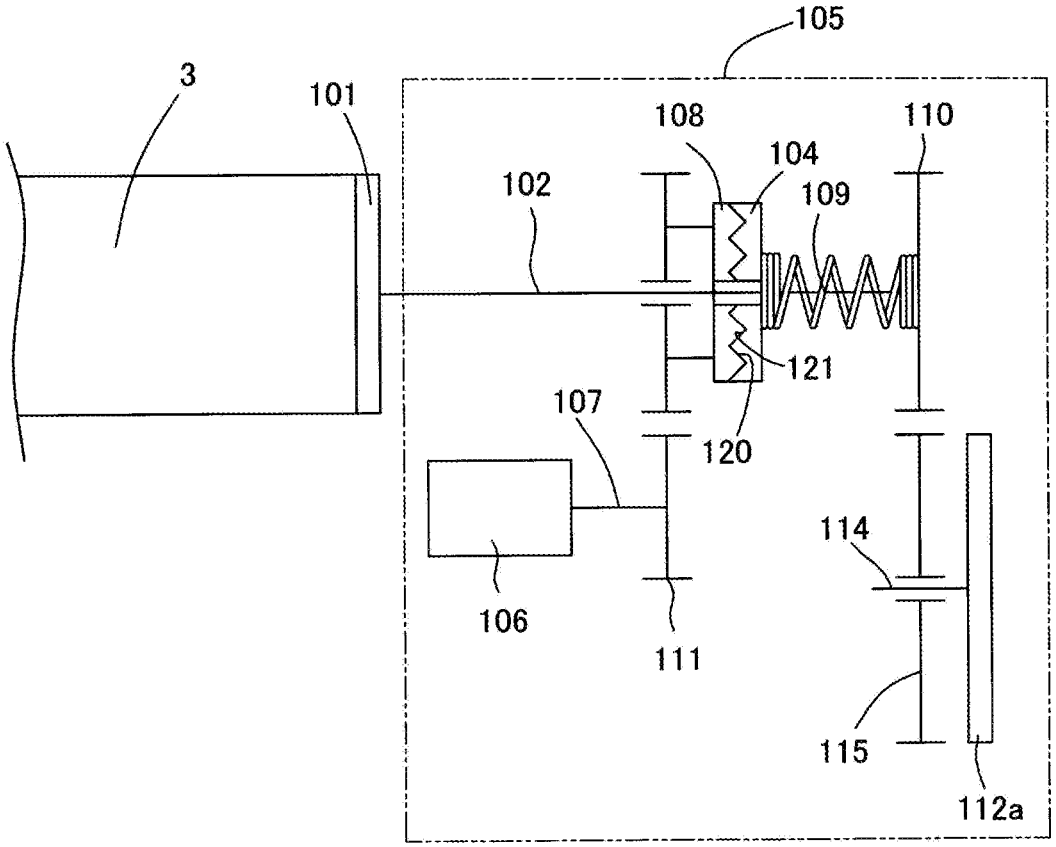
FIG. 14 is a skeleton view of the internal mechanism of the mounting part of FIG. 4.

The mounting part 100 is a box body attachable to the mounting surface 8*a* such as a wall surface. As in FIG. 14, a motor 106 is incorporated inside a casing part 105, the shaft part 102 rotates with the rotation of a rotating shaft 107 of the motor 106, and the fixing part 101 also rotates in conjunction. The mounting part 100 has a structure in which a safety clutch is activated when a predetermined load or more is applied to the motor 106. That is, when an overload is applied to the motor 106, the supporting member 5*a* cuts off the connection between the motor 106 and the shaft part 102 and is capable of cutting off the torque transmission.

The mounting part 100 is provided with a predetermined restriction angle in the circumferential rotation angle of the shaft part 102. When reaching the restriction angle, the rotation of the shaft part 102 is restricted electrically and physically, and the rotation movable range of the fixing part 101 is made possible to regulate. In other words, the supporting member 5*a* is capable of regulating the circumferential movable range of the surface light-emitting module 3.

As in FIG. 4 and FIG. 12, the casing part 105 includes a casing side connecting unit 113 connectable with the end of the interval retaining member 6 on the mounting surface 8*a* side. The casing side connecting unit 113 is provided at the lower end of the casing part 105 as in FIG. 12.

The fixing part 101 is a portion that is fixed to the end of the surface light-emitting module 3 and supports the surface light-emitting module 3. As in FIG. 12, the fixing part 101 includes a main body 130 and connecting units 131 and 132.

The main body 130 is a rectangular-shaped plate-like portion that includes a shaft hole part 135 at the longitudinal center. The shaft hole part 135 is a fastening hole that can be fastened with a fastening part 119 provided at a distal end of the shaft part 102 and is a bottomed hole or a through hole having a depth in the thickness direction of the main body 130. The shaft hole part 135 is a screw hole threaded inward on the inner surface and can be screwed with the fastening part 119.

The connecting units 131 and 132 are plate-like portions standing upright with respect to the main body 130, and include fixing holes 136 and 137 in the center of the upright direction. The fixing holes 136 and 137 are insertion holes through which a part of the temporary fastening element 202 can be inserted, and are through holes penetrating the connecting units 131 and 132 in the thickness direction.

Figure 13:
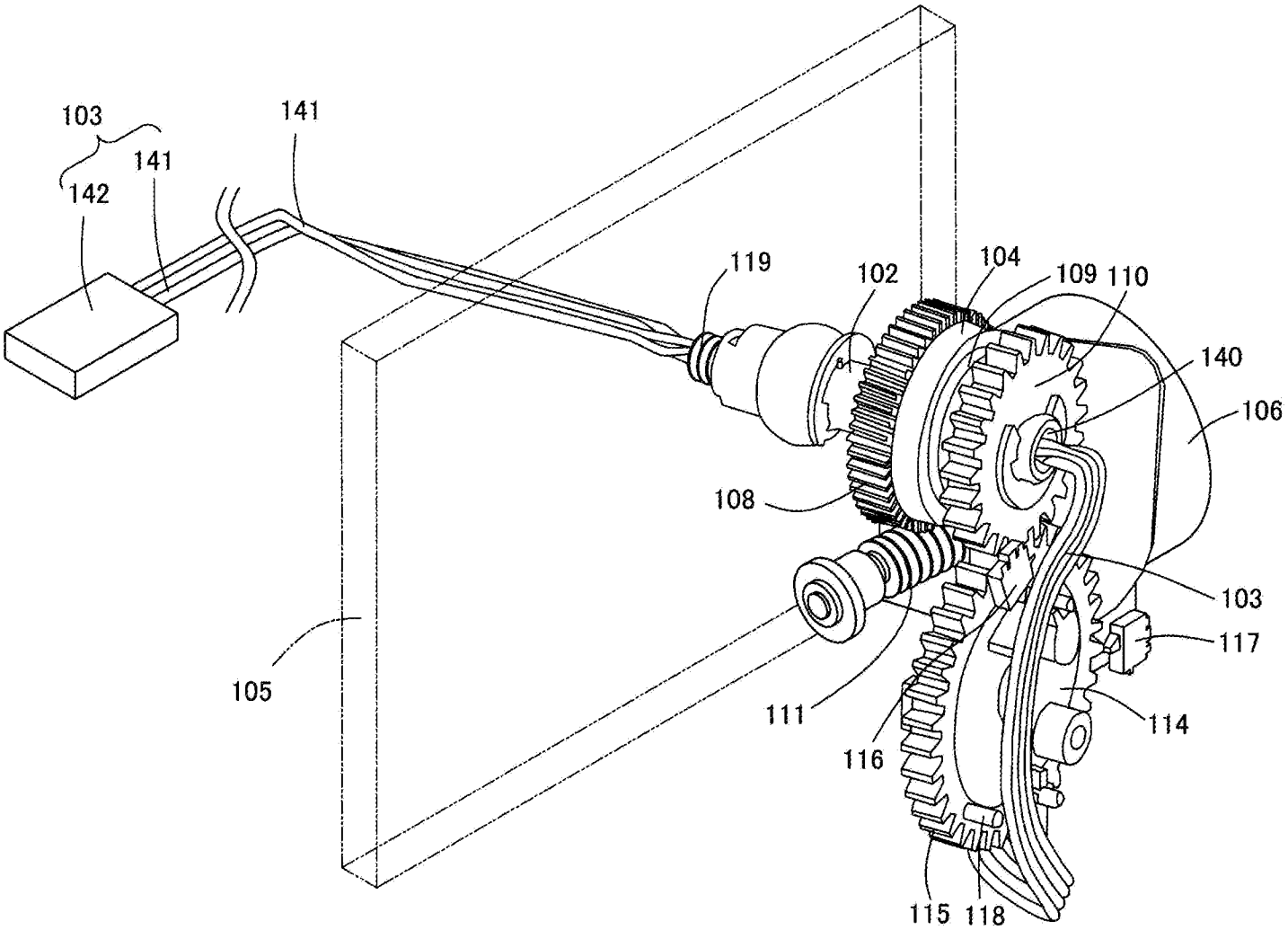
FIG. 13 is a perspective view of a main part of the internal mechanism of the mounting part of FIG. 4.

The shaft part 102 is a rod-shaped body extending linearly, and as in FIG. 13, it is a hollow body having a wiring space 140 in the axial direction. The wiring space 140 is an insertion space through which the support side wiring member 103 can be inserted. The shaft part 102 is disposed across the inside and outside of the casing part 105 when the surface light-emitting module 3 is assembled, and the fastening part 119 is provided at an exposed part from the casing part 105. The fastening part 119 is a portion that can be fastened with the shaft hole part 135 of the fixing part 101, specifically, it is an external thread.

The support side wiring member 103 is a member that electrically connects between the power supply member 12*a* and a printed circuit board (not shown) and is to be electrically connected with an external power source via a printed circuit board (not shown). The support side wiring member 103 includes a wiring main body 141, a wiring side connector portion 142, and a print side connector portion (not shown).

The wiring main body 141 is a linear body or a bundle-like body having flexibility and physically and electrically connecting between the wiring side connector portion 142 and the print side connector portion connected to the printed circuit board (not shown).

The wiring side connector portion 142 is a connection terminal connectable with the wiring connector portion 88 of the power supply member 12*a*. Specifically, the wiring side connector portion 142 is a male connector and is electrically connectable by fitting with the wiring connector portion 88.

Here, the drive mechanism inside the casing part 105 of the mounting part 100 will be described.

In the shaft part 102, as in FIG. 13, a middle section of the wiring main body 141 of the support side wiring member 103 is disposed in the wiring space 140. In the shaft part 102, a helical gear 108, a clutch 104, a spring 109, and a first spur gear 110 are mounted in order from the distal end side (the fixing part 101 side).

The first spur gear 110 is provided in the end or the vicinity of the end of the shaft part 102, and the helical gear 108 is disposed nearer the distal end side (the fixing part 101 side) than the first spur gear 110. As in FIG. 14, the helical gear 108 is provided with an uneven surface 120 which is a friction surface on the base end side (the side opposite to the fixing part 101), and the clutch 104 is provided with an uneven surface 121 which is a friction surface on the distal end side (the fixing part 101 side). Between the helical gear 108 and the first spur gear 110, the clutch 104 and the spring 109 which is an urging unit are interposed, and the spring 109 urges so that the uneven surface 120 of the helical gear 108 and the uneven surface 121 of the clutch 104 are engaged. That is, the spring 109 urges the clutch 104 toward the helical gear 108.

The motor 106 and a printed circuit board 112*a* are integrally fixed in the casing part 105, and a worm gear 111 is provided on the rotating shaft 107 of the motor 106. The worm gear 111 is engaged with the helical gear 108 attached to the shaft part 102.

On the printed circuit board 112*a* is provided with a fixing shaft portion 114, a second spur gear 115, and angle restriction sensors 116 and 117 (movable range restriction unit).

The second spur gear 115 is fixed to the printed circuit board 112*a* via the fixing shaft portion 114 and is rotatable along the outer circumference of the fixing shaft portion 114. The second spur gear 115 is engaged with the first spur gear 110 and is rotatable around the fixing shaft portion 114 with rotation of the first spur gear 110.

The angle restriction sensors 116 and 117 are members for restricting the rotation angle of the surface light-emitting module 3, and are provided at a predetermined interval in the rotation direction of the second spur gear 115 as in FIG. 13.

Figure 15A:
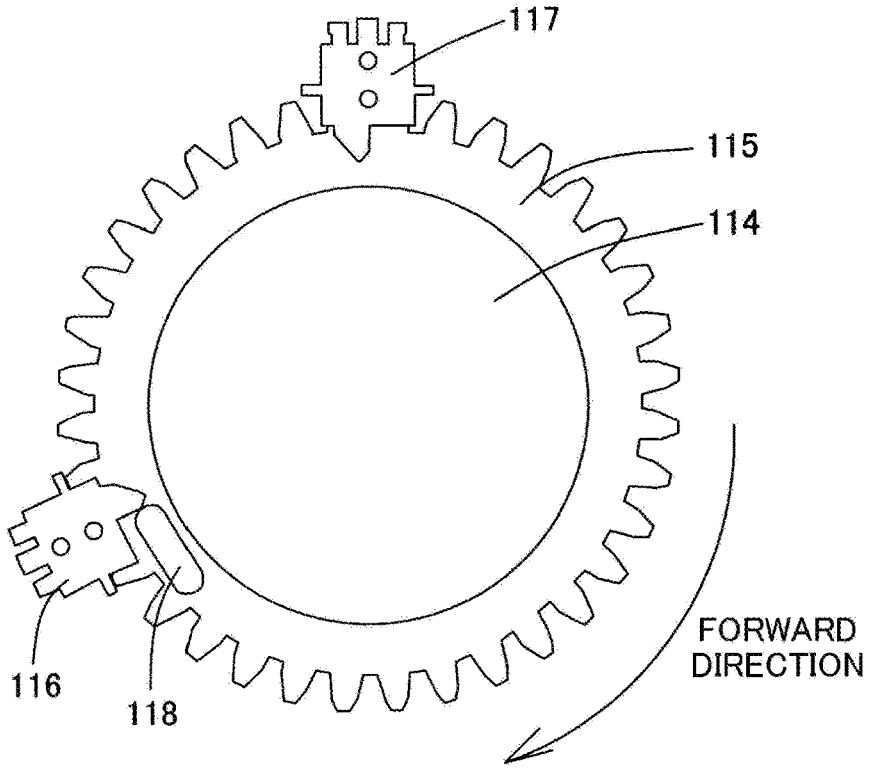
FIGS. 15A and 15B are explanatory views of a rotation angle restriction function of the surface light-emission system of FIG. 2, with FIG. 15A being a positional relationship between an angle restriction sensor and a protrusion when restricting in the forward direction, and FIG. 15B being positional relationship between the angle restriction sensor and the protrusion when restricting in the backward direction.
Figure 15B:
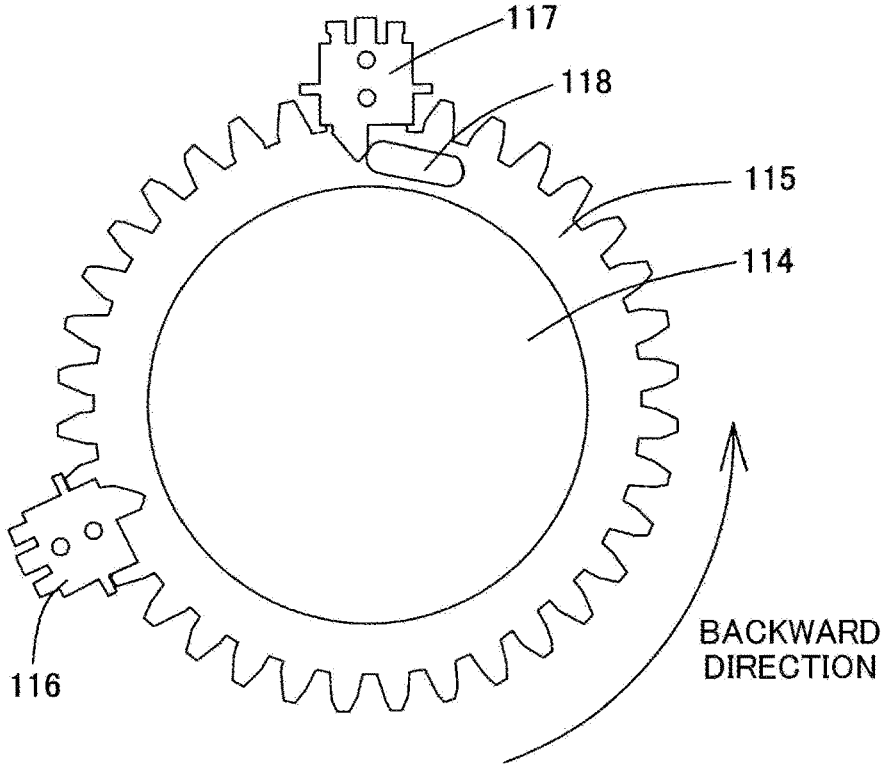

The second spur gear 115 includes a protrusion 118 on the side surface, and the rotation angle is restricted by the protrusion 118 contacting the angle restriction sensors 116 and 117 provided on the printed circuit board 112*a*. Specifically, when the surface light-emitting module 3 rotates to a forward threshold value (forward restriction angle) by the rotation of the motor 106, the angle restriction sensor 116 and the protrusion 118 are brought into contact and locked, as in FIG. 15A. When the surface light-emitting module 3 rotates to a backward threshold value (backward restriction angle) by the rotation of the motor 106, the angle restriction sensor 117 and the protrusion 118 are brought into contact and locked, as in FIG. 15B.

The forward threshold value (forward restriction angle) at this time is preferably 540 degrees or less, more preferably less than 360 degrees, further preferably 330 degrees or less, particularly preferably 300 degrees or less, and most preferably 270 degrees or less, with the direct lighting posture as a reference.

The backward threshold value (backward restriction angle) is preferably less than 360 degrees (over −360 degrees in the forward direction), more preferably 180 degrees or less (−180 degrees or more in the forward direction), with the direct lighting posture as a reference. The backward threshold value (backward restriction angle) is preferably 0 degree or more, i.e., immovable in the backward direction, from the viewpoint of preventing the user's finger from getting caught.

In this way, when no overload is applied to the motor 106, in the mounting part 100, the helical gear 108 rotates in accordance with the rotation of the motor 106, the clutch 104 rotates in accordance with the rotation of the helical gear 108, and the rotational force is transmitted and hence the shaft part 102 rotates. When the shaft part 102 rotates, the first spur gear 110 rotates and the second spur gear 115 rotates. When the protrusion 118 of the second spur gear 115 contacts the angle restriction sensors 116 and 117 of the printed circuit board 112*a*, the rotation of the motor 106 is stopped.

When an overload is applied to the motor 106, in the mounting part 100, the engagement of the uneven surface 120 of the helical gear 108 and the uneven surface 121 of the clutch 104 is released against the urging force of the spring 109 with the rotation of the motor 106, and thus the rotational force of the motor 106 is not transmitted to the shaft part 102 and the motor 106 idles.

The mounting part 100 has a structure in which, in addition to the above-described rotation angle control, the rotation speed of the rotating shaft 107 of the motor 106 is monitored from the current amount to the motor 106 and the like and it is stopped when it is detected that the rotation angle has reached the restriction angle from the rotation speed of the rotating shaft 107.

As in FIG. 12, the supporting member 5*a* includes an information reception part 125 (signal reception unit), a dimmer switch 126*a*, and a rotation switch 126*b*.

The information reception part 125 includes a wireless communication function such as Bluetooth (registered trademark) and is capable of receiving information from an external terminal 210 such as a remote controller. Upon receiving predetermined operation information at the information reception part 125, the motor 106 of the supporting member 5*a* is driven or stopped in accordance with a predetermined program. It is to be noted that the information reception part 125 may be an information transmission and reception part that not only receives but also transmits information.

The dimmer switch 126*a* is connected to the printed circuit board 112*a* or a printed circuit board not shown, and by pressing it down, it is possible to change the amount of current to be supplied to each of the surface light-emitting panels 10 so that the brightness of each of the surface light-emitting panels 10 can be adjusted. In the present embodiment, the dimmer switch 126*a* also serves as a power switch. the surface light-emitting panels 10 are turned on by pressing down the dimmer switch 126*a* at the time of non-lighting, and the brightness is changed each time the dimmer switch 126*a* is pressed down at the time of lighting. the surface light-emitting panels 10 are turned off by continuing to press down the dimmer switch 126*a* for a predetermined period of time (for example, 2 seconds) or more at the time of lighting.

The rotation switch 126*b* is connected to the printed circuit board 112*a* or a printed circuit board not shown, and when pressed down, the motor 106 rotates and the rotation angle of each of the surface light-emitting panels 10 can be adjusted. In the present embodiment, every time the rotation switch 126*b* is pressed down, the surface light-emitting module 3 rotates at a predetermined angle (for example, 10 degrees to 20 degrees) in the forward direction, and rotates backward by the rotation switch 126*b* being continuously pressed down for a predetermined period of time (for example, 2 seconds), thereby rotating in the opposite direction.

Figure 16:
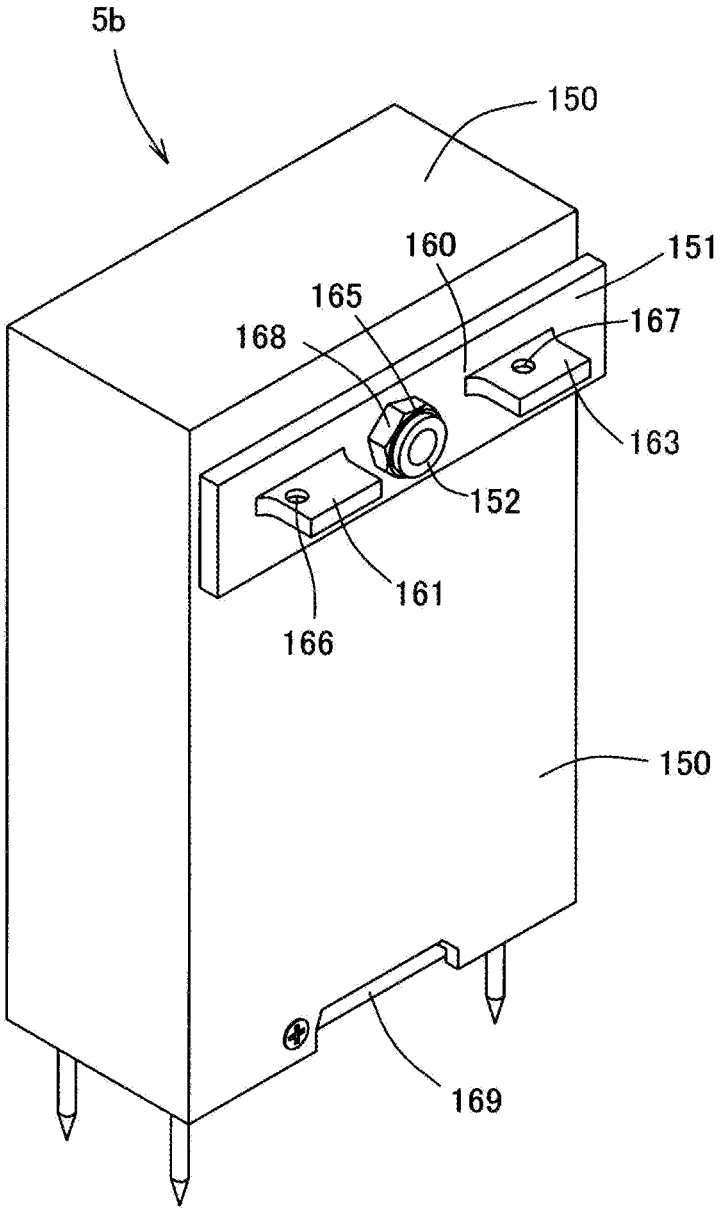
FIG. 16 is a perspective view of a supporting member different from that in FIG. 12.

The supporting member 5*b* is a member forming a pair with the supporting member 5*a* and, as in FIG. 16, includes a mounting part 150, a fixing part 151, and a shaft part 152 connecting the mounting part 150 and the fixing part 151.

Similarly to the mounting part 100, the mounting part 150 is a box body that can be fixed to the mounting surface 8*a* such as a wall surface.

The fixing part 151 is a portion fixed to the end of the surface light-emitting module 3 and supporting the surface light-emitting module 3, and includes a main body 160 and connecting units 161 and 162.

The main body 160 is a rectangular-shaped plate-like portion that includes a shaft hole part 165 at the longitudinal center. The shaft hole part 165 is a fastening hole that can be fastened with a fastening part 168 provided at the distal end of the shaft part 152 and is a bottomed hole or a through hole having a depth in the thickness direction of the main body 160. The shaft hole part 165 is a screw hole threaded inward on the inner surface and can be screwed with the fastening part 168. The connecting units 161 and 162 are plate-like portions standing upright with respect to the main body 160, and have fixing holes 166 and 167 at the center portion in the upright direction. The fixing holes 166 and 167 are insertion holes through which the temporary fastening element 202 can be inserted, and are through holes through which the connecting units 161 and 162 penetrate in the thickness direction.

The shaft part 152 is a linearly extending rod-shaped body that, when the surface light-emitting module 3 is assembled, is pivotally supported by a casing part 163 and disposed across the inside and outside of the casing part 163 of the mounting part 150, and the fastening part 168 is provided in an exposed part from the casing part 163. The fastening part 168 is a portion that can be fastened with the shaft hole part 165 of the fixing part 151, specifically, it is an external thread.

As in FIG. 4, the casing part 163 includes a casing side connecting unit 169 connectable with the end of the interval retaining member 6 on the mounting surface 8*a* side. Similarly to the casing side connecting unit 113 of the casing part 105, the casing side connecting unit 169 is provided at the lower end of the casing part 105 as in FIG. 16.

As in FIG. 4, the interval retaining member 6 is a reinforcing member that bridge parts between the supporting members 5*a* and 5*b*, maintains the interval between the supporting members 5*a* and 5*b*, and corrects distortion of the surface light-emitting module 3, and includes a main body 180 and connecting units 181 and 182.

Figure 17A:
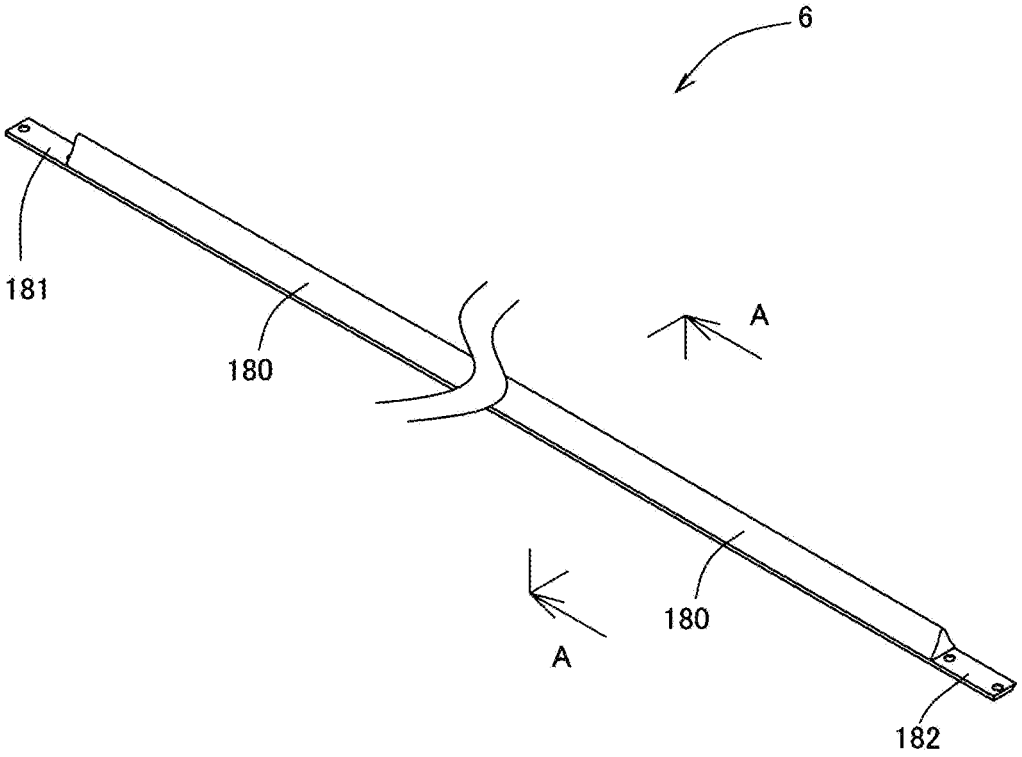
Figure 17B:
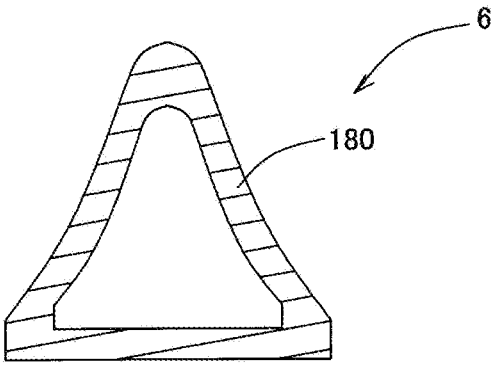

As in FIGS. 17A and 17B, the main body 180 is a lengthy portion having a substantially triangular-shaped cross section, and the connecting units 181 and 182 are provided at both longitudinal ends. The main body 180 has a vertex on the surface light-emitting panel 10 side and has a bottom surface on the mounting surface 8*a* side. In the main body 180, a surface connecting the vertex and the bottom surface is a curved surface, and the maximum width becomes gradually larger from the vertex side toward the bottom surface side. The main body 180 is preferably mirror-finished on the curved surface.

The connecting units 181 and 182 are plate-like portions connected with the casing side connecting units 113 and 169 of the supporting members 5*a* and 5*b* by a fastening element such as a screw, and overhanging outward from both the longitudinal ends of the main body 180.

The external terminal 210 (signal transmission unit) is a signal transmission device that transmits a plurality of types of operation signals to the information reception part 125 (refer to FIG. 12) of the supporting member 5*a* and, in this embodiment, is a remote controller.

Figure 18:
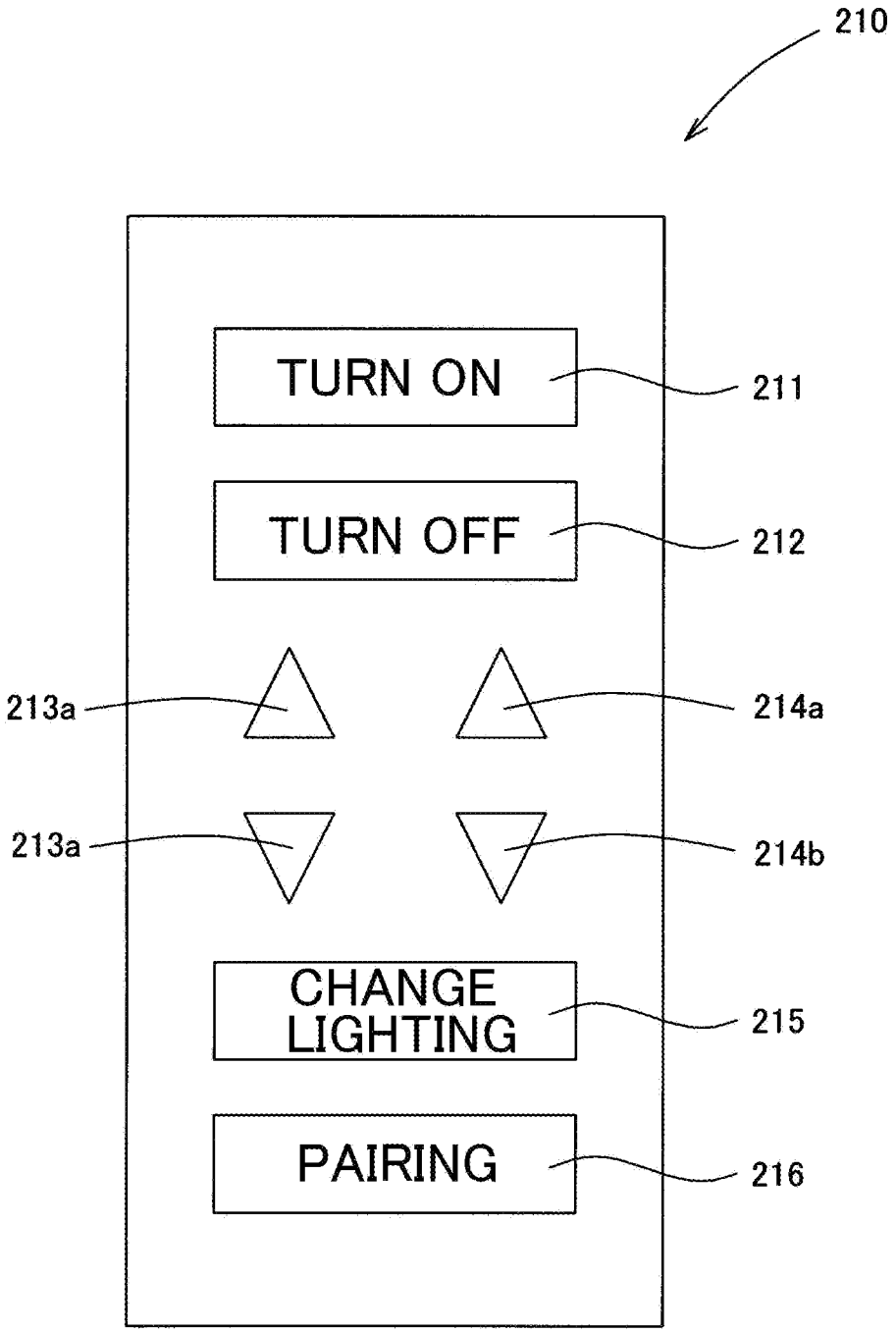
FIG. 18 is a front view schematically showing an external terminal usable for the lighting system of FIG. 1.

As in FIG. 18, the external terminal 210 is provided with a plurality of operation buttons and, by pressing down each operation button, is capable of transmitting an operation signal corresponding to the operation button to the information reception part 125 of the supporting member 5*a*. As in FIG. 18, the external terminal 210 of the present embodiment includes, as main operation buttons, a turn-on button 211, a turn-off button 212, dimmer buttons 213*a* and 213*b*, angle change buttons 214*a* and 214*b*, a lighting change button 215, and a pairing button 216.

The turn-on button 211 is a button for transmitting a lighting signal (operation signal related to lighting) to the information reception part 125. By pressing down it, power supply to the surface light-emitting module 3 is continued or started, and each of the surface light-emitting panels 10 can be lighted.

The turn-off button 212 is a button for transmitting a non-lighting signal (operation signal related to non-lighting) to the information reception part 125. By pressing down it, power supply to the surface light-emitting module 3 is stopped, and each of the surface light-emitting panels 10 can be turned off.

The dimmer buttons 213*a* and 213*b* are buttons for transmitting a dimmer signal (operation signal related to dimmer) to the information reception part 125. By pressing down it, the power supply amount to the surface light-emitting module 3 is changed, and the brightness of each of the surface light-emitting panels 10 can be changed. In the external terminal 210 of the present embodiment, the brightness of each of the surface light-emitting panels 10 increases when the dimmer button 213*a* is pressed down, and the brightness of each surface light-emitting panel 10 decreases when the dimmer button 213*b* is pressed down.

The angle change buttons 214*a* and 214*b* are buttons for transmitting an angle change signal (operation signal related to angle posture) to the information reception part 125. By pressing down it, the motor 106 is driven, allowing the surface light-emitting module 3 to be caused to rotate in a stepwise or stepless manner.

In the external terminal 210 of the present embodiment, the surface light-emitting module 3 rotates in the forward direction when the angle change button 214*a* is pressed down, and the surface light-emitting module 3 rotates in the backward direction when the angle change button 214*b* is pressed down.

Further, by pressing down the angle change buttons 214*a* and 214*b* of the present embodiment, it is possible to cause the surface light-emitting module 3 to rotate in a stepwise manner by a predetermined rotation angle.

This predetermined rotation angle is preferably between 5 degrees and 20 degrees. Within this range, it is easy to adjust to a desired angle.

The lighting change button 215 is a button for transmitting a lighting change signal (operation signal related to lighting posture) to the information reception part 125. By pressing down it, the motor 106 is driven, allowing the surface light-emitting module 3 to be caused to rotate and to be changed between the indirect lighting posture and the direct lighting posture.

The pairing button 216 is a button for transmitting a pairing signal (operation signal related to synchronization) to the information reception part 125. By pressing down it, the motor 106 is driven, allowing the surface light-emitting module 3 to be caused to rotate and to be changed to the same posture as another surface light-emitting module 3 or a preset posture.

Subsequently, the positional relationship of the surface light-emitting module 3 will be described.

In the surface light-emitting module 3, the plurality of surface light-emitting panels 10 (10*a* to 10*j*) are linearly arranged in the lateral direction X by the frame member 11, and the surface light-emitting panels 10 and 10 adjacent in the arranged direction are in a state of being brought into contact or close proximity. The distance between the adjacent surface light-emitting panels 10 and 10 is preferably ⅕ or less of one side of the surface light-emitting panel 10, and more preferably 1/10 or less. In the present embodiment, the distance between the adjacent surface light-emitting panels 10 and 10 is 2 cm or less.

The emission surface 16 of each of the surface light-emitting panels 10*a* to 10*j* faces an identical direction and constitutes an identical surface. In the surface light-emitting panel 10, as in FIG. 19, the bracket part 21 is attached to the rear face of the light-emitting tile 20. The power supply portion 25 of the light-emitting tile 20 passes through the bracket part 21 and reaches the rear face side of the bracket part 21, and the tile side connector portion 26 is fitted into the corresponding power supply side connector portion 86 of the power supply members 12*a* and 12*b*.

The power supply members 12*a* and 12*b* are disposed across the plurality of surface light-emitting panels 10. The power supply members 12*a* and 12*b* are fitted in the power supply position adjusting grooves 32 of the respective bracket parts 21 to which the board main body 85 is connected respectively, and the movement of the power supply members 12*a* and 12*b* in the direction away from the bracket part 21 is locked by the power supply fixing part 31. The position adjusting projection 39 is inserted in the positioning hole 87 of the power supply members 12*a* and 12*b*, and the movement in the lateral direction X and the vertical direction Y is regulated.

The wiring connector portions 89 and 88 located at the ends of the power supply members 12*a* and 12*b* are in a state of being brought into close proximity in the lateral direction X. The wiring side connector portions 91*a* and 91*b* of the panel side wiring member 15 are respectively connected thereto. That is, the power supply members 12*a* and 12*b* are electrically connected by the panel side wiring member 15.

Each of the power supply side connector portions 86 of the power supply members 12*a* and 12*b* is electrically connected in series via each of the respective light-emitting tiles 20.

The light-emitting side frame 55 is attached to the emission surface 16 side of each of the surface light-emitting panels 10, and the first crosspiece part 60 (60*a* and 60) and the second crosspiece part 61 (61*a* to 61*k*) are provided along an edge of each of the surface light-emitting panels 10*a* to 10*j*.

Specifically, the first crosspiece part 60 covers the non light-emitting region 23 of each of the surface light-emitting panels 10 with the light-emitting side cover 62, and covers the side surface of each of the surface light-emitting panels 10 with the side face side covers 63*a* and 63*b*.

The second crosspiece part 61 is disposed across between the non light-emitting regions 23 and 23 of the surface light-emitting panels 10 and 10 adjacent in the arranged direction (lateral direction X). That is, the non light-emitting region 23 of each of the surface light-emitting panels 10 is concealed by the first crosspiece part 60 and the second crosspiece part 61, and only the light-emitting region 22 is exposed from the window part 68 formed by the first crosspiece part 60 and the second crosspiece part 61.

In the first crosspiece parts 60*a* and 60*b*, the first frame side fixing holes 66*a* and 66*b* form one communicating hole with the panel side fixing holes 48*a* and 48*b* of the bracket part 21, a fastening element is inserted into the communicating hole, and the frame-side engagement holes 65*a* to 65*d* are engaged with the engagement protrusions 47*a* to 47*d* of the bracket part 21. Hence, in the surface light-emitting module 3, the light-emitting side frame 55 is integrated with the surface light-emitting panel 10.

The rear face side frame 56 is attached to the rear face side of each of the surface light-emitting panels 10, the rear face side cover 70 covers the outside of the bracket part 21, and the side face side covers 71 and 72 cover the outside of the side face side covers 63*a* and 63*b* of the light-emitting side frame 55. That is, the rear face side frame 56 constitutes a non emission surface 17 which is the rear face of the surface light-emitting module 3.

The distal end of the interval maintaining part 36 of the bracket part 21 is brought into contact with or close proximity to the rear face side cover 70. The frame side fixing holes 75*a* and 75*b* of the side face side covers 71 and 72 and the second frame side fixing holes 67*a* and 67*b* of the side face side covers 63*a* and 63*b* form one communicating hole, and the fastening element 201 is inserted into the communicating hole.

Next, the positional relationship of the surface light-emission system 2 will be described.

Both ends of the surface light-emitting module 3 are supported by the supporting members 5*a* and 5*b*, and fixed in a lateral posture by the supporting members 5*a* and 5*b*. That is, the surface light-emitting module 3 is supported by the supporting members 5*a* and 5*b* in a posture in which the longitudinal direction extends in the lateral direction X.

The shaft part 102 forming the rotating shaft of the surface light-emitting module 3 extends in the horizontal direction and is in parallel to the mounting surface 8*a*. That is, the surface light-emitting module 3 is rotatable in the circumferential direction while maintaining the posture parallel to the mounting surface 8*a*.

The fixing parts 101 and 151 are connected with the mounting parts 100 and 150 via the shaft parts 102 and 152, and are rotatable with respect to the mounting parts 100 and 150. In the fixing parts 101 and 151, the main bodies 130 and 160 continuously form a panel-like appearance together with the surface light-emitting module 3, and the shaft hole parts 135 and 165 are fastened with the fastening parts 119 and 168 of the shaft parts 102 and 152.

The fixing holes 136 and 137 of the connecting units 131 and 132 of the supporting member 5*a* form one communicating hole with the fastening reception holes 79 and 80 of the ridge parts 73 and 74 of the rear face side frame 56, and the temporary fastening element 202 is inserted into the communicating hole. Similarly, the fixing holes 166 and 167 of the connecting units 161 and 162 of the supporting member 5*b* form one communicating hole with the fastening reception holes 77 and 78 of the ridge parts 73 and 74 of the rear face side frame 56, and the temporary fastening element 202 is inserted into the communicating hole.

Figure 19:
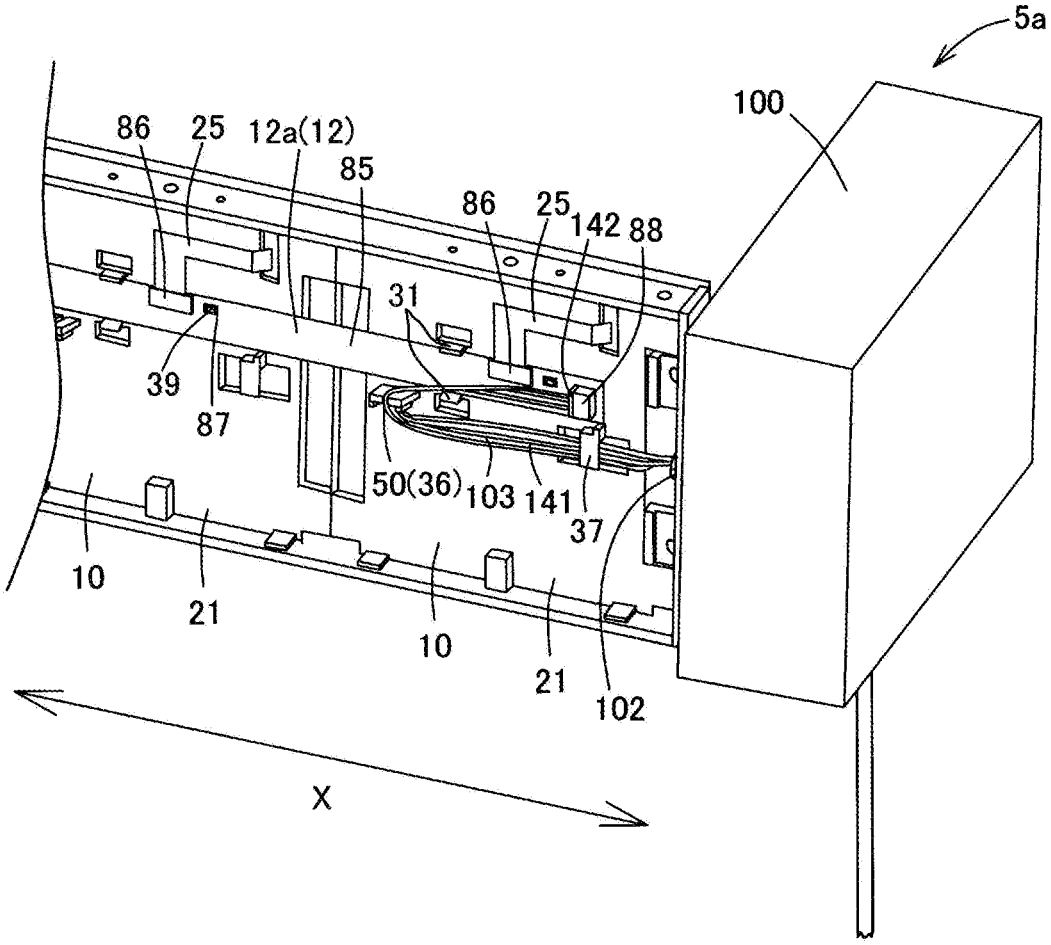
FIG. 19 is a perspective view of a main part of the surface light-emitting module of FIG. 4.

A part of the support side wiring member 103 is disposed inside the surface light-emitting module 3 as in FIG. 19. The wiring main body 141 overhangs from the wiring space 140 inside the shaft part 102, and the overhanging part is disposed between the light-emitting side frame 55 and the rear face side frame 56. The wiring main body 141 is engaged with the wiring regulating part 37 of the bracket part 21 and passes through the wiring notch 50, and the wiring side connector portion 142 is connected with the wiring connector portion 88 of the power supply member 12*a*.

The connecting units 181 and 182 of the interval retaining member 6 are connected with the casing side connecting units 113 and 169 of the supporting members 5*a* and 5*b*, and the interval retaining member 6 is provided along the mounting surface 8*a*.

In the surface light-emission system 2, as in FIGS. 20A to 20C, the surface light-emitting module 3 rotates with respect to the supporting members 5*a* and 5*b* relatively, and it is possible to switch between the direct lighting posture and the indirect lighting posture.

In the direct lighting posture, as in FIG. 20A, the emission surface 16 of each of the surface light-emitting panels 10 faces the living space 7 side, and the non emission surface 17, which is the rear face, faces the mounting surface 8*a* side. That is, in the surface light-emitting module 3, the emission surface 16 faces the direction opposite to the interval retaining member 6, and the non emission surface 17 faces the interval retaining member 6 so as to sandwich the space between the non emission surface 17 and the interval retaining member 6. Therefore, it becomes possible to irradiate light directly to the user side, and to supply light with high brightness to the living space 7 side. Further, when the emission surface 16 is viewed from the front, the interval retaining member 6 is concealed by the surface light-emitting module 3, so that the surface light-emission system 2 can function as a lighting device with high designability.

Figure 21:
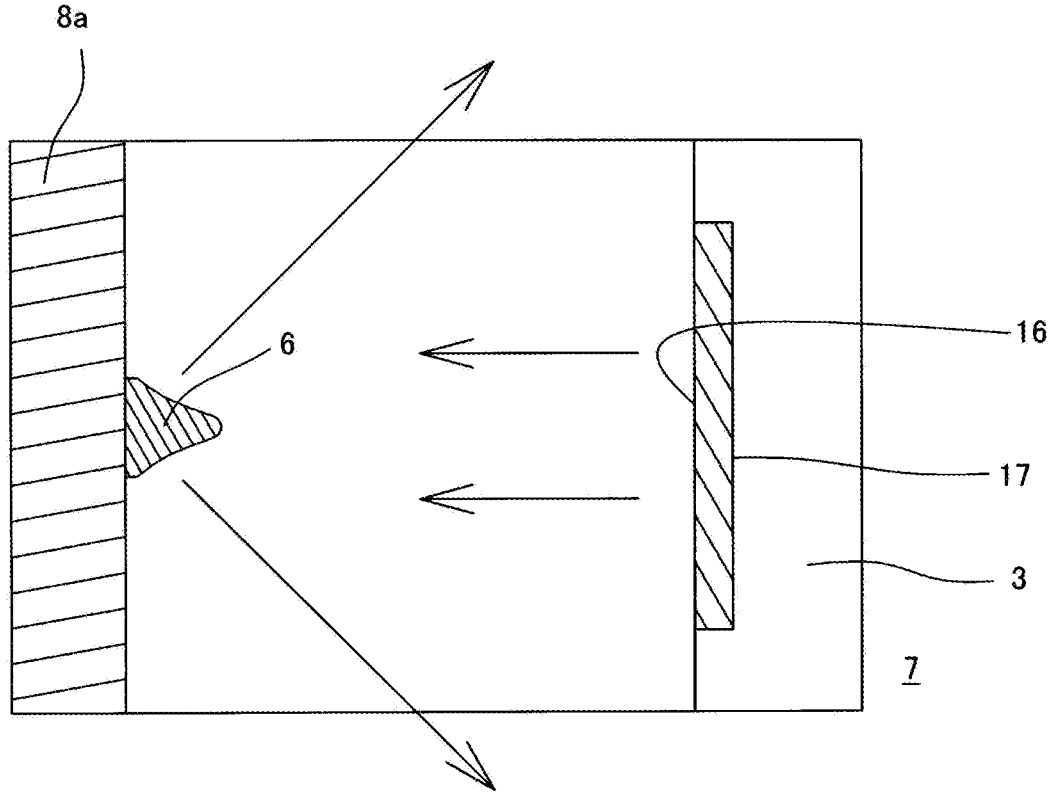
FIG. 21 is a cross-sectional view of a main part in an indirect lighting posture in the surface light-emission system of FIG. 2.

On the other hand, in the indirect lighting posture, as in FIG. 20C, the emission surface 16 of each of the surface light-emitting panels 10 faces the mounting surface 8*a* side, and the non emission surface 17, which is the rear face, faces the living space 7 side. That is, in the surface light-emitting module 3, as in FIG. 21, the emission surface 16 is opposed to the interval retaining member 6 so as to sandwich the space between the emission surface 16 and the interval retaining member 6, and the non emission surface 17 faces the side opposite to the interval retaining member 6. Therefore, while maintaining the rigidity by the interval retaining member 6, it becomes possible to irradiate reflected light from the mounting surface 8*a* and the main body 180 of the interval retaining member 6 to the user side (the living space 7 side). Further, when the non emission surface 17 is viewed from the front, the interval retaining member 6 is concealed by the surface light-emitting module 3, so that the surface light-emission system 2 can function as a lighting device with high designability.

According to the surface light-emission system 2 of the present embodiment, by pressing down the operation button of the external terminal 210 such as a remote controller, the posture can be changed by rotating the surface light-emitting module 3 automatically. For example, by continuously or intermittently pressing down the angle change button 214 of the external terminal 210, it is possible to rotate the surface light-emitting module 3 in a stepwise manner by a predetermined rotation angle, and to change the posture of the surface light-emitting module 3 to a posture of the desired rotation angle by the user.

In addition, by pressing down the lighting change button 215 of the external terminal 210, it is possible to automatically change between the direct lighting posture in which the emission surface 16 of the surface light-emitting module 3 faces the living space side and the indirect lighting posture in which the emission surface 16 of the surface light-emitting module 3 faces the mounting surface 8*a* side (the interval retaining member 6 side). Therefore, it is possible to switch between the function as a direct lighting and the function as an indirect lighting in accordance with the user's intended use.

Further, by pressing down the pairing button 216, it is possible to change or maintain the posture of its own surface light-emitting module 3 to the same posture as another surface light-emitting modules 3 or a preset posture. Therefore, it is possible to reproduce a unified lighting space between the surface light-emission systems 2 and 2. For example, by pressing down the pairing button 216, the surface light-emitting modules 3 of the respective surface light-emitting systems 2 installed in the living space 7 are unified in the indirect lighting posture, or only the surface light-emitting module 3 of the specific surface light-emitting system 2 can be set as the indirect lighting posture. Therefore, a preset lighting space can be automatically reproduced.

According to the surface light-emission system 2 of the present embodiment, the rotation angle of the surface light-emitting module 3 is restricted by monitoring the rotation speed of the motor 106 by the printed circuit board 112*a* or a printed circuit board (angle restriction unit) (not shown), and the rotation angle of the surface light-emitting module 3 with respect to the mounting surface 8*a* is restricted by the protrusion 118 of the second spur gear 115 contacting the angle restriction sensors 116 and 117. That is, both one end and the other end of the circumferential movable range of the surface light-emitting module 3 are restricted by physical regulation of the angle restriction sensors 116 and 117. Therefore, it is possible to prevent troubles such as disconnection of the support side wiring member 103 and catching of the user's finger that are caused by the rotation of the surface light-emitting module 3, thereby improving safety and reliability as compared with the conventional case.

According to the surface light-emission system 2 of the present embodiment, the rotational range of the surface light-emitting module 3 is restricted by both the electronic control of the motor 106 and the physical control of the angle restriction sensors 116 and 117, and hence the detection position of the angle restriction sensors 116 and 117 can be corrected according to the reference of the motor 106 even if, for example, it is shifted. Therefore, maintenance becomes easy.

According to the surface light-emission system 2 of the present embodiment, since the surface light-emitting module 3 rotates by the driving of the motor 106, the posture of the surface light-emitting module 3 with respect to the supporting members 5*a* and 5*b* can be fixed to a desired posture.

According to the surface light-emission system 2 of the present embodiment, since the surface light-emitting module 3 is integrated with the fixing parts 101 and 151 of the supporting members 5*a* and 5*b* by the temporary fastening elements 202 and 202, it is possible to easily remove the surface light-emitting module 3 from the supporting members 5*a* and 5*b* by removing the temporary fastening elements 202 and 202. Therefore, the surface light-emitting module 3 can be easily attached to and detached from the supporting members 5*a* and 5*b*, and when the surface light-emitting module 3 went out, it can be easily replaced with a new surface light-emitting module 3.

Subsequently, a lighting system 301 of the second embodiment will be described. It is to be noted that the same reference numerals are given to the same components as those of the lighting system 1 of the first embodiment, and the description thereof will be omitted. Regarding the positional relationship of a surface light-emission system 302, the posture of FIG. 1 is taken as a reference. That is, a supporting member 305 side is down, and a surface light-emitting module 303 side is up.

Figure 22:
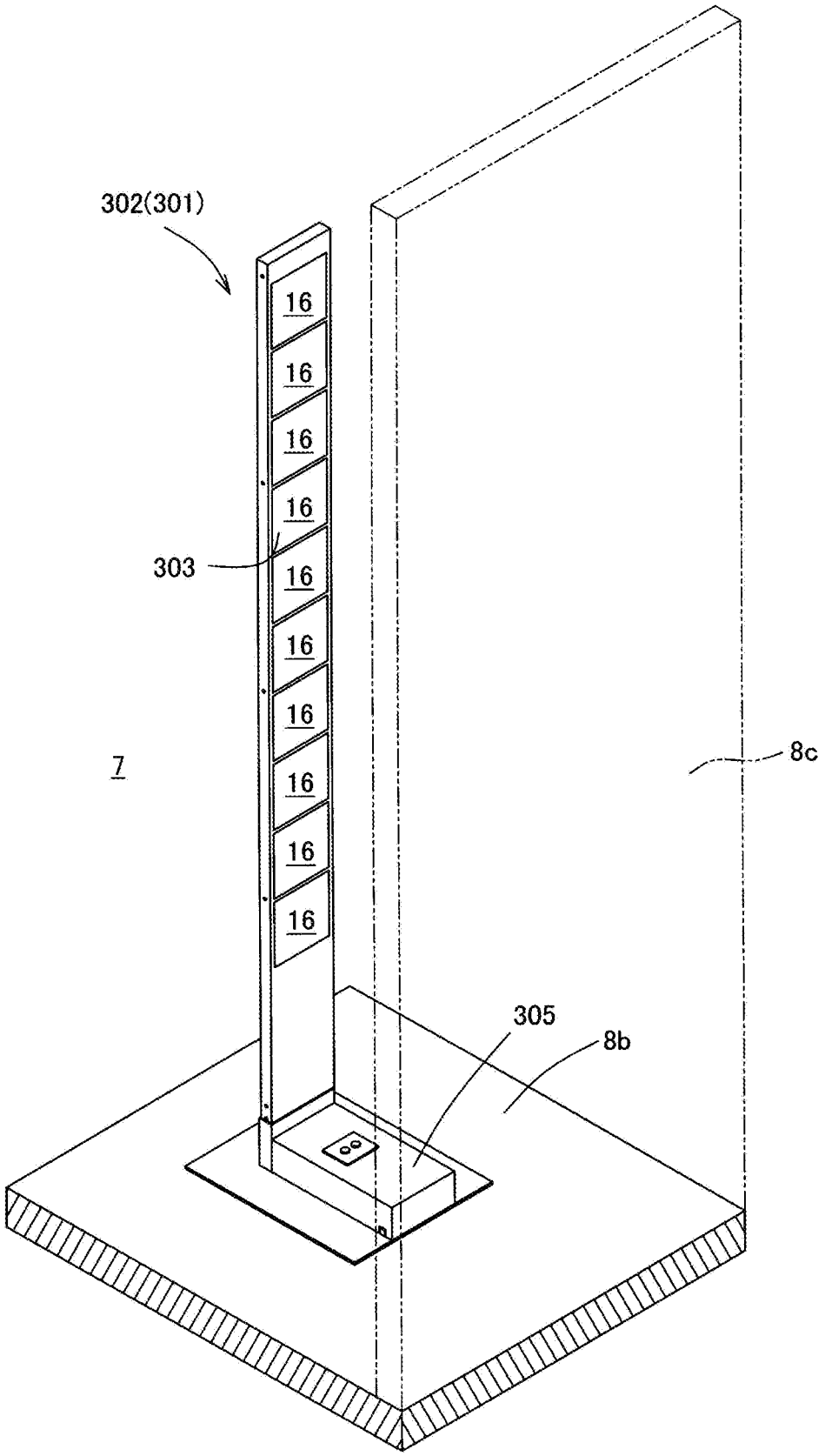
FIG. 22 is a perspective view of a surface light-emission system according to a second embodiment of the present invention.

Similarly to the lighting system 1 of the first embodiment, the lighting system 301 of the second embodiment is disposed mainly in the living space 7 as in FIG. 22, and has the surface light-emission system 302.

Figure 23:
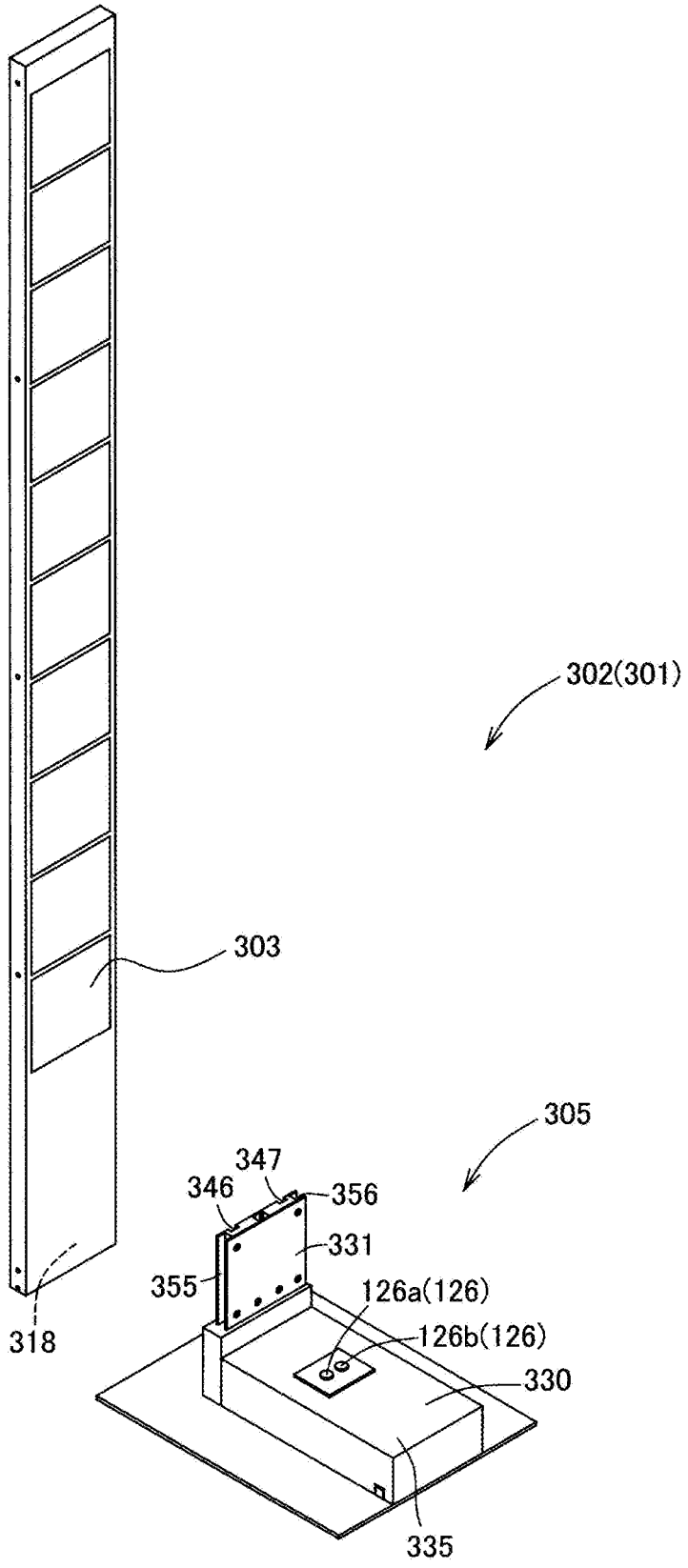
FIG. 23 is an exploded perspective view of the surface light-emission system of FIG. 22.

As in FIG. 22 and FIG. 23, the surface light-emission system 302 is a lighting device having an "L" shape when viewed from the side, and includes the surface light-emitting module 303 and the supporting member 305.

Similarly to the surface light-emission system 2 of the first embodiment, the surface light-emission system 302 is capable of switching between the direct lighting posture in which the emission surface 16 faces the living space 7 side and the indirect lighting posture in which the emission surface 16 faces a mounting surface 8*c* side, by manually or automatically rotating the surface light-emitting module 303. In the surface light-emission system 302, an angle restriction is provided in the rotation movable range of the surface light-emitting module 303, and excessive rotation of the surface light-emitting module 303 is prevented.

Figure 24:
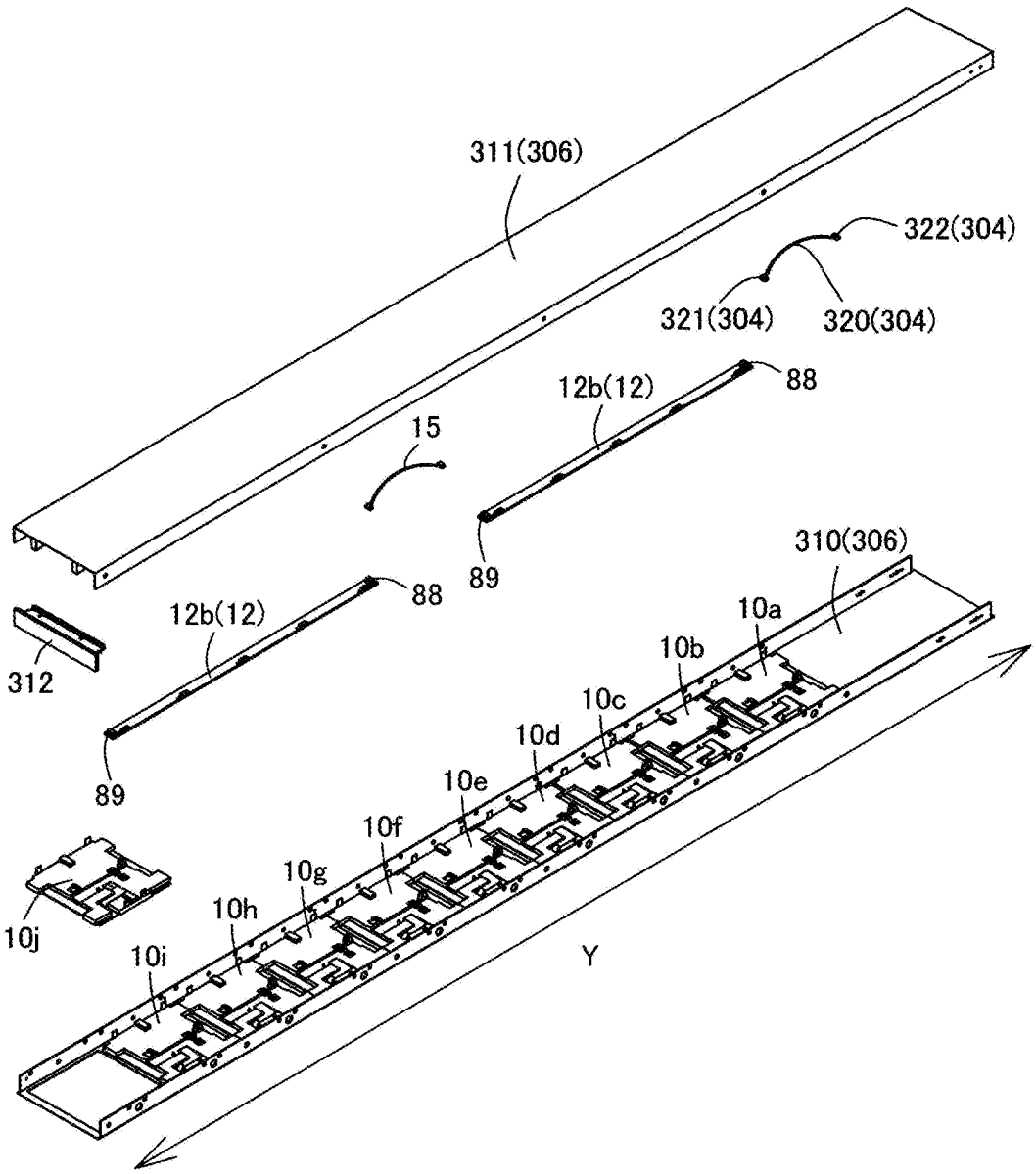
FIG. 24 is an exploded perspective view of the surface light-emitting module of FIG. 23.

As in FIG. 24, the surface light-emitting module 303 includes the plurality of surface light-emitting panels 10, a frame member 306, the power supply members 12*a* and 12*b*, and panel side wiring members 15 and 304.

The frame member 306 is composed of a light-emitting side frame 310, a rear face side frame 311, and an end face side frame 312.

The light-emitting side frame 310 is a member having substantially the same structure as that of the light-emitting side frame 55 of the first embodiment, and is composed of the first crosspiece parts 60*a* and 60*b* and the second crosspiece parts 61*a* to 61*k* connecting between the first crosspiece parts 60*a* and 60*b*.

Figure 25:
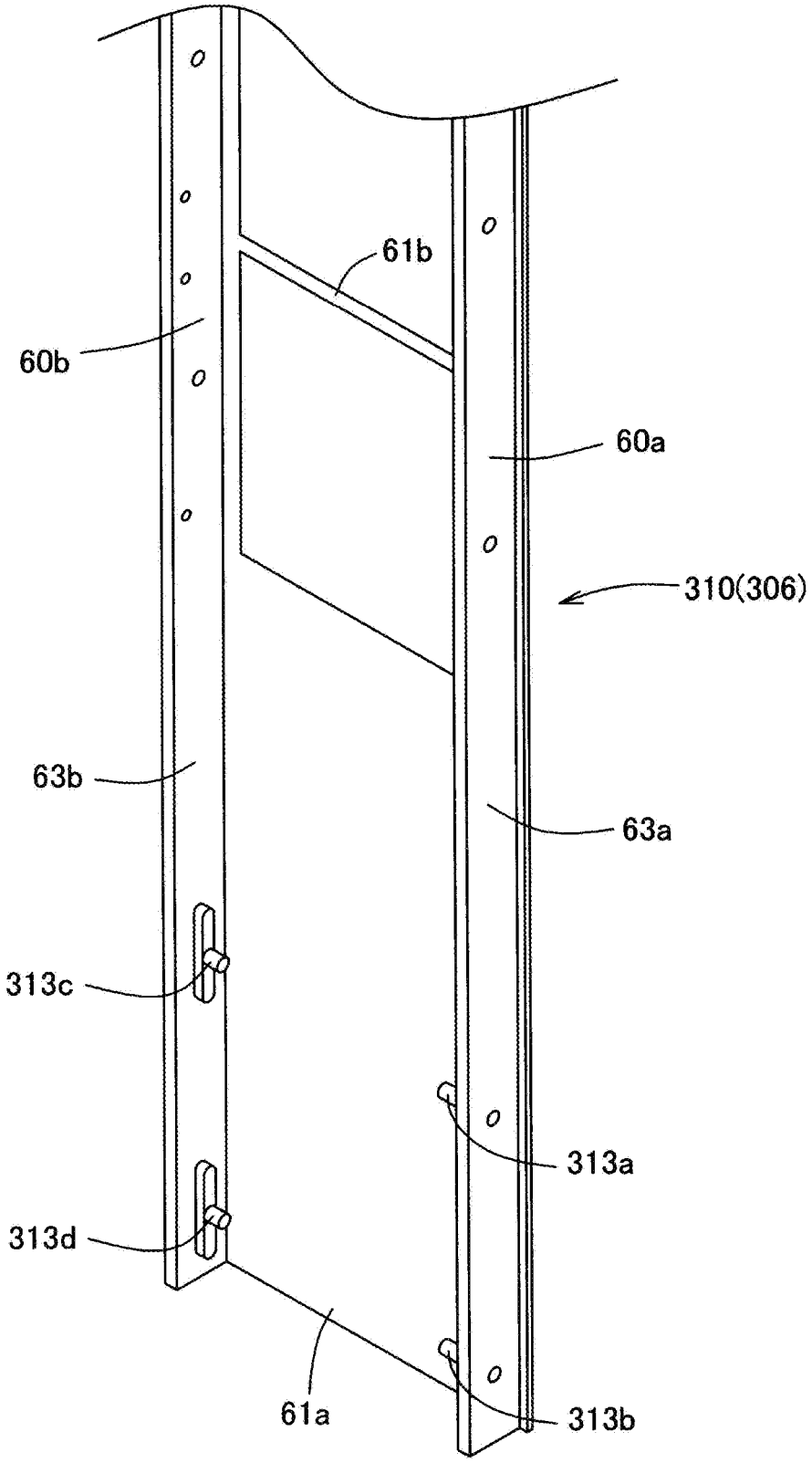
FIG. 25 is a perspective view of a main part of the light-emitting side frame of FIG. 24.

As in FIG. 25, slider parts 313*a* to 313*d* are provided on the longitudinal lower end side (the supporting member 305 side) of the first crosspiece parts 60*a* and 60*b* of the light-emitting side frame 310.

The slider parts 313*a* to 313*d* are portions that restrict the moving direction of the frame member 306 in a predetermined direction and are upright projections with respect to the side face side covers 63*a* and 63*b*. The slider parts 313*a* and 313*b* of the side face side cover 63*a* and slider parts 313*c* and 313*d* of the side face side cover 63*b* protrude toward each other.

The second crosspiece part 61*a* located at the lower end of the light-emitting side frame 310 is wider than the other second crosspiece parts 61*b* to 61*k* in width, and in the present embodiment, it is approximately double in size of the surface light-emitting panel 10.

Figure 26:
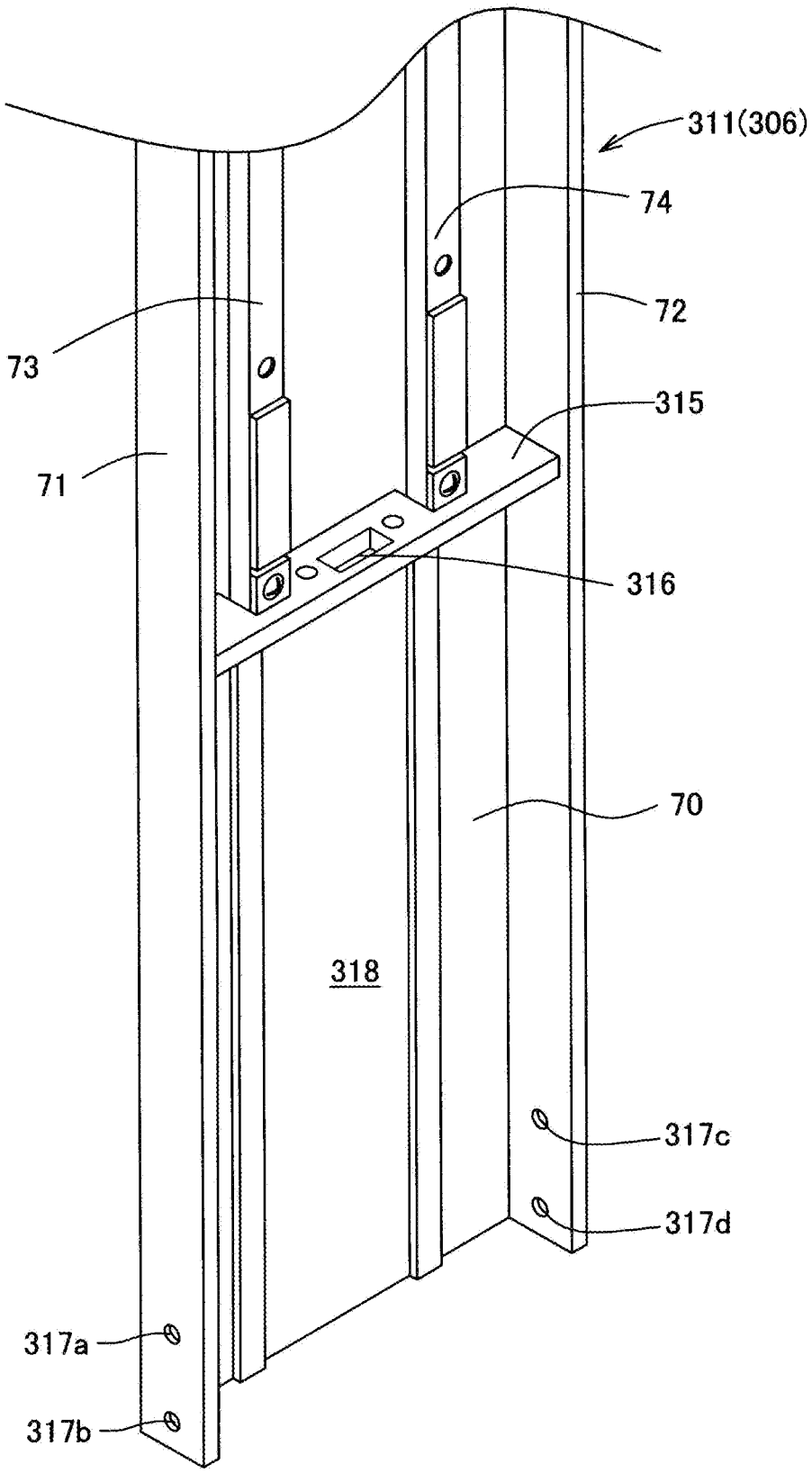
FIG. 26 is a perspective view of a main part of the rear face side frame of FIG. 24.

As in FIG. 26, the rear face side frame 311 includes the rear face side cover 70, the side face side covers 71 and 72, the ridge parts 73 and 74, and a partitioning member 315.

The partitioning member 315 is a rectangular-shaped plate-like body that partitions the space surrounded by the covers 70, 71, and 72. That is, in the surface light-emitting module 303, the internal space of the frame member 306 is longitudinally partitioned by the partitioning member 315.

The partitioning member 315 includes a connecting fixing hole 316 penetrating in the thickness direction at the longitudinal center. The connecting fixing hole 316 can insert a connecting connector portion 361 (refer to FIG. 28) of a support side wiring member 333.

As in FIG. 24, the panel side wiring member 304 is a member for electrically connecting the wiring connector portion 88 of the power supply member 12*a* and the connecting connector portion 361 of the support side wiring member 333, and includes a wiring main body 320, a wiring side connector portion 321, and a connecting connector portion 322.

The wiring main body 320 is a linear body or a bundle-like body physically and electrically connecting between the wiring side connector portion 321 and the connecting connector portion 322.

The wiring side connector portion 321 is a connection terminal connectable with the wiring connector portion 88 of the power supply member 12*a*. Specifically, the wiring side connector portion 321 is a male connector that is made electrically connectable by being fitted with the wiring connector portion 88.

The connecting connector portion 322 is a connection terminal connectable with the connecting connector portion 361 of the support side wiring member 333. Specifically, the connecting connector portion 322 is a male connector that is made electrically connectable by being fitted with the connecting connector portion 361 of the support side wiring member 333.

As in FIG. 24, the end face side frame 312 is a member that blocks the internal space of the frame member 306 and constitutes the end face of the frame member 306.

Here, the positional relationship of each portion of the surface light-emitting module 3 will be described.

In the surface light-emitting module 303, each of the surface light-emitting panels 10 (10*a* to 10*j*) is linearly arranged in the vertical direction Y (longitudinal direction). The surface light-emitting panel 10 is disposed close to one end side (upper end side) of the arranged direction inside the frame member 306. That is, the surface light-emitting panel 10 is disposed so as to be biased toward one longitudinal side.

In the frame member 306, the light-emitting side frame 310 is attached to the emission surface 16 side of each of the surface light-emitting panels 10, and the rear face side frame 311 is attached to the non emission surface 17 side, which is the rear face of the surface light-emitting panel 10. In the frame member 306, the end face side frame 312 is provided on one end (upper end) side of the arranged direction of the surface light-emitting panel 10, and the partitioning member 315 is disposed in a position opposed to the end face side frame 312 so as to sandwich each of the surface light-emitting panels 10 between the partitioning member 315 and the end face side frame 312, which is the middle section of the arranged direction (up-down direction) of the surface light-emitting panels 10. That is, in the frame member 306, each of the surface light-emitting panels 10 is disposed between the end face side frame 312 and the partitioning member 315.

As in FIG. 26, the internal space of the frame member 306 is partitioned by the partitioning member 315, and an insertion space 318 is formed outside of the partitioning member 315. The insertion space 318 is a space surrounded by the light-emitting side frame 310 and the rear face side frame 311, and is capable of inserting a fixing part 331 of the supporting member 305.

As in FIG. 22 and FIG. 23, the supporting member 305 is a member placed on a floor surface 8*b* (mounting surface) and rotatably supporting the surface light-emitting module 303, and is capable of supporting the surface light-emitting module 303 so that the emission surface 16 of each of the surface light-emitting panels 10 faces in the horizontal direction. As in FIG. 23 and FIG. 28, the supporting member 305 includes a mounting part 330 (main body), the fixing part 331, the shaft part 102 connecting the mounting part 330 and the fixing part 331, and the support side wiring member 333.

As in FIG. 23, the mounting part 330 is a box body capable of being fixed with respect to the floor surface 8*b*, and is a member forming the base of the surface light-emitting module 303.

Similarly to the mounting part 100 of the first embodiment, in the mounting part 330, the motor 106 is incorporated inside a casing part 335, the shaft part 102 rotates with the rotation of the rotating shaft 107 of the motor 106, and the fixing part 331 also rotates in conjunction. The mounting part 330 has a structure in which a safety clutch is activated when a predetermined load or more is applied to the motor 106. When an overload is applied to the motor 106, the connection between the motor 106 and the shaft part 102 is cut off and it is possible to cut off the torque transmission.

In the mounting part 330, when the circumferential rotation angle of the shaft part 102 reaches a predetermined angle, the rotation of the shaft part 102 is restricted, and it is possible to regulate the rotation movable range of the fixing part 331. That is, the supporting member 305 is capable of regulating the rotation movable range in the circumferential direction of the surface light-emitting module 303.

Figure 27:
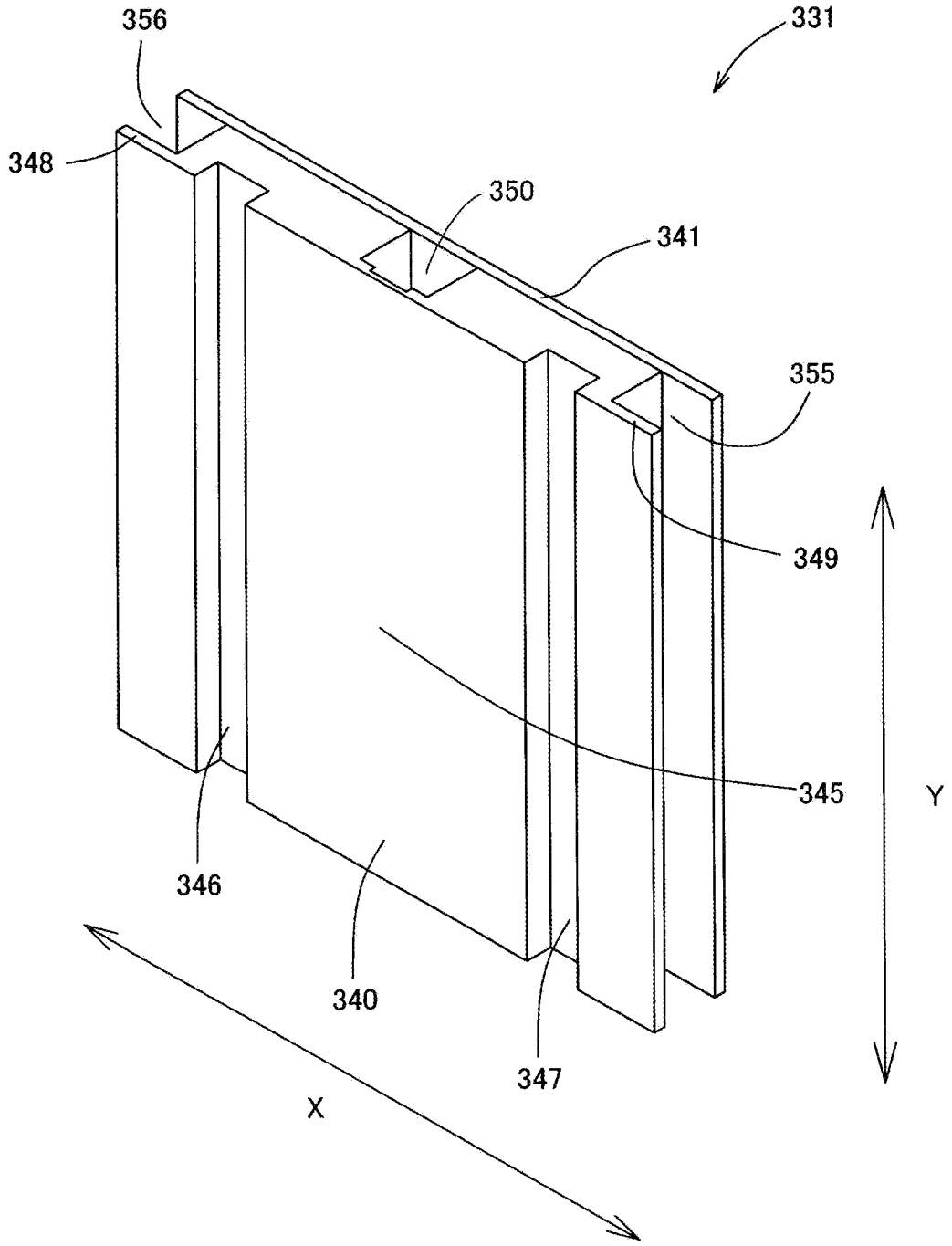
FIG. 27 is a perspective view of the fixing part of FIG. 24 as viewed from another direction.

The fixing part 331 is a portion which is to be inserted into the insertion space 318 (refer to FIG. 26) of the surface light-emitting module 303 and supports the surface light-emitting module 303, and as in FIG. 23, the fixing part 331 is a substantially plate-like body having approximately the same size as the surface light-emitting panel 10. As in FIG. 27 and FIG. 28, the fixing part 331 is a quadrangular-shaped plate-like body, and includes a first reinforcing part 340 (reinforcing member) and a second reinforcing part 341 (reinforcing member) as main constituent members. The support side wiring member 333 can be inserted between the first reinforcing part 340 and the second reinforcing part 341.

The first reinforcing part 340 is a member that reinforces the supporting strength of the fixing part 331 and protects the support side wiring member 333. As in FIG. 27, the first reinforcing part 340 includes a main body 345, slide groove parts 346 and 347, and overhanging parts 348 and 349 on one main surface side (rear face side), and includes a wiring groove part 350 on the other main surface side (second reinforcing part 341 side).

The slide groove parts 346 and 347 are regulating grooves that regulate the moving direction of the ridge parts 73 and 74 of the rear face side frame 311 when the surface light-emitting module 303 is assembled. As in FIG. 27, the slide groove parts 346 and 347 are bottomed grooves having a bottom in the thickness direction of the main body 345, and extend linearly in the vertical direction Y. That is, the slide groove parts 346 and 347 extend in the same direction as the extending direction of the ridge parts 73 and 74 of the rear face side frame 311. The overhanging parts 348 and 349 are overhang parts overhang in the lateral direction X from the end of the lateral direction X of the main body 345.

Figure 28:
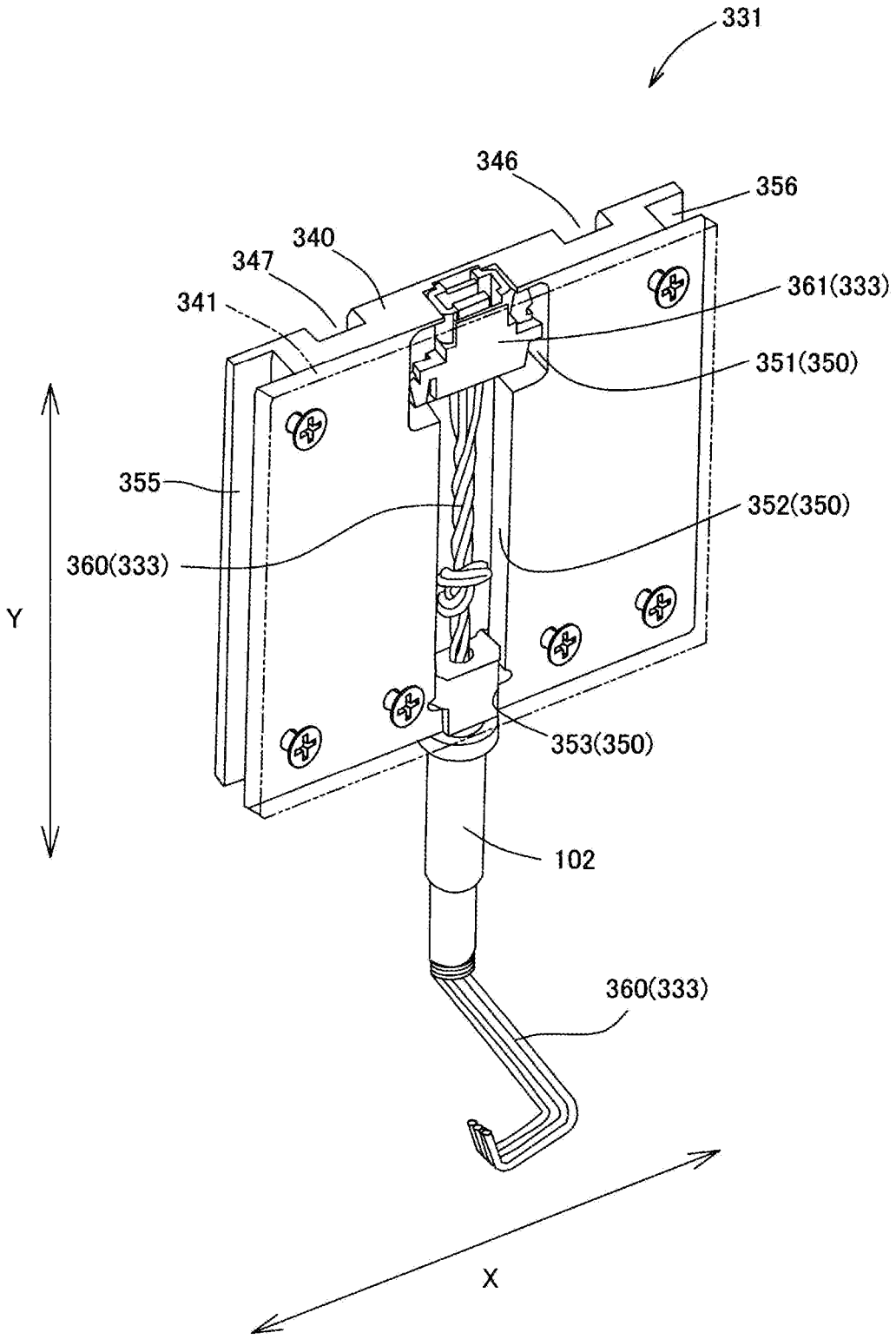
FIG. 28 is a perspective view of the vicinity of the support side wiring member of FIG. 24, with the second reinforcing part made transparent.

As in FIG. 28, the wiring groove part 350 is a groove part for fixing the support side wiring member 333, is a communication groove communicating in the vertical direction Y, and includes a connector fixing part 351, a wiring passing part 352, and a shaft fixing part 353.

The connector fixing part 351 is a groove part that fixes the connecting connector portion 361 of the support side wiring member 333 together with the second reinforcing part 341, and is capable of housing most part or the entire of the connecting connector portion 361 thereinside. The connector fixing part 351 can retain the connecting connector portion 361 so that a part of the connecting connector portion 361 is exposed from the fixing part 331 in a state in which the support side wiring member 333 is attached.

The wiring passing part 352 is a groove part which connects the connector fixing part 351 and the shaft fixing part 353 and is capable of housing a wiring main body 360 of the support side wiring member 333.

The shaft fixing part 353, together with the second reinforcing part 341, is a groove part for fixing the shaft part 102, and the distal end portion of the shaft part 102 can be fitted inside thereof.

The second reinforcing part 341 is a member that reinforces the supporting strength of the fixing part 331 and protects the support side wiring member 333, and is capable of blocking the wiring groove part 350.

In addition, from another viewpoint, the fixing part 331 includes slider groove parts 355 and 356 on the end face in the lateral direction X. The slider groove parts 355 and 356 are grooves capable of passing through the slider parts 313*a* to 313*d* of the light-emitting side frame 310, and have "U" shaped cross sections. Specifically, the slider groove parts 355 and 356 are formed by the overhanging parts 348 and 349, the end face of the main body 345, and the second reinforcing part 341.

The shaft part 102 of the present embodiment can be fitted into the shaft fixing part 353 of the fixing part 331.

The support side wiring member 333 is a member for electrically connecting the panel side wiring member 304 and a printed circuit board (not shown) in the supporting member 305, and, as in FIG. 28, includes the wiring main body 360, the connecting connector portion 361, and a print side connector portion (not shown).

The wiring main body 360 is a linear body or a bundle-like body having flexibility and physically and electrically connecting between the connecting connector portion 361 and a print side connector portion connected with a printed circuit board (not shown). The connecting connector portion 361 is a connection terminal connectable with the connecting connector portion 322 of the panel side wiring member 304, specifically, it is a female connector.

Subsequently, the positional relationship of each member of the surface light-emission system 302 will be described.

The surface light-emitting module 303 is placed on the floor surface 8*b* and fixed in a vertical posture by the supporting member 305. In the supporting member 305, the fixing part 331 is inserted into the insertion space 318 of the surface light-emitting module 303, and the connecting connector portion 361 of the support side wiring member 333 is connected by being fitted with the connecting connector portion 322 of the panel side wiring member 304 in the insertion space 318.

In the fixing part 331, the support side wiring member 333 is housed in the wiring groove part 350, the ridge parts 73 and 74 of the rear face side frame 311 are inserted into the slide groove parts 346 and 347, and the slider parts 313*a* to 313*d* of the light-emitting side frame 310 are inserted into the slider groove parts 355 and 356. The surface light-emitting module 303 can move along the slide groove parts 346 and 347 and the slide groove parts 355 and 356 of the fixing part 331.

As described above, the surface light-emission system 302 is capable of switching between the direct lighting posture in which the emission surface 16 of each of the surface light-emitting panels 10 faces the living space 7 side and the indirect lighting posture in which the emission surface 16 of each of the surface light-emitting panels 10 faces the mounting surface 8*c* side. The shaft part 102, which is the rotating shaft of the surface light-emitting module 303, extends in the vertical direction (up-down direction), and is orthogonal to the floor surface 8*b*. In other words, the rotating shaft of the surface light-emitting module 303 faces the direction perpendicular to the floor surface 8*b*, and is rotatable in the circumferential direction while maintaining the upright posture with respect to the floor surface 8*b*.

According to the surface light-emission system 302 of the present embodiment, the surface light-emitting module 303 is supported by the supporting member 305 by covering the fixing part 331 of the supporting member 305. In the surface light-emitting module 303, the ridge parts 73 and 74 of the rear face side frame 311 are inserted into the slide groove parts 346 and 347, and the slider parts 313*a* to 313*d* of the light-emitting side frame 310 are inserted into the slider groove parts 355 and 356. Therefore, it is slidable upward in the extending direction of the groove parts 346, 347, 355, and 356, and attachment and detachment of the surface light-emitting module 303 to and from the supporting member 305 is easy.

Further, according to the surface light-emission system 302 of the second embodiment, the fixing part 331 is inserted into the insertion space 318 of the root (base end portion) of the surface light-emitting module 303, and the fixing part 331 receives the own weight of the surface light-emitting module 303 and a load during rotation. Therefore, it is less likely for a load to be applied to each of the surface light-emitting panels 10, and each of the surface light-emitting panels 10 is less likely to be damaged.

Subsequently, a surface light-emission system 402 of the third embodiment will be described. It is to be noted that the same reference numerals are given to the same components as those of the first and second embodiments, and the description thereof will be omitted. Regarding the positional relationship of the surface light-emission system 402, the posture of FIG. 1 is taken as a reference. That is, a supporting member 405 side is down, and a surface light-emitting module 403 side is up.

Figure 29:
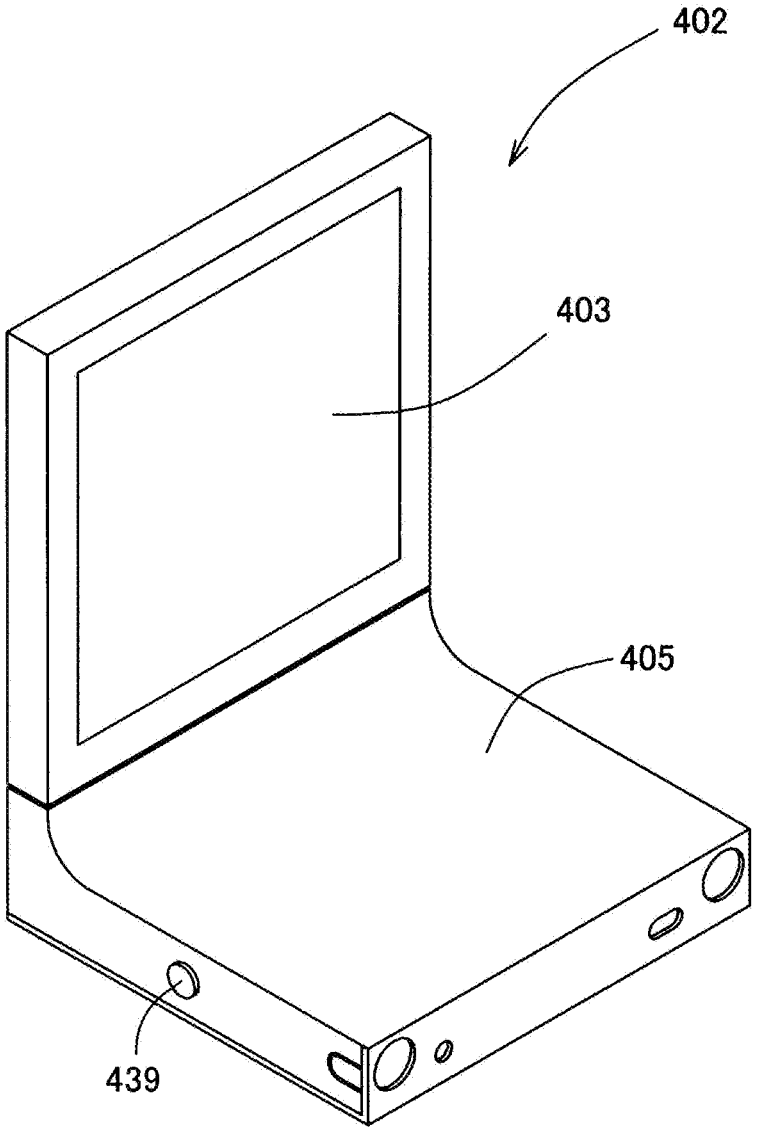
FIG. 29 is a perspective view of a surface light-emission system according to a third embodiment of the present invention.

As in FIG. 1, the surface light-emission system 402 of the third embodiment is disposed mainly in the living space 7 and is attached to the mounting surface 8*a* such as a wall. As in FIG. 29 to FIG. 31, the surface light-emission system 402 is a lighting device having an "L" shape when viewed from the side, and includes the surface light-emitting module 403, the supporting member 405, and a cover member 406.

Figure 36A:
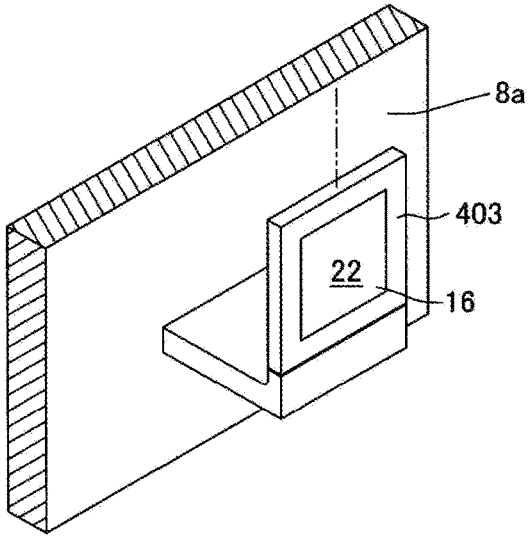
FIGS. 36A, 36B, and 36C are explanatory views of each posture of the surface light-emission system of FIG. 29, with FIG. 36A being a perspective view of a direct lighting posture, FIG. 36B being a perspective view in the middle of changing from a direct lighting posture to an indirect lighting posture, and Fig. C being a perspective view of an indirect lighting posture.
Figure 36B:
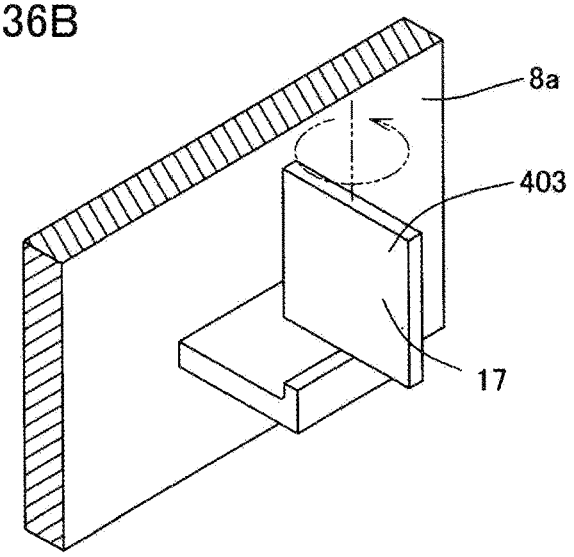
Figure 36C:
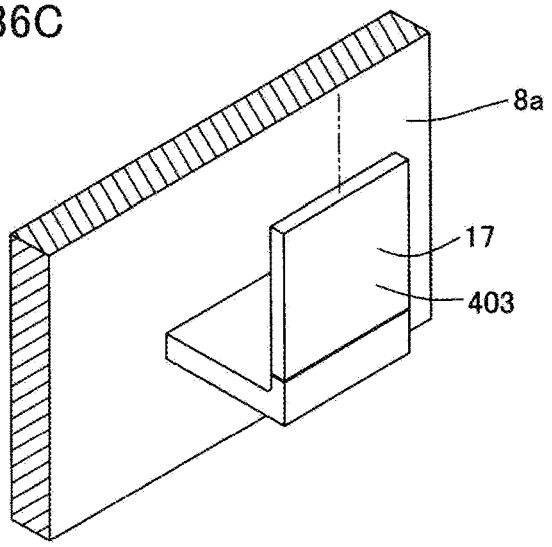

As in FIGS. 36A to 36C, the surface light-emission system 402 is capable of switching between the direct lighting posture in which the emission surface 16 faces the living space 7 side and the indirect lighting posture in which the emission surface 16 faces the mounting surface 8*a* side, by manually rotating the surface light-emitting module 403.

As in the first and second embodiments, the surface light-emission system 402 is provided with angle restriction in the circumferential rotation angle of the surface light-emitting module 403, and excessive rotation of the surface light-emitting module 403 is prevented. However, the structure of the angle restriction is different.

Figure 32:
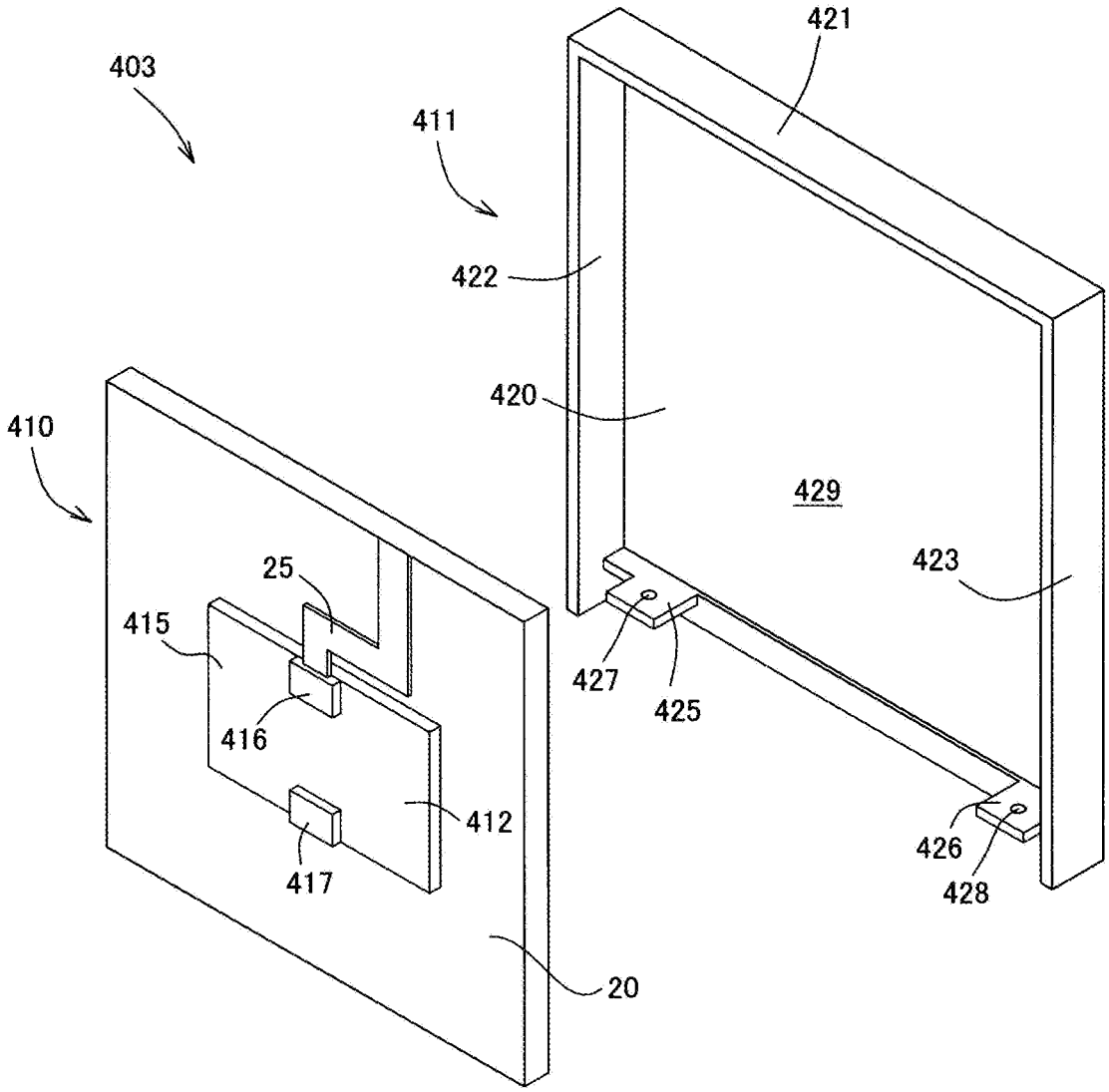
FIG. 32 is an exploded perspective view of the surface light-emitting module of FIG. 31.

As in FIG. 32, the surface light-emitting module 403 includes a surface light-emitting panel 410 and a frame member 411.

The surface light-emitting panel 410 includes the light-emitting tile 20 and a printed circuit board 412.

The printed circuit board 412 includes on a board 415, a tile connector portion 416, a wiring side connector portion 417, and a printed wiring part (not shown) that electrically connects the tile connector portion 416 and the wiring side connector portion 417.

The tile connector portion 416 is a connection terminal connectable with the tile side connector portion 26 of the power supply portion 25 of the light-emitting tile 20, specifically, a female connector, and is electrically connectable to the tile side connector portion 26 by being fitted with the tile side connector portion 26.

The wiring side connector portion 417 is a connection terminal connectable with a wiring side connector portion 442 of the support side wiring member 433, specifically, a female connector.

As in FIG. 32, the frame member 411 includes a light-emitting side cover 420, side face side covers 421, 422, and 423, and case side fixing parts 425 and 426, and includes an enclosed space 429 enclosed by them.

The light-emitting side cover 420 is a portion covering the emission surface 16 of the light-emitting tile 20 and has the identical or similar shape to that of the light-emitting tile 20. In the light-emitting side cover 420, a light scattering film is provided so as to cover the entire light-emitting region 22 of the light-emitting tile 20.

The side face side covers 421, 422, and 423 are wall parts standing upright from three sides of the light-emitting side cover 420 so as to cover the side face of the light-emitting tile 20. Specifically, the side face side cover 421 is a top face cover that covers the top face of the light-emitting tile 20, and the side face side covers 422 and 423 are left and right side-face covers that cover the left and right side faces of the light-emitting tile 20.

As in FIG. 32, the case side fixing parts 425 and 426 are plate-like portions bent from the lower end of the light-emitting side cover 420 and fixing pieces to be fixed to a support side fixing part 455 of a fixing part 431 of the supporting member 405, and includes case side fixing holes 427 and 428 in the center.

The case side fixing holes 427 and 428 are fastening holes that can be fastened with a temporary fastening element 475 (refer to FIG. 31), and in the present embodiment, the case side fixing holes 427 and 428 are screw holes threaded inward on the inner surface.

The enclosed space 429 is a space surrounded by the light-emitting side cover 420, the side face side covers 421, 422, and 423, and the case side fixing parts 425 and 426, and capable of housing the light-emitting tile 20.

The supporting member 405 is a member that is attached to the mounting surface 8*a* such as a wall surface and rotatably supports the surface light-emitting module 403, and in the present embodiment, is capable of supporting the surface light-emitting module 403 so that the emission surface 16 of the surface light-emitting panel 410 faces the horizontal direction. As in FIG. 33, the supporting member 405 includes a mounting part 430 (main body), the fixing part 431, a shaft part 432 connecting the mounting part 430 and the fixing part 431, and the support side wiring member 433.

Figure 31:
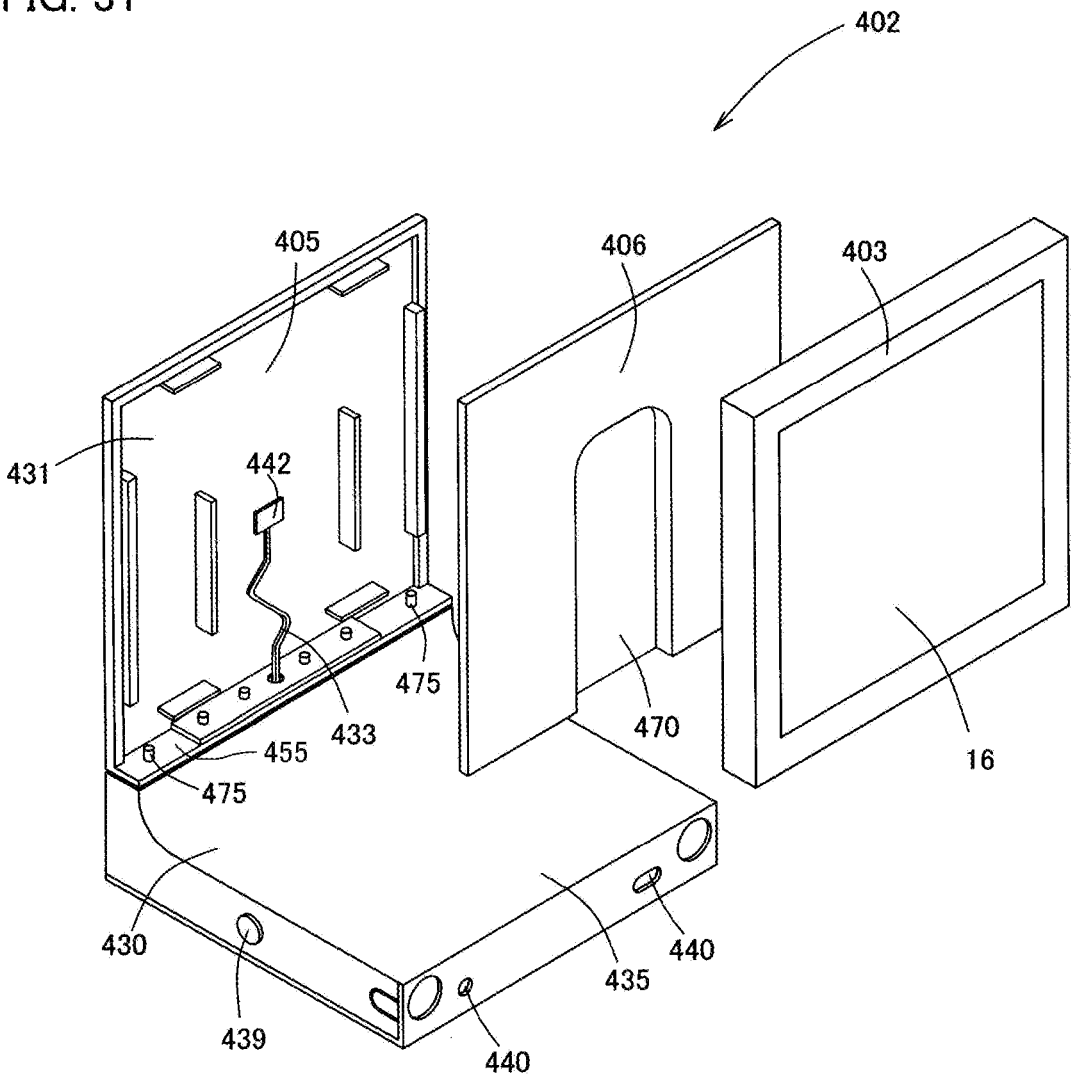
FIG. 31 is a further exploded perspective view of the surface light-emission system of FIG. 30.
Figure 33:
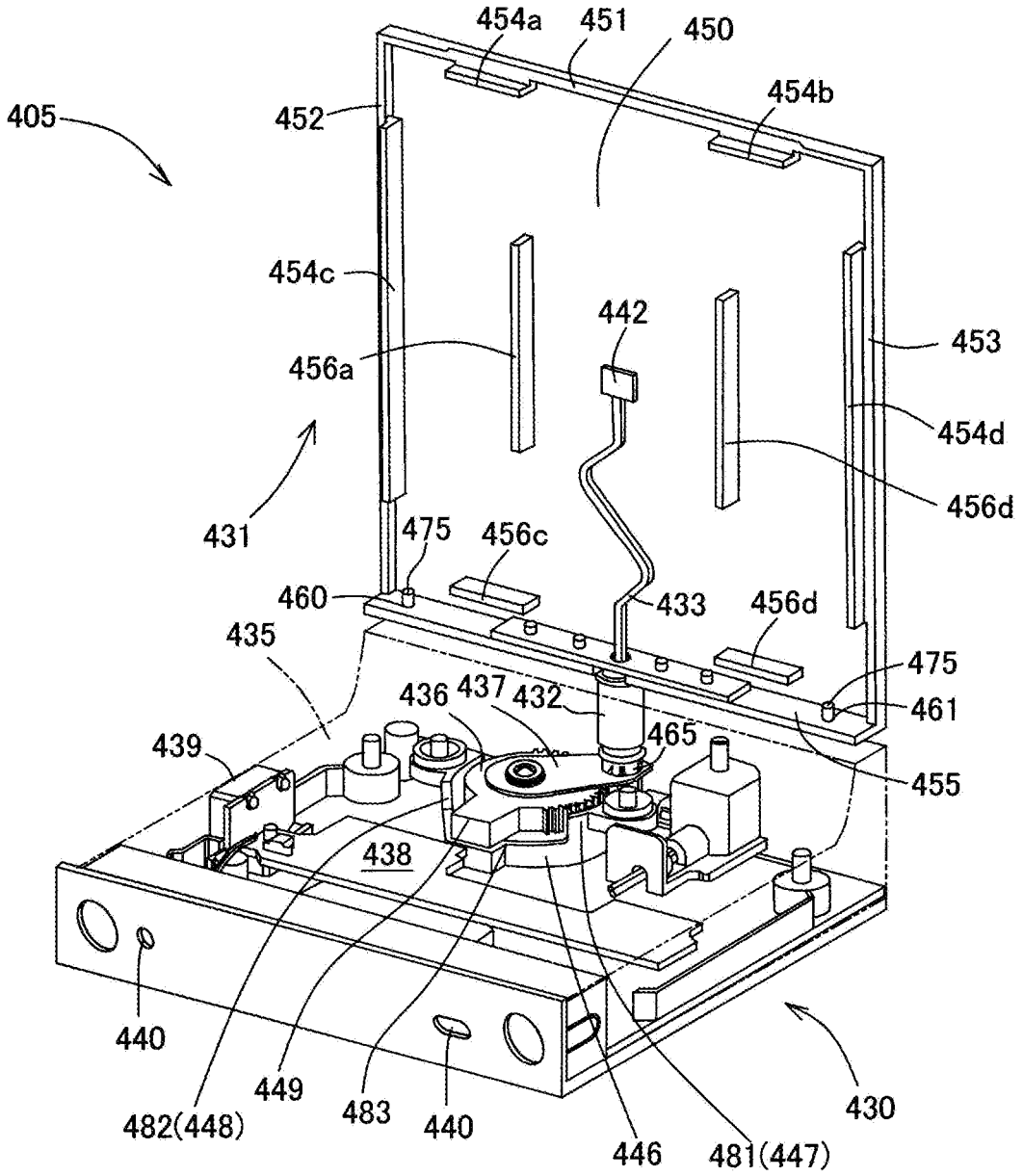
FIG. 33 is a perspective view of the supporting member of FIG. 31, with a part thereof made transparent.
Figure 34:
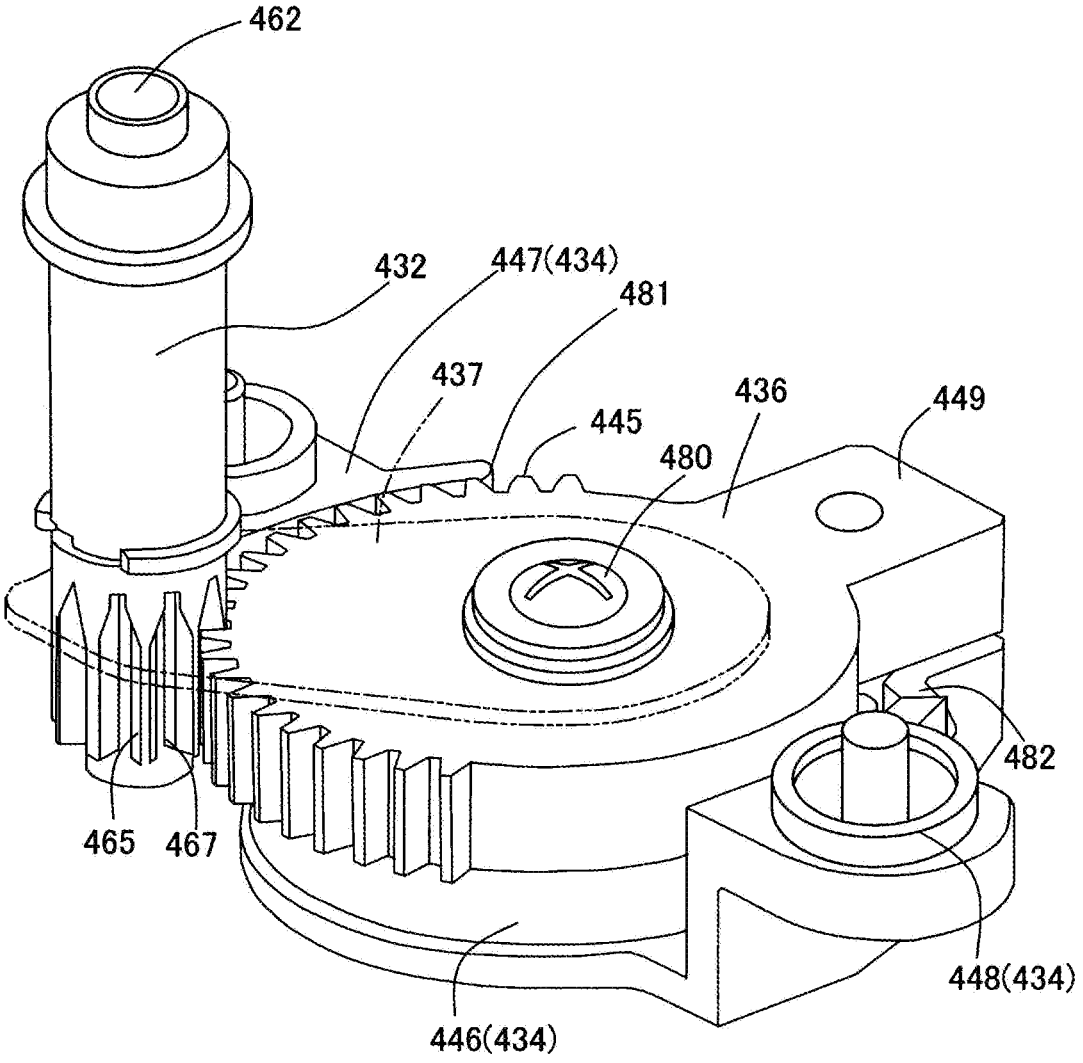
FIG. 34 is a perspective view showing a positional relationship between the gear part and the shaft part of FIG. 33.

The mounting part 430 is a box body attachable to the mounting surface 8*a* such as a wall surface, and as in FIG. 31, FIG. 33 and FIG. 34, the mounting part 430 includes a base part 434, a gear part 436 (movable range restriction unit), a coupling part 437, a printed circuit board 438, and a dimmer switch 439 as main components in a casing part 435.

The casing part 435 includes a casing side mounting part 440 attachable to the mounting surface 8*a*. The casing side mounting part 440 is provided at the end of the side opposite to the surface light-emitting module 403 of the casing part 435, and is attachable to the mounting surface 8*a* so that the surface light-emitting module 403 faces the mounting surface 8*a* by a fastening element.

The base part 434 is a supporting part that is fastened with a fastening element 480 and pivotally supports the gear part 436, and includes a base main body 446, a first locking part 447, and a second locking part 448.

The base main body 446 is a disk-like portion that includes a fastening hole that can be fastened with the fastening element 480 in the center.

The first locking part 447 is a portion for locking the forward rotation of the gear part 436 and includes a first locking wall part 481 rising from the end of the base main body 446 and extending along the edge of the base main body 446.

The second locking part 448 is a portion for locking the backward rotation of the gear part 436 and includes a second locking wall part 482 rising from the end of the base main body 446 and extending along the edge of the base main body 446. The second locking wall part 482 is provided in a position opposed to the first locking wall part 481 of the first locking part 447 so as to sandwich the base main body 446 between the second locking wall part 482 and the first locking wall part 481, and a missing part 483 along the edge of the base main body 446 is formed between the locking wall parts 481 and 482. A part of the gear part 436 can pass through the missing part 483.

The gear part 436 is a gear fixed to the bottom of the casing part 435 and provided with teeth 445 and a gear side locking part 449 on a part of its circumference as in FIG. 34. The gear part 436 has a section provided with the teeth 445 and a section not provided with the teeth 445 in the entire circumference, and the gear side locking part 449 is provided to the section not provided with the teeth 445.

It is preferable that the teeth 445 of the gear part 436 are provided in a range of ⅓ to ⅔ of the entire circumference. As in FIG. 34, the teeth 445 of the gear part 436 of the present embodiment are provided in a range of ½ of the entire circumference (corresponding to one turn of a gear part 465 of the shaft part 432). That is, the teeth 445 of the gear part 436 are provided only on a half circumference.

The gear side locking part 449 is a locking piece that protrudes in the radial direction from the other section of the gear part 436 and can be engaged with each of the first locking part 447 and the second locking part 448. The gear side locking part 449 is provided in a position opposite to the teeth 445.

The coupling part 437 is a portion that couples the gear part 436 and the shaft part 432 so that the interval therebetween becomes constant, and is also a separation preventing part that prevents the gear part 436 and the shaft part 432 from separating.

The printed circuit board 438 is a control board that controls the power supply amount to the surface light-emitting panel 410 and the like.

As in FIG. 31, the dimmer switch 439 is a switch that is provided on the outer shell of the casing part 435 and is connected to the printed circuit board 438. By pressing down the dimmer switch 439, the amount of electric current supplied to the surface light-emitting panel 410 of the surface light-emitting module 403 is changed, and the brightness can be dimmed.

Figure 35:
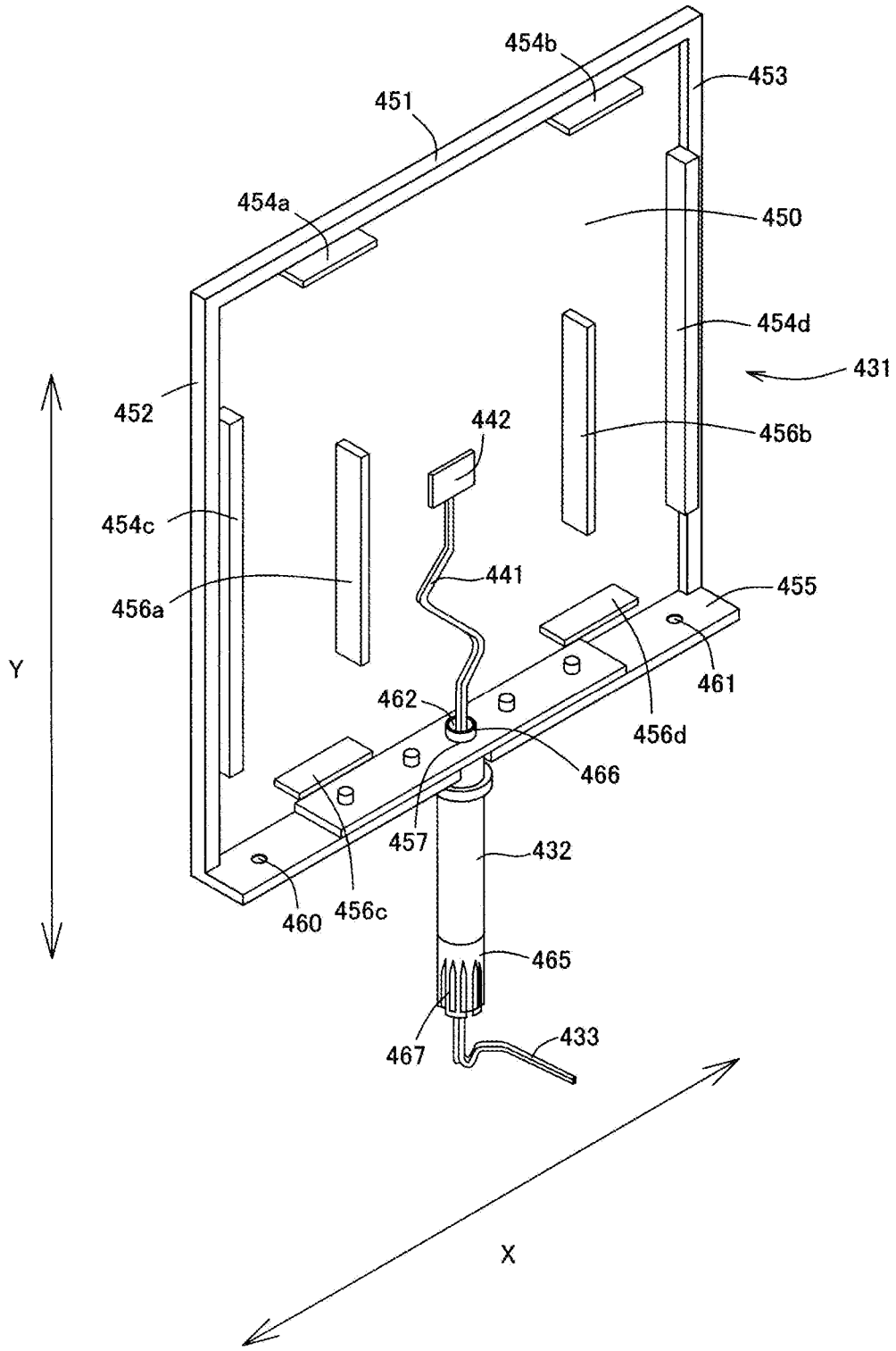
FIG. 35 is a perspective view of the vicinity of the fixing part and the shaft part of FIG. 32.

As in FIG. 33 and FIG. 35, the fixing part 431 includes a rear face forming part 450, side face forming parts 451, 452, and 453, support side engagement parts 454*a* to 454*c*, the support side fixing part 455, and interval maintaining parts 456*a* to 456*d*.

The rear face forming part 450 is a portion that forms the rear face of the surface light-emission system 402 and covers the rear face of the surface light-emitting module 403, specifically, a quadrangular-shaped plate-like portion.

The side face forming parts 451, 452, and 453 are wall portions standing upright from three sides (the upper side, the left side, and the right side) of the rear face forming part 450, and form the side surface of the surface light-emission system 402, together with the side face side covers 421, 422, and 423 of the frame member 411.

The support side engagement parts 454*a* to 454*d* are portions that can be engaged with the cover member 406. Specifically, the support side engagement parts 454*a* and 454*b* are ribs that protrude from the rear face forming part 450 to the surface light-emitting panel 410 side and extend in a left-right direction (lateral direction X), and the support side engagement parts 454*c* and 454*d* are ribs that protrude from the rear face forming part 450 to the surface light-emitting panel 410 side and extend in an up-down direction (vertical direction Y).

The support side fixing part 455 is a wall part standing upright from the lower side of the rear face forming part 450 and is horizontally elongated long plate-like. The support side fixing part 455 includes a coupling part 457 capable of coupling the end of the shaft part 432 in the longitudinal center thereof, and includes fixing side insertion holes 460 and 461 in the vicinity of both longitudinal ends.

The coupling part 457 is a shaft reception part for receiving the shaft part 432 and is a portion integrally coupling the fixing part 431 with the shaft part 432 by inserting the shaft part 432.

The fixing side insertion holes 460 and 461 are through holes that penetrate the support side fixing part 455 in the thickness direction and are insertion holes through which the temporary fastening element 475 can be inserted.

The interval maintaining parts 456*a* to 456*d* are portions for maintaining the interval between the cover member 406 and the rear face forming part 450. Specifically, the interval maintaining parts 456*a* and 456*b* are ribs that protrude from the rear face forming part 450 to the surface light-emitting panel 410 side and extend in the up-down direction (vertical direction Y), and the interval maintaining parts 456*c* and 456*d* are ribs that protrude from the rear face forming part 450 to the surface light-emitting panel 410 side and extend in the left-right direction (lateral direction X).

As in FIG. 34 and FIG. 35, the shaft part 432 is a linearly extending rod-shaped body and a hollow body having a wiring space 462 in the axial direction. The support side wiring member 433 can be inserted through the wiring space 462.

The shaft part 432 includes the gear part 465 at one end in the longitudinal direction and includes a coupling part 466 at the other end. The gear part 465 is a gear that forms a pair with the gear part 436 of the mounting part 430 and has teeth 467 that are engaged with the teeth 445 of the gear part 436 in the entire circumference. The coupling part 466 can be coupled with the coupling part 457 of the fixing part 431.

The support side wiring member 433 is a member that electrically connects the printed circuit board 412 of the surface light-emitting panel 410 and the printed circuit board 438 of the mounting part 430, and is electrically connected with an external power source via the printed circuit board 412. The support side wiring member 433 includes a wiring main body 441, the wiring side connector portion 442, and a print side connector portion (not shown).

The wiring main body 441 is a linear body or a bundle-like body having flexibility and physically and electrically connecting between the wiring side connector portion 442 and the print side connector portion connected to the printed circuit board 438.

The wiring side connector portion 442 is a connection terminal connectable with the wiring side connector portion 417 of the printed circuit board 412. Specifically, the wiring side connector portion 442 is a male connector that is electrically connectable by being fitted with the wiring side connector portion 417.

Figure 30:
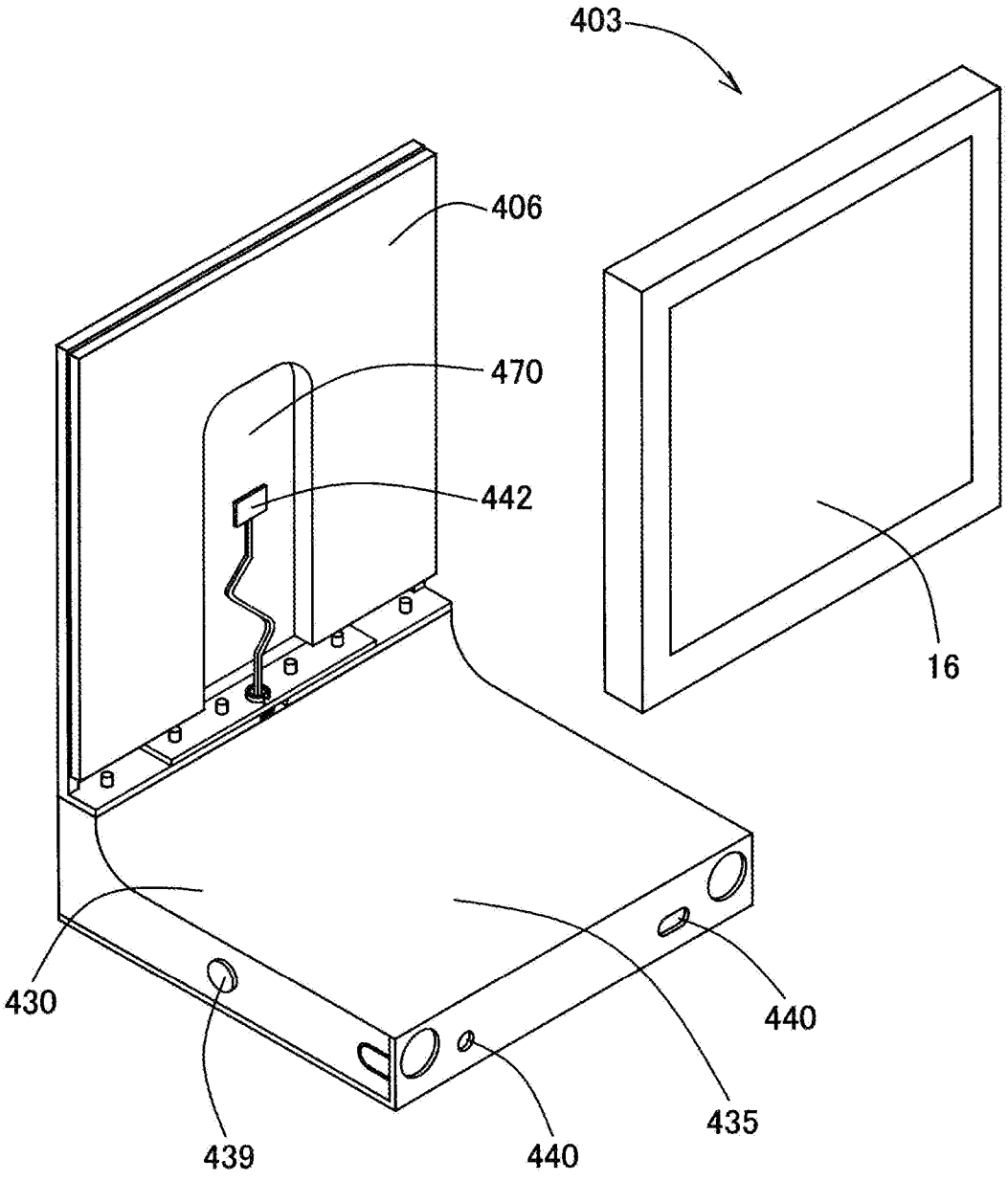
FIG. 30 is an exploded perspective view of the surface light-emission system of FIG. 29.

The cover member 406 is a member that covers the printed circuit board 412 of the surface light-emitting panel 410, and as in FIG. 30, a recessed section 470 corresponding to the printed circuit board 412 is formed.

The recessed section 470 is a depression linearly extending from the lower end toward the upper end side, and is capable of storing the printed circuit board 412.

Subsequently, the positional relationship of each member of the surface light-emission system 402 will be described.

In the surface light-emission system 402, the printed circuit board 412 is disposed on the rear face of the light-emitting tile 20, and the cover member 406 is disposed so as to cover the printed circuit board 412. That is, the printed circuit board 412 is disposed between the rear face of the light-emitting tile 20 and the recessed section 470 of the cover member 406, and most of the printed circuit board 412 is stored in the recessed section 470.

The fixing part 431 of the supporting member 405 covers the further rear face side of the cover member 406 and is inserted into the enclosed space 429 of the frame member 411 of the surface light-emitting module 403.

The case side fixing parts 425 and 426 of the frame member 411 are disposed on the upper side of the support side fixing part 455 of the supporting member 405, and the case side fixing holes 427 and 428 form one communicating hole with the fixing side insertion holes 460 and 461 of the support side fixing part 455. Then, the temporary fastening element 475 is inserted into the communicating hole, and the temporary fastening element 475 is fastened with the case side fixing holes 427 and 428, so that the surface light-emitting module 403, the supporting member 405, and the cover member 406 are integrated.

In the casing part 435 of the mounting part 430 of the supporting member 405, the gear part 436 and the shaft part 432 are coupled by the coupling part 437, and the gear part 436 is constantly in a state of being engaged with the gear part 465 of the shaft part 432. In addition, in the gear part 436, the gear side locking part 449 is located between the first locking part 447 and the second locking part 448. Therefore, the gear part 465 of the shaft part 432 is capable of rotating only in the range where the teeth 445 of the gear part 436 are formed, which is the range between the first locking part 447 and the second locking part 448, and the rotation movable range of the fixing part 431 is regulated.

The surface light-emission system 402 is capable of switching between the direct lighting posture (FIG. 36A) and the indirect lighting posture (FIG. 36C).

Figure 37A:
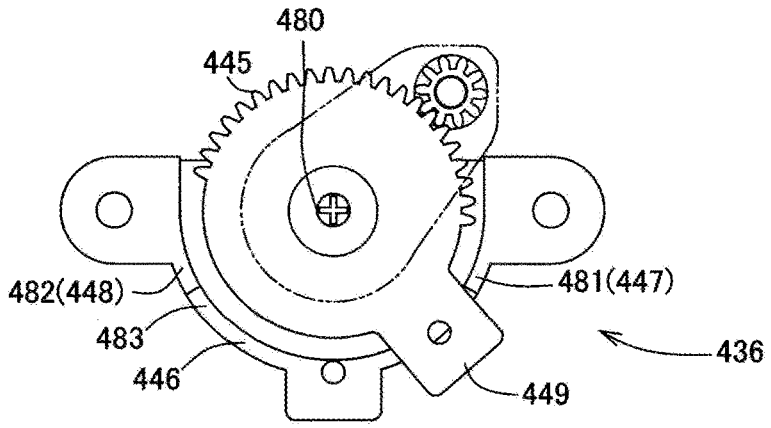
FIGS. 37A, 37B, and 37C are explanatory views of each posture of the gear part of FIG. 33, with FIG. 37A being a plan view of a direct lighting posture in the forward direction, FIG. 37B being a plan view of an indirect lighting posture, and FIG. 37C being a plan view of a direct lighting posture in the forward direction.
Figure 37B:
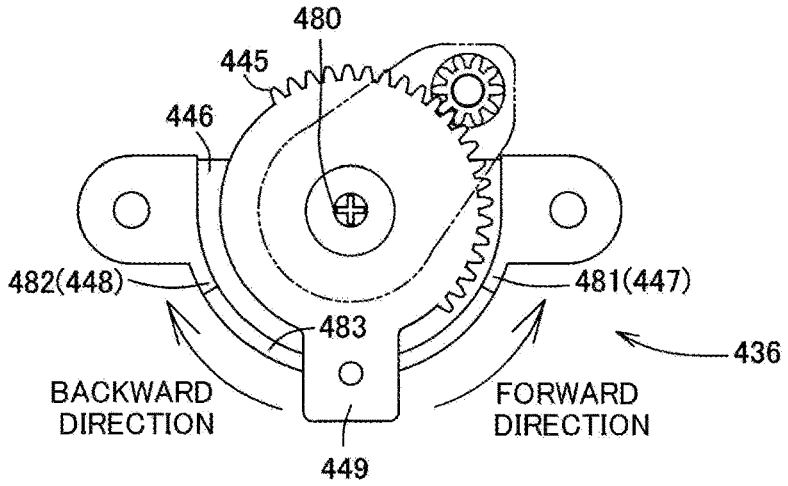

When the gear part 436 is further rotated in the forward direction in the direct lighting posture (FIG. 37A) where the gear part 436 has been rotated in the forward direction from the indirect lighting posture (FIG. 37B), the gear side locking part 449 is locked by abutting against the first locking wall part 481 and it can rotate only in the backward direction.

Figure 37C:
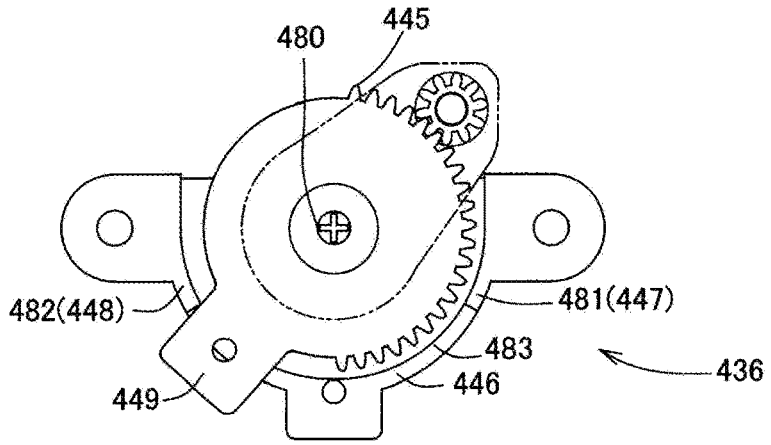

On the other hand, when the gear part 436 is further rotated in the backward direction in the direct lighting posture (FIG. 37C) where the gear part 436 has been rotated in the backward direction from the indirect lighting posture (FIG. 37B), the gear side locking part 449 is locked by abutting against the second locking wall part 482 and it can rotate only in the forward direction.

The shaft part 432, which is the rotating shaft of the surface light-emitting module 403, extends in the vertical direction (up-down direction) as in FIG. 33 in either posture of the direct lighting posture and the indirect lighting posture, and is in parallel with the mounting surface 8*a*. That is, the surface light-emitting module 403 is rotatable in the circumferential direction while maintaining the upright posture with respect to the floor surface 8*b*.

According to the surface light-emission system 402 of the third embodiment, the movable range of the gear part 436 is restricted to the range between the locking parts 447 and 448, and the rotation movable range of the surface light-emitting module 403 is restricted in the range where the teeth 445 of the gear part 436 of the mounting part 430 and the teeth 467 of the gear part 465 of the shaft part 432 are engaged. Therefore, it is easy to set the rotation movable range of the surface light-emitting module 403.

According to the surface light-emission system 402 of the third embodiment, since the surface light-emitting module 403, the supporting member 405, and the cover member 406 are integrated by the temporary fastening element 475, the surface light-emitting module 403 can be easily replaced by removing the temporary fastening element 475.

Subsequently, a surface light-emission system 502 of the fourth embodiment will be described. It is to be noted that the same reference numerals are given to the same components as those of the first to third embodiments, and the description thereof will be omitted.

The surface light-emission system 502 of the fourth embodiment is different in the structure of supporting member from the surface light-emission system 402 of the third embodiment.

Figure 38:
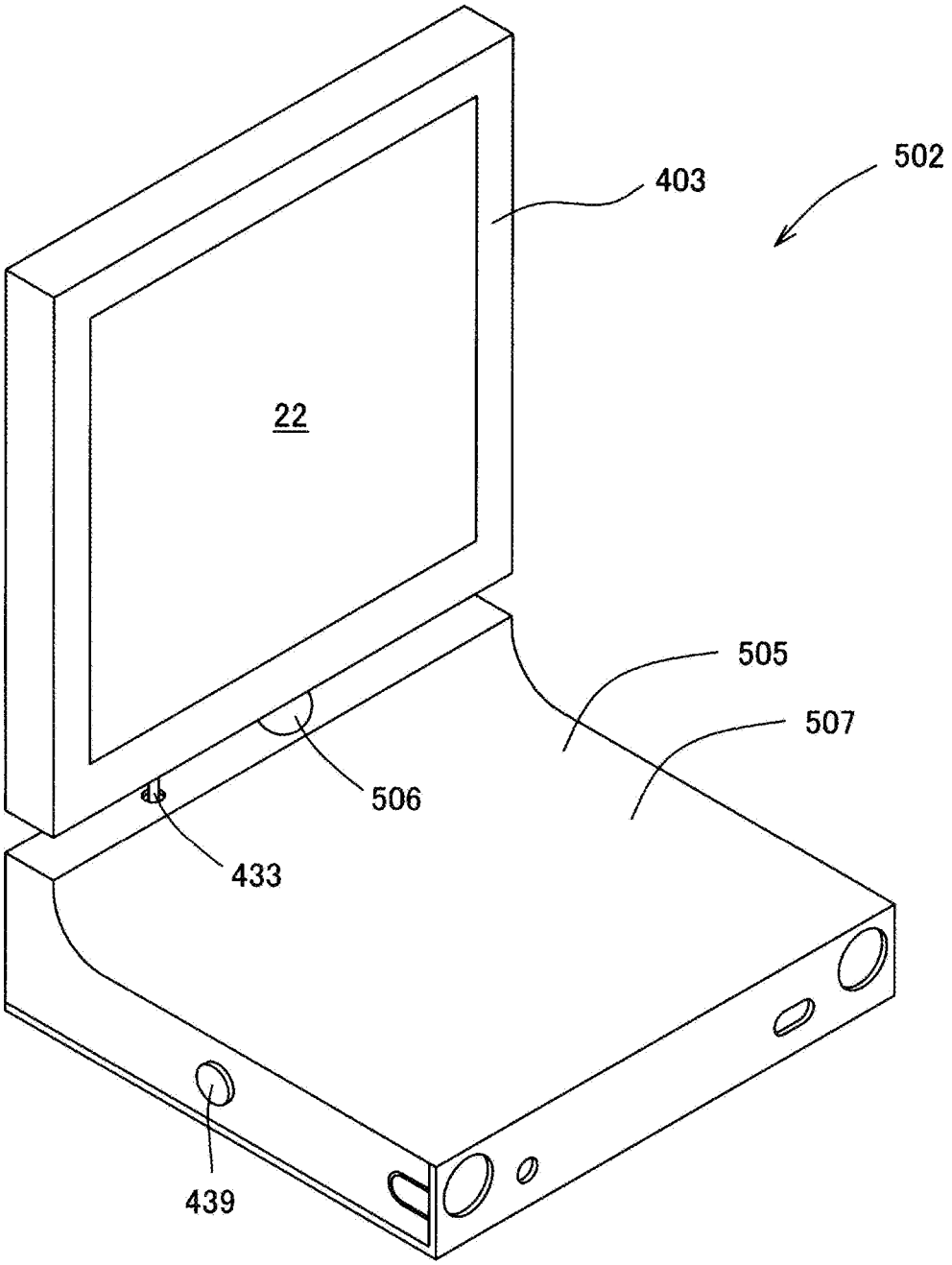
FIG. 38 is a perspective view of a surface light-emission system according to a fourth embodiment of the present invention.
Figure 39:
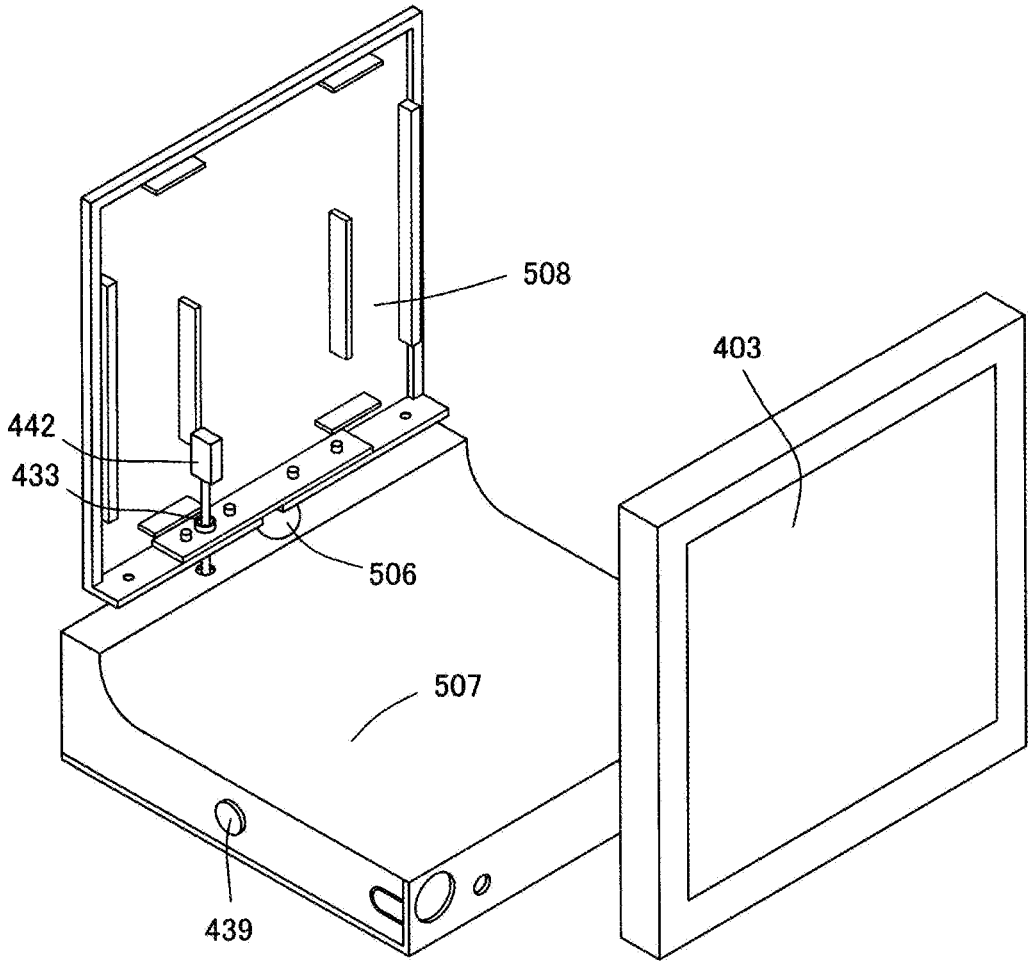
FIG. 39 is an exploded perspective view of the surface light-emission system of FIG. 38.

As in FIG. 38 and FIG. 39, a supporting member 505 of the fourth embodiment has a mounting part 507 (main body), a fixing part 508, and the support side wiring member 433, and the mounting part 507 and the fixing part 508 are coupled with each other so as to be relatively bendable by a universal joint part 506. That is, the supporting member 505 has an interval between the mounting part 507 and the fixing part 508, and the universal joint part 506 is disposed in the interval.

Figure 40:
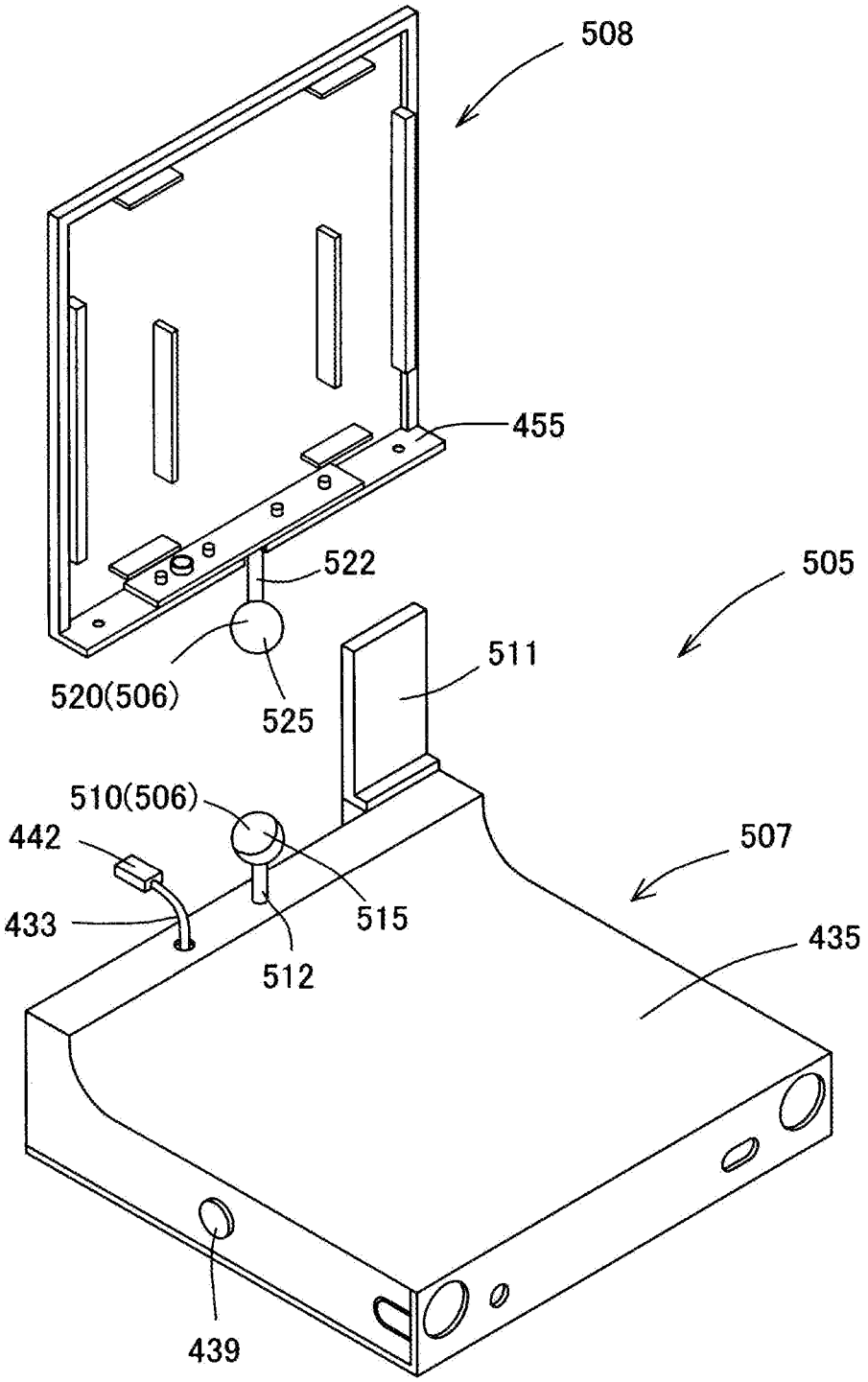
FIG. 40 is an exploded perspective view of the supporting member of FIG. 39.

The mounting part 507 includes the same internal structure as that of the mounting part 430 of the third embodiment, and includes a first joint part 510 and a regulating part 511 as in FIG. 40.

The first joint part 510 constitutes a part of the universal joint part 506, and is composed of a first shaft portion 512 and a reception part 515. The first shaft portion 512 is a rod-shaped portion connecting the casing part 435 and the reception part 515, and is upright with respect to the casing part 435. The reception part 515 is a recessed section with a spherical inner surface, and an opening faces upward.

The regulating part 511 is a member for regulating the rotation angle of the fixing part 508, and is a projecting part projecting upward from the top face of the casing part 435. The projecting length of the regulating part 511 is longer than the interval between the mounting part 507 and the fixing part 508 and is preferably ⅕ or more of one side of the surface light-emitting module 403.

The fixing part 508 includes a second joint part 520 in addition to the fixing part 431 of the third embodiment.

The second joint part 520 is composed of a second shaft portion 522 and a head part 525. The second shaft portion 522 is a rod-shaped portion connecting the support side fixing part 455 and the head part 525, and is upright with respect to the support side fixing part 455. The head part 525 is a protrusion with a spherical outer surface.

Subsequently, the positional relationship of each member of the surface light-emission system 502 will be described.

The head part 525 of the second joint part 520 is fitted with the reception part 515 of the first joint part 510, and the surface light-emitting module 403 is coupled to the supporting member 505 so as to be bendable. The regulating part 511 is disposed on the rear face side of the surface light-emitting module 403 and the circumferential rotation with the first shaft portion 512 and/or the second shaft portion 522 of the surface light-emitting module 403 as a rotating shaft is regulated.

According to the surface light-emission system 502 of the present embodiment, since the surface light-emitting module 403 is coupled to the supporting member 505 so as to be bendable, the movable range of the surface light-emitting module 403 is wide and it is easy to install in a desired posture.

Figure 41:
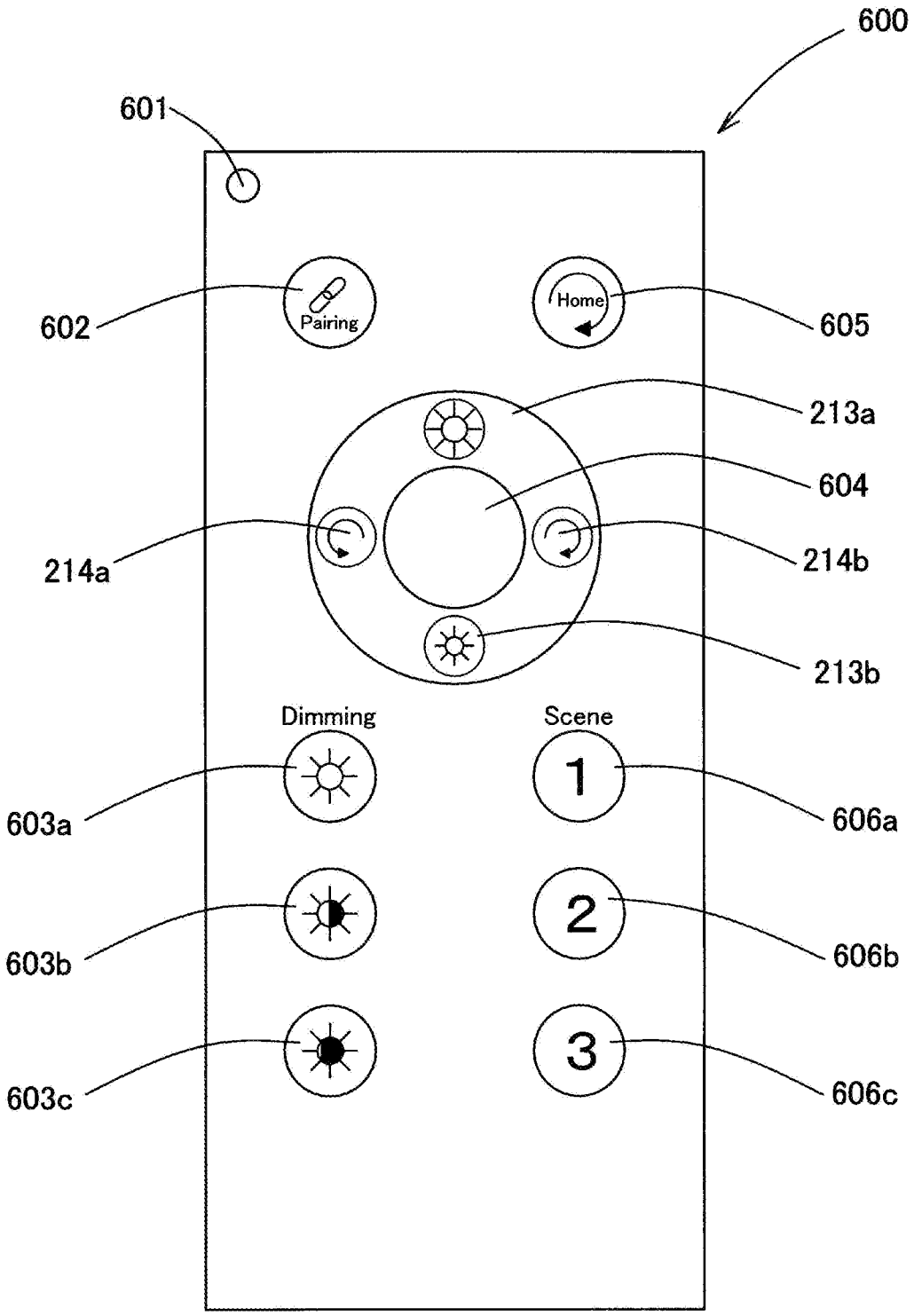
FIG. 41 is a front view of an example of an external terminal usable for the surface light-emission system according to each embodiment of the present invention.

In the above-described first and second embodiments, an external terminal 600 shown in FIG. 41 can also be preferably used.

The external terminal 600 is a remote controller and includes an indicator part 601, a registration button 602, the angle change buttons 214*a* and 214*b*, set brightness change buttons 603*a* to 603*c*, a power button 604, a home button 605, the dimmer buttons 213*a* and 213*b*, and light reproduction buttons 606*a* to 606*c*.

The indicator part 601 is a portion for displaying the operation state and the battery state of the external terminal 600. It lights when another button is pressed down, and blinks when the battery capacity falls below a certain level.

The registration button 602 is a button for registering the surface light-emission system of the operation target and linking the surface light-emission systems 2 and 302 and the external terminal 600.

The set brightness change buttons 603*a* to 603*c* are buttons for changing the brightness of the surface light-emitting modules 3 and 303 to a predetermined brightness set in advance. The brightness set in advance is divided into a plurality of stages, and it is preferably changed by pressing down the corresponding set brightness change buttons 603*a* to 603*c*.

The power button 604 is a button for turning on/off the surface light-emitting modules 3 and 303 when pressed down.

The home button 605 is a button for returning the surface light-emitting modules 3 and 303 to a preset reference angular position.

The light reproduction buttons 606*a* to 606*c* are buttons for storing the current brightness and angle when pressed down, and reproducing the stored brightness and angle when pressed down again.

While in the above-described first embodiment, the surface light-emitting module 3 is fixed to the mounting surface 8*a* in a lateral posture extending in the lateral direction, the present invention is not limited thereto. The surface light-emitting module 3 may be fixed to the mounting surface 8*a* in another posture. For example, the surface light-emitting module 3 may be fixed to the mounting surface 8*a* in a vertical posture extending in the vertical direction (up-down direction).

While in the above-described first and second embodiments, the remote controller is used as the external terminals 210 and 600, the present invention is not limited thereto. The external terminal 210 may be a mobile terminal such as a mobile phone or a fixed terminal such as a switch fixed to a wall or the like.

While in the above-described first and second embodiments, the light-emitting tiles 20 are electrically connected in series via the power supply members 12*a* and 12*b*, the present invention is not limited thereto. The light-emitting tiles 20 may be electrically connected in parallel via the power supply members 12*a* and 12*b*.

While in the above-described embodiments, the members constituting the supporting member rotate relative to each other therebetween and the surface light-emitting modules mounted thereto rotates, the present invention is not limited thereto. The members constituting the surface light-emitting module may rotate relatively to each other therebetween.

While in the above-described embodiments, the supporting member directly supports the surface light-emitting module so as to be rotatable, the present invention is not limited thereto. The supporting member may indirectly support the surface light-emitting module so as to be rotatable via a separate member.

While in the above-described fourth embodiment, the reception part 515 is provided on the mounting part 507 side and the head part 525 is provided on the fixing part 508 side, the present invention is not limited thereto. The head part 525 may be provided on the mounting part 507 side and the reception part 515 may be provided on the fixing part 508 side.

While in the above-described fourth embodiment, the universal joint part 506 is a coaxial universal joint in which the movable points in two directions coincide, the present invention is not limited thereto. The universal joint part 506 may be a universal joint in which the movable points in two directions are displaced in the axial direction.

While in the above-described embodiments, the supporting member directly supports the surface light-emitting module so as to be rotatable, the present invention is not limited thereto. The supporting member may indirectly support the surface light-emitting module so as to be rotatable via another member.

In the above-described embodiments, each of the constituent members can freely be replaced or added between each of the embodiments as long as it is within the technical scope of the present invention.

EXPLANATION OF REFERENCE CHARACTERS

1, 301: lighting system
2, 302, 402, 502: surface light-emission system
3, 303, 403: surface light-emitting module
5*a*, 5*b*, 305, 405, 505: supporting member (supporting part)
8*a*: mounting surface
10, 10*a* to 10*j*, 410: surface light-emitting panel
11, 306, 411: frame member
16: emission surface
100, 150, 330, 430, 507: mounting part (main body)
101, 151, 331, 431, 508: fixing part
102, 152, 432: shaft part
104: clutch
106: motor
116, 117: angle restriction sensor (movable range restriction unit)
140, 462: wiring space
210, 600: external terminal (signal transmission unit)
340: first reinforcing part (reinforcing member)
341: second reinforcing part (reinforcing member)
436: gear part (movable range restriction unit)
506: universal joint part (universal joint)

The invention claimed is:

1. A surface light-emission system comprising:
a surface light-emitting module that includes a surface light-emitting panel having an emission surface; and
a supporting part that supports the surface light-emitting module rotatably in a circumferential direction directly or indirectly,
wherein the supporting part is capable of supplying electric power to the surface light-emitting panel,
wherein the supporting part includes a movable range restriction unit that restricts a movable range of the surface light-emitting module in the circumferential direction,
the supporting part comprises a main body, a fixing part, a shaft part, and a wiring part,
the fixing part is coupled to the main body via the shaft part, and the fixing part is rotatable in the circumferential direction relative to the main body;
the shaft part is a hollow body with a wiring space within the hollow body, and
the wiring part is electrically connectable with an external power source, and electrically connected from the main body to the surface light-emitting panel through the wiring space of the shaft part.

2. The surface light-emission system according to claim 1, wherein the movable range restriction unit restricts the movable range of rotation in the circumferential direction of the surface light-emitting module to less than 360 degrees.

3. The surface light-emission system according to claim 1, wherein the movable range restriction unit physically regulates the movable range of rotation in the circumferential direction of the surface light-emitting module.

4. The surface light-emission system according to claim 1,
wherein the supporting part includes a motor and a clutch, and
wherein a rotational force of the motor is transmitted via the clutch, so that the surface light-emitting module rotates in the circumferential direction.

5. The surface light-emission system according to claim 1,
wherein the surface light-emitting module is fixed to the fixing part with a temporary fastening element.

6. The surface light-emission system according to claim 1,
wherein the surface light-emitting module includes:
at least two of the surface light-emitting panels; and
a frame member that protects the two surface light-emitting panels, and
wherein the two surface light-emitting panels are fixed in a state of being brought into contact with or close proximity to each other by the frame member.

7. The surface light-emission system according to claim 1,
wherein the supporting part is capable of attaching the surface light-emitting module to a mounting surface, and
wherein when the surface light-emitting module is attached to the mounting surface, the supporting part is capable of retaining the surface light-emitting module with the emission surface facing the mounting surface.

8. The surface light-emission system according to claim 1, wherein the supporting part supports a lower end portion of the surface light-emitting module, and wherein a reinforcing member is provided at a connection portion connecting the supporting part to the surface light-emitting module.

9. The surface light-emission system according to claim 1, wherein the fixing part and the main body are connected via a universal joint.

10. A lighting system comprising:

the surface light-emission system according to claim 1; and a signal transmission unit that transmits a predetermined operation signal to the surface light-emission system, wherein the surface light-emission system includes a signal reception unit, and wherein the signal reception unit receives the operation signal from the signal transmission unit, so that the surface light-emission system performs an operation based on the operation signal.

11. The lighting system according to claim 10, wherein the signal reception unit receives an operation signal related to a posture from the signal transmission unit, so that the surface light-emission system changes the surface light-emitting module to a preset posture or keeps the surface light-emitting module in the preset posture.

12. A lighting system comprising:

at least two of the surface light-emission systems according to claim 1, the at least two of the surface light-emission systems including a first surface light-emission system and a second surface light-emission system; and a signal transmission unit that transmits a predetermined operation signal to the first and the second surface light-emission systems, wherein the first surface light-emission system includes a first signal reception unit, wherein the second surface light-emission system includes a second signal reception unit, and wherein a posture of a surface light-emitting module of the second surface light-emission system is synchronized with a posture of a surface light-emitting module of the first surface light-emission system when the second signal reception unit receives an operation signal related to synchronization from the signal transmission unit.

13. A method for reproducing a preset lighting space, using at least two surface light-emission systems, the two surface light-emission systems each comprising:

a surface light-emitting module; and a supporting part that rotatably supports the surface light-emitting module, the two surface light-emission systems each having a signal reception unit, respectively, the method further using a signal transmission unit that transmits an operation signal related to synchronization to the two surface light-emission systems, the method comprising:

transmitting the operation signal related to synchronization to the respective signal reception units of the two surface light-emission systems with the signal transmission unit; and changing the surface light-emitting modules of the two surface light-emission systems to a preset posture, or keeping the surface light-emitting modules in the preset posture, thereby reproducing the preset lighting space.

14. The surface light-emission system of claim 1, wherein the movable range restriction unit is an angle restriction sensor.

15. The method of claim 13, wherein a rotation angle of the surface light-emitting module is restricted by an angle restriction sensor configured to detect the rotation angle of the surface light-emitting module.

* * * * *